US012287099B2

(12) United States Patent
Lin

(10) Patent No.: US 12,287,099 B2
(45) Date of Patent: Apr. 29, 2025

(54) DOOR BODY STRUCTURE AND COOKING DEVICE

(71) Applicants: GUANGDONG MIDEA KITCHEN APPLIANCES MANUFACTURING CO., LTD., Guandong (CN); MIDEA GROUP CO., LTD., Guangdong (CN)

(72) Inventor: Jingsheng Lin, Guandong (CN)

(73) Assignees: GUANGDONG MIDEA KITCHEN APPLIANCES MANUFACTURING CO., LTD., Guandong (CN); MIDEA GROUP CO., LTD., Guangdong (CN)

( * ) Notice: Subject to any disclaimer, the term of this patent is extended or adjusted under 35 U.S.C. 154(b) by 453 days.

(21) Appl. No.: 17/720,635

(22) Filed: Apr. 14, 2022

(65) Prior Publication Data

US 2023/0296258 A1 Sep. 21, 2023

Related U.S. Application Data

(63) Continuation of application No. PCT/CN2022/085199, filed on Apr. 2, 2022.

(30) Foreign Application Priority Data

Mar. 18, 2022 (CN) ..... 202210272536.3
Mar. 18, 2022 (CN) ..... 202210272540.X
(Continued)

(51) Int. Cl.
*F24C 15/02* (2006.01)
*F24C 7/02* (2006.01)

(52) U.S. Cl.
CPC ..... *F24C 15/022* (2013.01); *F24C 7/02* (2013.01); *F24C 15/024* (2013.01)

(58) Field of Classification Search
CPC ..... F24C 15/022; F24C 15/024; F24C 7/02
See application file for complete search history.

(56) References Cited

U.S. PATENT DOCUMENTS

2007/0175891 A1* 8/2007 Maeda ..... F24C 15/022 219/720
2017/0051542 A1* 2/2017 Reske ..... E05B 63/244
2019/0316380 A1 10/2019 Kim et al.

FOREIGN PATENT DOCUMENTS

CN 1942712 A 4/2007
CN 202928267 U 5/2013
(Continued)

OTHER PUBLICATIONS

Rejection Decision dated Aug. 15, 2023 received in Chinese Patent Application No. CN 202210273320.9.
(Continued)

*Primary Examiner* — Ko-Wei Lin
(74) *Attorney, Agent, or Firm* — Scully, Scott, Murphy & Presser, P.C.

(57) ABSTRACT

A door body structure and a cooking device are provided. The cooking device has a housing that includes a limiting portion. The door body structure has a door body, an engagement member, a switching member, and a handle. The door body is arranged on the housing. The engagement member is arranged on the door body and has a hook. The hook is configured to be engaged with or disengaged from the limiting portion. The switching member is configured to cooperate with the engagement member to drive the engagement member to move between a first position and a second position. The switching member has a connecting segment connected to the engagement member and an operating member slidingly engaged with the connecting segment. The handle is provided on the door body and has a locking groove defined therein.

23 Claims, 41 Drawing Sheets

(30) Foreign Application Priority Data

| | | |
|---|---|---|
| Mar. 18, 2022 | (CN) | 202210273300.1 |
| Mar. 18, 2022 | (CN) | 202210273313.9 |
| Mar. 18, 2022 | (CN) | 202210273320.9 |

(56) References Cited

FOREIGN PATENT DOCUMENTS

| | | | |
|---|---|---|---|
| CN | 104196363 | A | 12/2014 |
| CN | 106733244 | A | 5/2017 |
| CN | 20660796 | U | 11/2017 |
| CN | 209588119 | U | 11/2019 |
| CN | 111227632 | A | 6/2020 |
| CN | 112031555 | A | 12/2020 |
| CN | 212281028 | U | 1/2021 |
| CN | 212546582 | U | 2/2021 |
| CN | 112469156 | A | 3/2021 |
| CN | 212912769 | U | 4/2021 |
| CN | 212958380 | U | 4/2021 |
| CN | 213654511 | U | 7/2021 |
| CN | 213898527 | U | 8/2021 |
| CN | 213927916 | U | 8/2021 |
| CN | 21436544 | U | 10/2021 |
| CN | 215255347 | U | 12/2021 |
| CN | 215949159 | U | 3/2022 |
| EP | 2011936 | A1 | 1/2009 |

OTHER PUBLICATIONS

Rejection Decision dated Aug. 8, 2023 received in Chinese Patent Application No. CN 202210272540.X.
Second Office Action dated Jul. 15, 2023 received in Chinese Patent Application No. CN 202210273313.9.
Third Office Action dated Sep. 19, 2023 received in Chinese Patent Application No. CN 202210273313.9.
Second Office Action dated Oct. 25, 2022 received in Chinese Patent Application No. CN 202210273300.1.
First Office Action dated Oct. 31, 2022 received in Chinese Patent Application No. CN 202210272540.X.
First Office Action dated Nov. 16, 2022 received in Chinese Patent Application No. CN 202210273320.9.
First Office Action dated Nov. 24, 2022 received in Chinese Patent Application No. CN 202210273313.9.
International Search report dated Nov. 30, 2022 received in International Application No. PCT/CN2022/085199.
Rejection Decision dated Mar. 27, 2023 received in Chinese Patent Application No. CN 202210273300.1.
Second Office Action dated Apr. 29, 2023 received in Chinese Patent Application No. CN 202210273320.9.
Second Office Action dated May 11, 2023 received in Chinese Patent Application No. CN 202210272540.X.
First Office Action dated May 31, 2022 received in Chinese Patent Application No. CN 202210273300.1.
First Office Action and First Search Report dated Nov. 14, 2024 received in Chinese Patent Application No. 202210272536.3.

* cited by examiner

DOOR BODY STRUCTURE AND COOKING DEVICE

CROSS-REFERENCE TO RELATED APPLICATIONS

The present application is a continuation application of PCT International Application No. PCT/CN2022/085199, which claims priorities to and benefits of Chinese Patent Application No. 202210272536.3, entitled "DOOR BODY STRUCTURE AND COOKING DEVICE", and filed on Mar. 18, 2022, Chinese Patent Application No. 202210273313.9, entitled "DOOR BODY STRUCTURE AND COOKING APPLIANCE", and filed on Mar. 18, 2022, Chinese Patent Application No. 202210273320.9, entitled "DOOR BODY STRUCTURE AND COOKING APPLIANCE", and filed on Mar. 18, 2022, Chinese Patent Application No. 202210273300.1, entitled "DOOR BODY STRUCTURE AND HOUSEHOLD APPLIANCE", and filed on Mar. 18, 2022, and Chinese Patent Application No. 202210272540.X, entitled "DOOR BODY STRUCTURE AND HOUSEHOLD APPLIANCE", and filed on Mar. 18, 2022, the entire contents of which are incorporated herein by reference for all purposes. No new matter has been introduced.

FIELD

The present disclosure relates to the field of cooking device technologies, and more particularly, to a door body structure and a cooking device.

BACKGROUND

Since most common cooking appliances do not have child locks, a child may be scalded when opening the door of the cooking appliance for various reasons. Therefore, electric child locks and complicated mechanical child locks are available on the market. These child locks have common disadvantages of a complicated structure and high costs. Furthermore, for the cooking appliance with the child lock available on the market, the child lock is a burden without being used.

SUMMARY

Embodiments of the present disclosure provide a door body structure and a cooking device.

According to an embodiment of the present disclosure, a door body structure is applied for a cooking device. The cooking device includes a housing including a limiting portion. The door body structure includes: a door body arranged on the housing in an openable and closable manner; an engagement member arranged on the door body and including a hook, the hook being configured to be engaged with or disengaged from the limiting portion; a switching member configured to cooperate with the engagement member to drive the engagement member to move between a first position and a second position, the switching member including a connecting segment connected to the engagement member and an operating member slidingly engaged with the connecting segment; and a handle provided on the door body and having a locking groove defined therein. When the engagement member is located at the first position, the hook is engaged with the limiting portion, and at least a part of the operating member is located within the locking groove to limit a movement of the engagement member. When the operating member is disengaged from the locking groove, the switching member is capable of driving the engagement member to move relative to the door body.

Optionally, the locking groove is disposed within an accommodation space defined between the handle and the door body.

Optionally, an included angle is formed between a sliding direction of the operating member and a movement direction of the engagement member.

Optionally, a part of the connecting segment is located within the accommodation space. The operating member is configured to be slidingly engaged with the part of the connecting segment located within the accommodation space. When the operating member is disengaged from the locking groove, the handle being pulled towards a direction facing away from the door body drives the engagement member to move in such a manner that the hook is disengaged from the limiting portion.

Optionally, a surface of the handle facing towards the door body is an inner side surface including a first engagement surface and a holding surface. The locking groove is connected to the first engagement surface at a top surface thereof and is connected to the holding surface at a bottom surface thereof to define a stepped surface, and the stepped surface is located below the connecting segment to limit a movement of the connecting segment.

Optionally, one of the operating member and the connecting segment has a sliding rail provided thereon, and the other one of the operating member and the connecting segment has a sliding groove defined therein. The sliding rail and the sliding groove are slidably engaged with each other.

Optionally, the operating member is made of a flexible material for attenuating, when the operating member is entering the locking groove, a collision force between the operating member and the locking groove.

Optionally, the hook is formed into a downwardly bent barb structure.

Optionally, the hook includes a connecting arm and an engagement portion. The connecting arm is connected to a main body of the engagement member. The engagement portion extends from an end of the connecting arm facing away from the main body towards the door body while being bent to form the barb structure.

Optionally, the door body has a through hole defined therein, and a part of the engagement member passes through the through hole to be positioned outside the door body to define the connecting segment.

Optionally, the operating member extends obliquely upwards in a direction from the handle to the door body; or the operating member extends obliquely downwards in a direction from the handle to the door body.

Optionally, the door body structure further includes a restoring member connected to each of the door body and the engagement member. The restoring member is configured to provide the engagement member with a force for moving the engagement member from the second position to the first position.

Optionally, the restoring member is a spring. The spring is hooked to and engaged with the door body and the engagement member at both ends thereof, respectively.

Optionally, the door body structure further includes a damping member arranged on the limiting portion and configured to attenuate, when the engagement member is moving into the first position, a collision force between a hook and the limiting portion.

According to an embodiment of the present disclosure, a cooking device includes a housing and the above-mentioned door body structure. The door body structure is arranged on the housing in an openable and closable manner.

In the door body structure and the cooking device according to the embodiments of the present disclosure, when the engagement member is located at the first position, the hook is engaged with the limiting portion, and the at least part of the operating member is located within the locking groove to limit the movement of the engagement member, such that a child lock protection function can be implemented, which effectively prevents a door of the cooking device from being directly opened due to pulling of the handle, guarantees safety of a door opening process of the cooking device, and reduces the possibility of scalding injuries caused by food in cooking when the door body is opened by mis-operation. When the operating member is disengaged from the locking groove, the child lock protection function can be disabled, and the switching member drives the engagement member to move relative to the door body to open the door. Moreover, since switching between an implementation of the child lock protection function and disabling of the child lock protection function can be realized simply by sliding the operating member, the door body structure, compared with electric child locks and complicated mechanical child locks in the related art, has a simple structure and lowered costs.

According to an embodiment of the present disclosure, a door body structure includes a door body, an engagement member, and a switching member. The door body is connected to a housing in an openable and closable manner. The housing includes a limiting portion. The engagement member is arranged on the door body. The switching member is configured to drive the engagement member to move relative to the door body between a first position and a second position. The switching member is formed by a part of the engagement member protruding from an outer side of the door body. The engagement member is configured to be engaged with the limiting portion when the engagement member is at the first position, and to be disengaged from the limiting portion when the engagement member is at the second position.

In the door body structure and the cooking device according to the embodiments of the present disclosure, the engagement member is slidable, relative to the door body, between the first position and the second position, and the switching member is fixedly connected to the engagement member and protrudes from the outer side of the door body. In this way, the engagement member can be drive through pushing the switching member by the user to slide to control engagement and cooperation between the engagement member and the limiting portion, thereby avoiding loud noises generated from collisions between the engagement member and the limiting portion when the door is opened or closed. Therefore, the operation is simple and convenient, the noises generated when opening and closing the door are effectively attenuated, and user experience is improved.

According to an embodiment of the present disclosure, a door body structure includes a door body, an engagement member, and a switching member. The door body is connected to a housing in an openable and closable manner. The housing includes a limiting portion. The engagement member is arranged on the door body and includes a hook. The hook is formed with a barb structure facing towards the door body. The switching member is configured to drive the engagement member to move relative to the door body between a first position and a second position. The switching member is formed by a part of the engagement member protruding from an outer side of the door body. The hook is configured to be engaged with the limiting portion by the barb structure to prevent the door body from being opened when the engagement member is at the first position, and to be disengaged from the limiting portion to allow the door body to be opened when the engagement member is at the second position.

In the door body structure and the cooking device according to the embodiments of the present disclosure, the engagement member includes the hook, the hook is formed with the barb structure, and the switching member is configured to drive the engagement member to move relative to the door body between the first position and the second position, such that the hook can be engaged with or disengaged from the limiting portion to limit closing or opening, relative to the housing, of the door body. In this way, the user needs to push the switching member firstly to drive the engagement member to move into the second position, and thus the door body can be pulled to open the housing only after the hook is disengaged from the limiting portion. Multi-step operations can prevent the user from being injured by a high temperature inside the housing when the housing is directly pulled by the user, and the barb structure can increase engagement firmness between the hook and the limiting portion to prevent the door body from being directly pulled open, such that the safety is improved.

Optionally, the engagement member includes a sliding portion, the hook is fixedly connected to the sliding portion and protrudes from the door body to extend towards the housing, and the switching member is fixedly connected to the sliding portion and faces towards the outer side of the door body and is capable of driving the sliding portion to move relative to the door body between the first position and the second position.

Optionally, the hook includes a connecting arm and an engagement portion. The connecting arm is connected to the sliding portion, and the engagement portion extends from an end of the connecting arm facing away from the sliding portion towards the door body while being bent to form the barb structure.

Optionally, the connecting arm includes a connecting surface extending along the sliding portion towards the engagement portion. The engagement portion includes an engagement surface connected to the connecting surface. An included angle between the connecting surface and the engagement surface is an acute angle, and the engagement surface extends towards the sliding portion from the connecting surface.

Optionally, the engagement member is slidable relative to the door body, in an upward-downward direction, and the first position is below the second position.

Optionally, a plurality of hooks is provided. The plurality of hooks is provided at intervals in a sliding direction of the sliding portion, and at least one of the plurality of hooks is provided with the barb structure.

Optionally, the switching member, the sliding portion, and the hook are formed into one piece.

Optionally, the door body structure further includes a handle fixed on the outer side of the door body. An accommodation space is defined between the handle and the door body, and the switching member is at least partially accommodated within the accommodation space.

Optionally, the handle includes an inner side surface close to the door body. The accommodation space is defined between the inner side surface and the door body. The inner side surface has a receiving groove defined therein, the receiving groove has a shape matched with that of the switching member, and the switching member is at least partially received within the receiving groove and movable within the receiving groove.

Optionally, the inner side surface includes a holding surface facing towards the door body, and the switching member includes a connecting segment and a protrusion. The connecting segment is connected to the sliding portion and movably arranged within the receiving groove, and the protrusion is connected to an end of the connecting segment facing away from the sliding portion and protrudes from the holding surface.

Optionally, the handle includes an appearance surface facing away from the door body, and the switching member includes a connecting segment and a protrusion. The connecting segment is connected to the sliding portion and movably arranged within the receiving groove, and the protrusion is connected to an end of the connecting segment facing away from the sliding portion and protrudes from the appearance surface in a direction of the receiving groove facing away from the door body.

Optionally, the inner side surface includes a holding surface facing towards the door body, and the switching member includes a connecting segment and an operating member. The connecting segment is connected to the engagement member and movably arranged within the receiving groove. The operating member is movably arranged on the handle and partially protrudes towards the door body from the holding surface, and the operating member is configured to cooperate with the connecting segment to move the engagement member between the first position and the second position. The operating member is operated in an operation direction perpendicular to a movement direction of the engagement member or in an operation direction oblique to a movement direction of the engagement member.

Optionally, the operating member has a driving surface formed at an end thereof facing towards the connecting segment, and the connecting segment has a driven surface formed at an end thereof that cooperates with the operating member. A contact surface between the driving surface and the driven surface is arranged to be inclined relative to the operation direction of the operating member. Both the driving surface and the driven surface are flat surfaces, or at least one of the driving surface and the driven surface is a curved surface.

Optionally, the door body structure includes a jacket arranged on the switching member and made of a shock absorbing material. When the sliding portion is at the first position or the second position, the jacket is abutted against the handle.

Optionally, the jacket extends obliquely upwards in a direction from the handle to the door body; or the jacket extends obliquely downwards in a direction from the handle to the door body.

According to an embodiment of the present disclosure, a door body structure includes a door body, an engagement member, and a switching member. The door body is connected to a housing of a cooking device in an openable and closeable manner. The housing includes a limiting portion. The engagement member is arranged on the door body. The switching member is configured to drive the engagement member to move relative to the door body between a first position and a second position. The switching member extends into the door body from an outer side of the door body, is movable relative to the door body, and is capable of cooperating with the engagement member. The engagement member is configured to be engaged with the limiting portion to prevent the door body from being opened when the engagement member is at the first position, and to be disengaged from the limiting portion to allow the door body to be opened when the engagement member is at the second position.

According to an embodiment of the present disclosure, a cooking device includes a door body structure. The door body structure includes a door body, an engagement member, and a switching member. The door body is connected to a housing of a cooking device in an openable and closable manner. The housing includes a limiting portion. The engagement member is arranged on the door body. The switching member is configured to drive the engagement member to move relative to the door body between a first position and a second position. The switching member extends into the door body from an outer side of the door body, is movable relative to the door body, and is capable of cooperating with the engagement member. The engagement member is configured to be engaged with the limiting portion to prevent the door body from being opened when the engagement member is at the first position, and to be disengaged from the limiting portion to allow the door body to be opened when the engagement member is at the second position.

In the door body structure and the cooking device according to the embodiments of the present disclosure, when the door body structure is at the first position, the engagement member is engaged with the limiting portion. When the door body needs to be opened without being unlocked, it is necessary to overcome an engaging force between the engagement member and the limiting portion, thereby generating loud noises. In the present disclosure, the switching member is provided. When being pressed, the switching member drives the engagement member to move between the first position and the second position. When the engagement member moves into the second position, locking between the engagement member and the limiting portion can be released. In such a circumstance, opening the door body does not need to overcome the engaging force between the engagement member and the limiting portion. Therefore, no noise is generated, and the door can be opened silently. Similarly, when the door needs to be closed, the engagement member can be driven to move into the second position by pressing the switching member firstly, and thus it is unnecessary to overcome the engaging force when the door is closed, so that the door can be closed silently. In this way, the door can be opened and closed silently by the door body structure in the present disclosure without generating loud noises that affect people's study, work and rest.

According to an embodiment of the present disclosure, a door body structure includes a door body, an engagement member, and a switching member. The door body is connected to a housing of a cooking device in an openable and closable manner. The housing includes a limiting portion. The engagement member is arranged on the door body and includes a hook. The hook is formed with a barb structure facing towards the door body. The switching member is configured to drive the engagement member to move relative to the door body between a first position and a second position. The switching member extends into the door body from an outer side of the door body, is movable relative to the door body, and is capable of cooperating with the engagement member. The hook is configured to be engaged with the limiting portion by the barb structure to prevent the door body from being opened when the engagement member is at the first position, and to be disengaged from the limiting portion to allow the door body to be opened when the engagement member is at the second position.

According to an embodiment of the present disclosure, a cooking device includes a door body structure. The door body structure includes a door body, an engagement member, and a switching member. The door body is connected to a housing of a cooking device in an openable and closable manner. The housing includes a limiting portion. The engagement member is arranged on the door body and includes a hook. The hook is formed with a barb structure facing towards the door body. The switching member is configured to drive the engagement member to move relative to the door body between a first position and a second position. The switching member extends into the door body from an outer side of the door body, is movable relative to the door body, and is capable of cooperating with the engagement member. The hook is configured to be engaged with the limiting portion by the barb structure to prevent the door body from being opened when the engagement member is at the first position, and to be disengaged from the limiting portion to allow the door body to be opened when the engagement member is at the second position.

The door body structure and the cooking device according to the embodiments of the present disclosure can allow the barb structure, which is formed by the hook, to be engaged with the limiting portion when the engagement member is at the first position, thereby preventing the door body from being opened. Further, since the switching member can drive the engagement member to move relative to the door body between the first position and the second position, and the hook is disengaged from the limiting portion to allow the door body to be opened when the engagement member is at the second position, it is ensured that the cooking device cannot be directly opened by an external force during the operation of the cooking device, thereby preventing children from being injured, and improving the user experience.

Additional aspects and advantages of the present disclosure will be provided at least in part in the following description, or will become apparent at least in part from the following description, or can be learned from practicing of the present disclosure.

DESCRIPTION OF EMBODIMENTS

Figure 1:
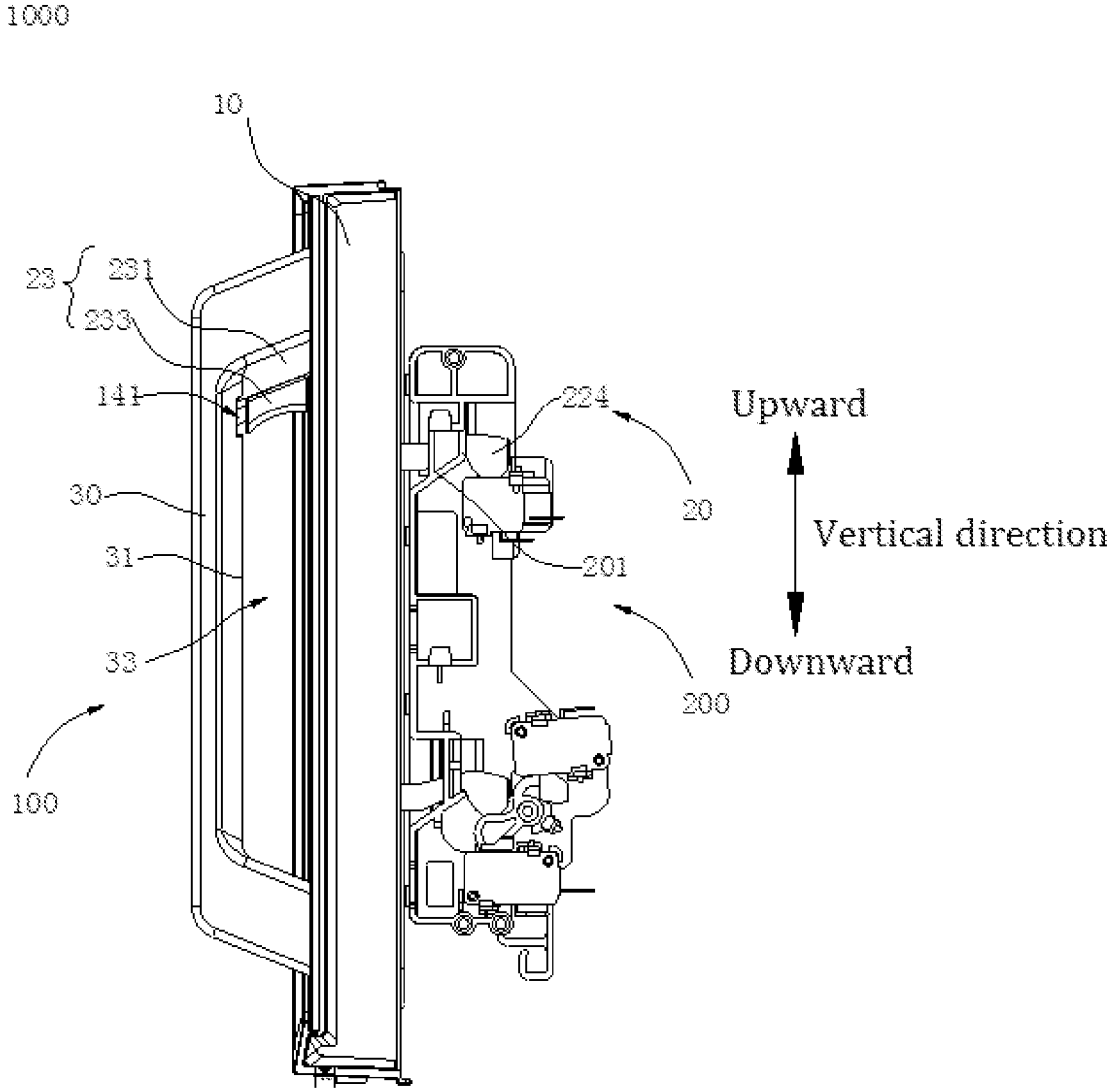
FIG. 1 is a schematic structural view showing cooperation between a door body structure and a limiting portion of a housing according to an embodiment of the present disclosure.

Embodiments of the present disclosure are described below in detail, examples of the embodiments are shown in accompanying drawings, and throughout the description, the same or similar reference signs represent the same or similar components or the components having the same or similar functions. The embodiments described below with reference to the accompanying drawings are exemplary and merely used to explain the present disclosure, rather than being construed as limitation on the present disclosure.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", etc., is based on the orientation or position relationship shown in the drawings, and is only for the convenience of describing the present disclosure and simplifying the description, rather than indicating or implying that the defined device or element must have a specific orientation or must be constructed and operated in a specific orientation. Thus, the orientation or position relationship indicated by these terms cannot be understood as limitations on the present disclosure. In addition, the terms "first" and "second" are only used for purpose of description, and cannot be understood as indicating or implying relative importance or implicitly indicating the number of indicated technical features. Therefore, the features defined by the terms "first" and "second" may explicitly or implicitly include at least one of the features. In the description of the present disclosure, "plurality" means at least two, unless otherwise specifically defined.

In the description of the present disclosure, it should be noted that, unless otherwise clearly specified and defined, terms such as "install", "mount", "connect to", "connected with" and the like should be understood in a broad sense. For example, it may be a fixed connection or a detachable connection or integral connection; mechanical connection or electrical connection or mutual communication; direct connection or indirect connection by an intermediate; internal communication of two components or an interaction relationship between two components. For those of ordinary skill in the art, the specific meaning of the above-mentioned terms in the present disclosure can be understood according to specific circumstances.

In the present disclosure, unless expressly specified and defined otherwise, the first feature being "on" or "under" the second feature may indicate that the first feature is in direct contact with the second feature, or the first and second features, instead of being in direct contact with each other, are in contact with each other by another feature therebetween. Moreover, the first feature being "above" the second feature may indicate that the first feature is directly above or obliquely above the second feature, or simply indicate that a level of the first feature is higher than that of the second feature. The first feature being "below" the second feature may indicate that the first feature is directly below or obliquely below the second feature, or merely indicate that a level of the first feature is less than that of the second feature.

Various embodiments or examples for implementing different structures of the present disclosure are provided below. In order to simplify the description of the present disclosure, components and arrangements of specific examples are described herein. Of course, these specific examples are merely for the purpose of illustration, and they are not intended to limit the present disclosure. Furthermore, the same reference numerals and/or reference letters may appear in different examples of the present disclosure for the purpose of simplicity and clarity, instead of indicating a relationship between different discussed embodiments and/or arrangements. In addition, the present disclosure provides examples of various specific processes and materials. However, applications of other processes and/or the use of other materials are conceivable for those skilled in the art.

Referring to FIG. 1 to FIG. 6, embodiments of the present disclosure provide a cooking device 1000 for cooking food. The cooking device 1000 includes a door body structure 100 and a housing 200. The door body structure 100 may be arranged on the housing 200 in an openable and closable manner.

The cooking device 1000 may include, but is not limited to, a microwave oven, a steamer, a baking oven, a device having functions of a combination thereof, and the like. The housing 200 includes a limiting portion 201 configured to limit a position of the door body structure 100 in such a manner that the door body structure 100 can be closed relative to the housing 200 to form a closed space for cooking food.

The door body structure 100 includes a door body 10, an engagement member 20, a switching member 23, and a handle 30.

Here, the door body 10 is arranged on the housing 200 in the openable and closable manner. The engagement member 20 is arranged on the door body 10 and includes a hook 224. The hook 224 is configured to be engaged with or disengaged from the limiting portion 201.

The switching member 23 is configured to cooperate with the engagement member 20 to drive the engagement member 20 to move between a first position x1 and a second position x2. The switching member 23 includes a connecting segment 231 connected to the engagement member 20 and an operating member 233 slidingly engaged with the connecting segment 231.

The handle 30 is provided on the door body 10 and has a locking groove 141 defined therein. When the engagement member 20 is located at the first position x1, the hook 224 is engaged with the limiting portion 201, and at least a part of the operating member 233 is located within the locking groove 141 to limit a movement of the engagement member 20. When the operating member 233 is disengaged from the locking groove 141, the switching member 23 drives the engagement member 20 to move relative to the door body 10.

In the door body structure 100 and the cooking device 1000 according to the embodiments of the present disclosure, when the engagement member 20 is located at the first position x1, the hook 224 is engaged with the limiting portion 201, and the at least part of the operating member 233 is located within the locking groove 141 to limit the movement of the engagement member 20, thus a child lock protection function can be implemented, which effectively avoids the cooking device 1000 from being directly opened due to pulling of the handle 30 to guarantee safety of an opening process of the cooking device 1000 and reduce the possibility of scalding injuries caused by food in cooking when the door body 10 is opened by a mis-operation. When the operating member 233 is disengaged from the locking groove 141, the child lock protection function can be disabled, and the switching member 23 drives the engagement member 20 to be movable relative to the door body 10 to open the door body. Moreover, since switching between an implementation of the child lock protection function and disabling of the child lock protection function can be realized simply by sliding the operating member 233, the door body structure 100, compared with electric child locks and complicated mechanical child locks in the related art, has a simple structure and lowered costs.

In addition, since the switching between the implementation of the child lock protection function and the disabling of the child lock protection function can be realized simply by sliding the operating member 233 of the switching member 23, the door body structure 100, compared with the electric child locks and the complicated mechanical child locks in the related art, has a simple structure and lowered costs.

For example, the door body 10 may include two opposite sides, one of which is rotatably connected to the housing 200 by means of, e.g., a hinge. For example, in some examples, the door body 10 and the housing 200 are rotatably connected to each other via the hinge. The door body 10 has the engagement member 20, the switching member 23, and the handle 30 that are provided on the other side thereof.

The engagement member 20 passes through the door body 10. When the door body 10 is closed relative to the housing 200, the engagement member 20 is disposed opposite to the limiting portion 201 of the housing 200. Also, the engagement member 20 includes the hook 224. The hook 224 is configured to partially extend from the door body 10 into the limiting portion 201 to be engaged with the limiting portion 201 to limit a position of the door body 10, thereby ensuring that the door body 10 is closed relative to the housing 200 without any external force.

The switching member 23 is arranged on a side of the door body 10 facing away from the housing 200, and is connected to the engagement member 20. The switching member 23 is configured to drive the engagement member 20 to move between the first position x1 and the second position x2. The switching member 23 includes the operating member 233 and the connecting segment 231. The connecting segment 231 is connected to the engagement member 20, and the sliding member is slidably arranged on the connecting segment 231.

The handle 30 is fixedly mounted on the side of the door body 10 facing away from the housing 200. The handle 30 may be applied with a force by a user to close or open the door body 10 relative to the housing 200. The handle 30 has the locking groove 141 defined therein. The locking groove 141 is arranged to face towards the operating member 233. When a force in a direction of the locking groove 141 is applied to the operating member 233, the operating member 233 can at least partially slide into the locking groove 141 to limit the movement of the engagement member 20, such that the engagement member 20 can be engaged with the limiting portion 201 to achieve the child lock function. In this case, the handle 30 restricts a relative movement of the engagement member 20. Even if the force is applied to the handle 30, the engagement member 20 cannot be disengaged from the limiting portion 201, thereby ensuring that the door body 10 can be closed relative to the housing 200.

When the door needs to be opened, the operating member 233 is operated to slide out of the locking groove 141 to be disengaged from the locking groove 141. In this case, the handle 30 has no direct restriction on the switching member 23, and the child lock is unlocked. When the user applies to the handle 30 a force in a direction facing away from the housing 200 to pull the switching member 23, the engagement member 20 is driven by the switching member 23 to move from the first position x1 to the second position x2, and the hook 224 is disengaged from the limiting portion 201. By further pulling the handle 30 or the operating member 233, the door body 10 is driven by the handle 30 or the operating member 233 to be disengaged from the housing 200, thereby opening the door body structure 100.

That is, during opening the door body structure 100, it is necessary to firstly slide the operating member 233 out of the locking groove 141 in the handle 30 to disengage the operating member 233 from the locking groove 141, which ensures that the handle 30 does not limit movements of a door opener and the engagement member 20. Therefore, the switching member 23 can drive the engagement member 20 to move from the first position x1 to the second position x2, such that the hook 224 is disengaged from the limiting portion 201 to achieve the opening of the door body. It should be understood that, since an action of sliding the operating member 233 is different from that of pulling the handle 30 to pull the door body 10, different operation steps are required, which can better prevent unrelated persons such as children from directly opening the door body, and thus the safety is high.

It should be noted that, in this embodiment, an arrangement direction of the first position x1 and the second position x2 may be a vertical direction or may be inclined to the vertical direction by a predetermined angle. For example, in this embodiment, the arrangement direction of the first position x1 and the second position x2 can be exemplified by the vertical direction. That is, the switching member 23 can drive the engagement member 20 to move in the vertical direction. In addition, the first position x1 is located below the second position x2, and the second position x2 may be a position at which the engagement member 20 is positioned when the hook 224 is just disengaged from the limiting portion 201 or a position at which the engagement member 20 is located after the engagement member 20 moves from the first position by a maximum distance. A rotation direction of the door body 10 may be a horizontal direction perpendicular to the vertical direction. It should be understood that, since the door body 10 can be opened only by moving in the vertical direction during opening thereof, a possibility of mis-operation can be reduced. Of course, in some other examples, the engagement member 20 may also move in other directions, e.g., in a direction angled with the vertical direction, as long as the engagement member 20 can be engaged with the limiting portion 201 by the hook 224.

In some embodiments, the locking groove 141 is disposed within an accommodation space 33 defined between the handle 30 and the door body 10. The switching member 23 is arranged within the accommodation space 33, and the engagement member 20 partially extends from the door body 10 into the accommodation space 33 to be connected to the connecting segment 231 arranged within the accommodation space 33. The operating member 233 is slidably arranged within the accommodation space 33, and the locking groove 141 is arranged in a sliding direction of the operating member 233. The locking groove 141 has an opening slightly greater than a cross section of the operating member 233 in the sliding direction. In this way, the operating member 233 can slide into the locking groove 141 in the sliding direction to limit the movement of the engagement member 20.

In some embodiments, an included angle is formed between the sliding direction of the operating member 233 and a movement direction of the engagement member 20.

The included angle between the sliding direction of the operating member 233 and the movement direction of the engagement member 20 may be an acute angle, a right angle, or an obtuse angle. A specific degree of the included angle is not limited. For example, the included angle between the sliding direction of the operating member 233 and the movement direction of the engagement member 20 may be 30°, 45°, 60°, 90°, 120°, 150°, and so on.

In some embodiments, a part of the connecting segment 231 is located within the accommodation space 33, and the operating member 233 is slidingly engaged with the part of the connecting segment 231 located within the accommodation space 33. The handle 30 is configured to be pulled in a direction facing away from the door body 10 to drive the engagement member 20 to move in such a manner that the hook 224 is disengaged from the limiting portion 201 when the operating member 233 is disengaged from the locking groove 141.

For example, in a case where the operating member 233 slides out of the locking groove 141 to be disengaged from the locking groove 141, when the handle 30 is pulled in the direction facing away from the door body 10, the engagement member 20 can be driven to move from the first position x1 to the second position x2 in such a manner that the hook 224 is disengaged from the limiting portion 201. Therefore, the door body 10 can move away from the housing 200 to open the door body.

Figure 3:
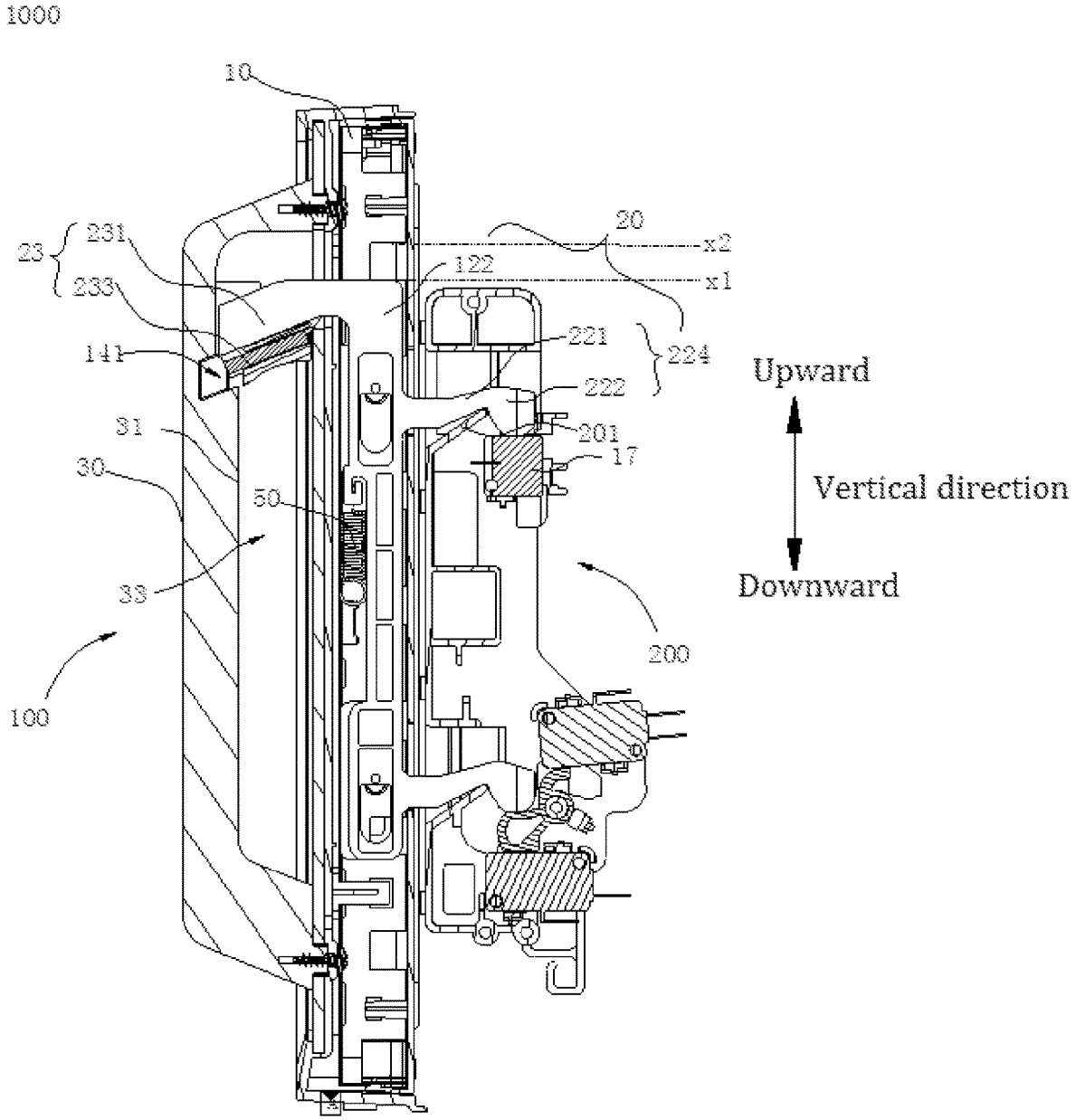
FIG. 3 is a schematic cross-sectional view showing a door body structure and a limiting portion of a housing according to an embodiment of the present disclosure.
Figure 4:
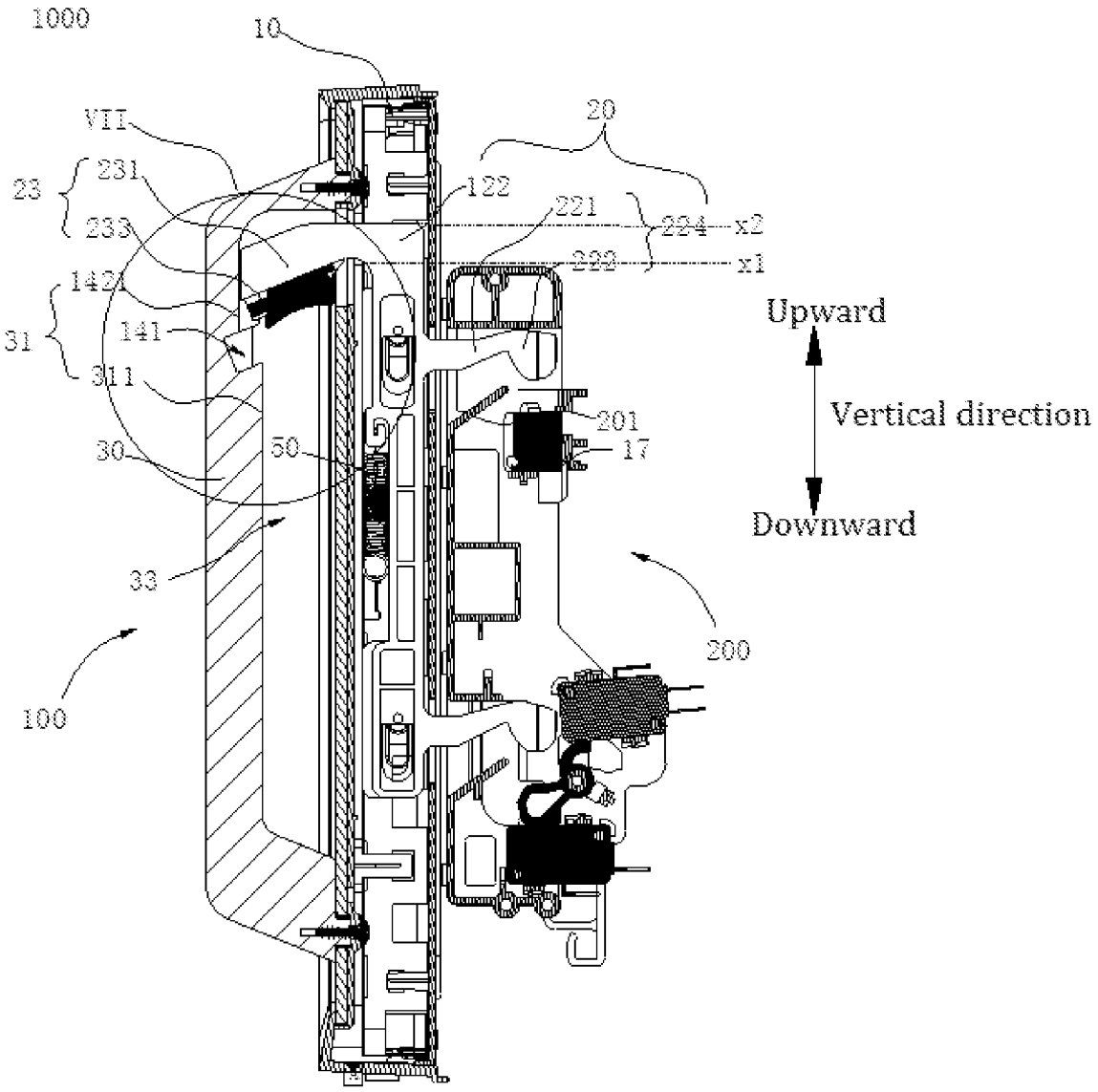
FIG. 4 is a schematic cross-sectional view showing a door body structure and a housing according to an embodiment of the present disclosure.
Figure 5:
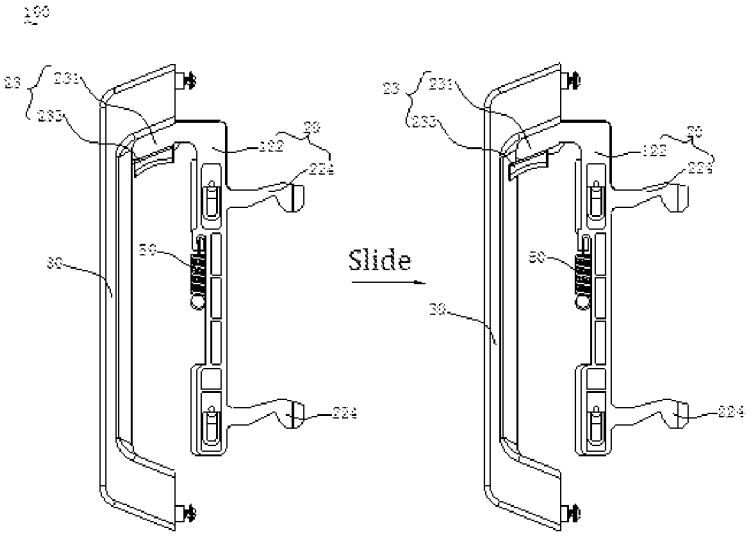
FIG. 5 is a schematic view showing an implementation of a child lock function by cooperating a handle with a door opener according to an embodiment of the present disclosure.
Figure 6:
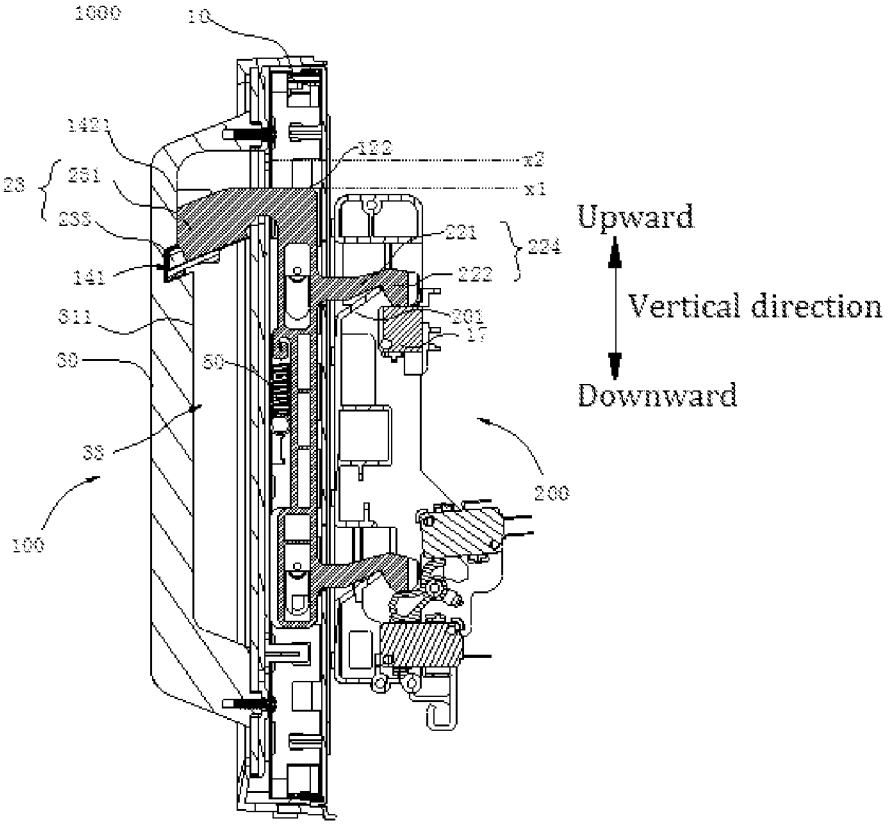
FIG. 6 is a schematic cross-sectional view showing a door body structure and a limiting portion of a housing according to an embodiment of the present disclosure.

Referring to FIG. 3 and FIG. 4, in addition, in other embodiments, the operating member 233 may be pressed firstly to drive the engagement member 20 to move from the first position x1 to the second position x2 in such a manner that the hook 224 is disengaged from the limiting portion 201, and then the handle 30 is pulled to open the door body.

As can be understood that, due to inertia such as an engaging force of the engagement member 20 and the opening and closing of the door body, the cooking device 1000 is prone to generate loud noises, which may cause disturbance to the user, especially in a quiet morning or late at night, using the cooking device 1000 may affect sleeping family members. Due to these scenarios, the use of the cooking device 1000 is greatly inconvenient and even limited. By pressing the operating member 233, the operating member 233 is abutted against the connecting segment 231 to drive the engagement member 20 to move from the first position x1 to the second position x2. In this manner, a direction of engaging and disengaging forces can be transferred to a normal direction of the movement of the door body 10 to ensure that the hook 224 can be disengaged from the limiting portion 201. When the handle 30 is applied with a force by the user again to drive the handle 30 to move away from the housing 200, the door body can be opened and closed without resistance during opening and closing thereof, which avoids noises resulted, when the door body is opened and closed, from impacts and collisions between the hook 224 and the limiting portion 201 due to inertia such as the engaging force between the hook 224 and the limiting portion 201 and a force for opening the door body, realizes noise reduction when opening and closing the door body, and improves the user experience. In addition, since the collisions and impacts between the hook 224 and the limiting portion 201 are mitigated, damages to the hook 224 and the limiting portion 201 are reduced, thereby prolonging service lives of the hook 224 and the limiting portion 201.

In addition, in some other embodiments, the movement of the engagement member 20 between the first position x1 and the second position x2 can be implemented by other methods. For example, the engagement member 20 may be abutted against by a cam or a lever structure, such that the engagement member 20 moves from the first position x1 to the second position x2, and then the handle 30 or the sliding member 131 is pulled to achieve the silent opening and closing of the door body.

Figure 7:
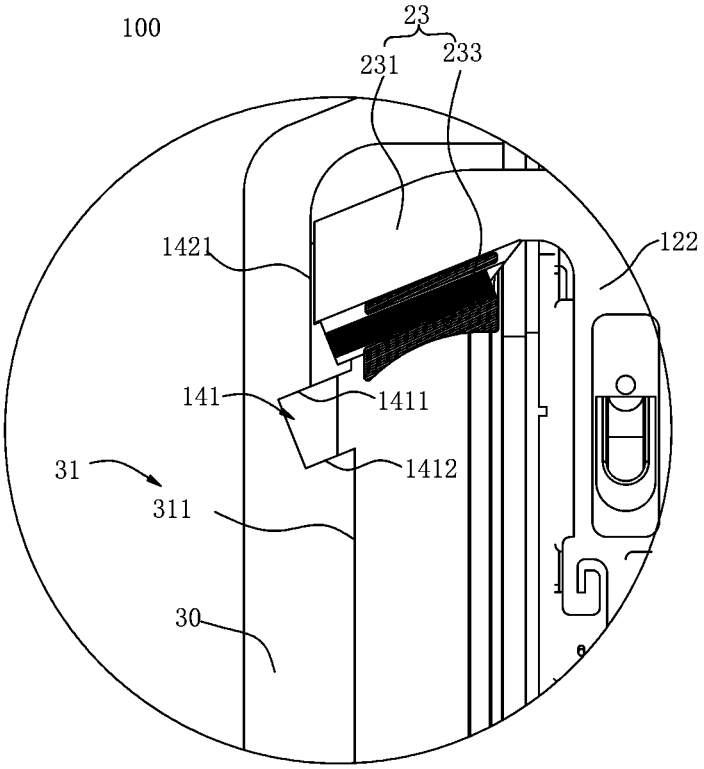
FIG. 7 is a schematic enlarged partial view of part VII in FIG. 4.

Referring to FIG. 7, in some embodiments, the handle 30 has a surface facing towards the door body 10, and the surface is an inner side surface 31 including a first engagement surface 1421 and a holding surface 311. The locking groove 141 is connected to the first engagement surface 1421 at a top surface 1411 thereof and is connected to the holding surface 311 at a bottom surface 1412 thereof to define a stepped surface (not illustrated). The stepped surface is located below the connecting segment 231 to limit a movement of the connecting segment 231.

The first engagement surface 1421 is arranged parallel to the movement direction of the engagement member 20. When a force is applied to the operating member 233 in the movement direction of the engagement member 20, the sliding member 131 is abutted against the connecting segment 231 to drive the engagement member 20 to slide along the first engagement surface 1421. The stepped surface formed by connecting the bottom surface 1412 of the locking groove 141 to the holding surface 311 can limit a range of the movement of the engagement member 20. When the connecting segment 231 is abutted against the stepped surface, the engagement member 20 is located at the first position x1, and the hook 224 is engaged with the limiting portion 201.

In some embodiments, one of the operating member 233 and the connecting segment 231 has a sliding rail provided thereon, and the other of the operating member 233 and the connecting segment 231 has a sliding groove defined therein. The sliding rail and the sliding groove are slidably engaged with each other.

For example, in some examples, the operating member 233 has the sliding rail provided thereon, the connecting segment 231 has the sliding groove provided thereon, and the sliding rail and the sliding groove are slidably engaged with each other. For example, in some other examples, the connecting segment 231 has the sliding rail provided thereon, the operating member 233 has the sliding groove provided thereon, and the sliding rail and the sliding groove are slidably engaged with each other.

In some embodiments, the operating member 233 is made of a flexible material for attenuating, when the operating member 233 is entering the locking groove 141, a collision force between the operating member 233 and the locking groove 141.

In this manner, noises from collisions and impacts generated when the operating member 233 extends into or out of the locking groove 141 can be mitigated, thereby realizing the noise reduction when opening and closing the door body and improving the user experience.

In certain embodiments, the hook 224 is formed into a downwardly bent barb structure. When the door body 10 is closed, the limiting portion 201 is engaged with a barb of the hook 224 to allow the limiting portion 201 to be engaged with the hook 224, thereby limiting the movement of the door body 10.

For example, the limiting portion 201 is arranged below the hook 224. When the door body 10 is closed, the engagement member 20 moves from the second position x2 to the first position to allow the limiting portion 201 to be engaged with the barb of the hook 224, thereby ensuring that the limiting portion 201 is engaged with the hook 224. When the handle 30 is pulled, the limiting portion 201 and the hook 224 abut with each other in a rotation direction of the door body to limit the movement of the door body 10, thereby ensuring that the door body 10 is closed relative to the housing 200 without any external force.

One or more hooks 224 may be provided. For example, 1, 2, 3, 4, or even more hooks 224 may be provided. That is, the number of the hooks 224 is not limited herein. The embodiments of the present disclosure are illustrated by taking the door body structure 100 including two hooks 224 as an example. It should be noted that the door body structure 100 including two hooks 224 is described as an example for illustration to facilitate understanding of implementations of the present disclosure, and should not be construed as a limitation on the present disclosure.

In some embodiments, the hook 224 includes a connecting arm 221 and an engagement portion 222. The connecting arm 221 is connected to a main body 122 of the engagement member 20, and the engagement portion 222 extends from an end of the connecting arm 221 facing away from the main body 122 towards the door body 10 while being bent to form the barb structure.

For example, the engagement member 20 includes the hook 224 and the main body 122. Here, the hook 224 and the main body 122 may be formed into one piece. For example, each of the hook 224 and the main body 122 may be made of a metal plate through punching or the like. It should be understood that, each of the main body 122 and the hook 224 is manufactured by punching the metal plate, the hook 224 thus is more reliable and durable, which avoids deformation of the hook 224 and facilitates manufacturing of the main body 122 and the hook 224. In this manner, the stability of arranging the hook 224 on the main body 122 can be effectively improved to ensure the stability of an engagement relationship between the hook 224 and the limiting portion 201. Of course, in other embodiments, the hook 224 may also be connected to the main body 122 by other connection manners such as welding, gluing, or a screw connection. That is, a specific connection manner between the hook 224 and the main body 122 is not limited herein.

When the engagement member 20 is located at the first position x1, the engagement portion 222 is engaged with the limiting portion 201 to limit the position of the door body 10, thereby ensuring that the door body 10 is closed relative to the housing 200 without any external force. When the engagement member 20 moves from the first position x1 to the second position, the engagement portion 121 is disengaged from the limiting portion 201.

Figure 2:
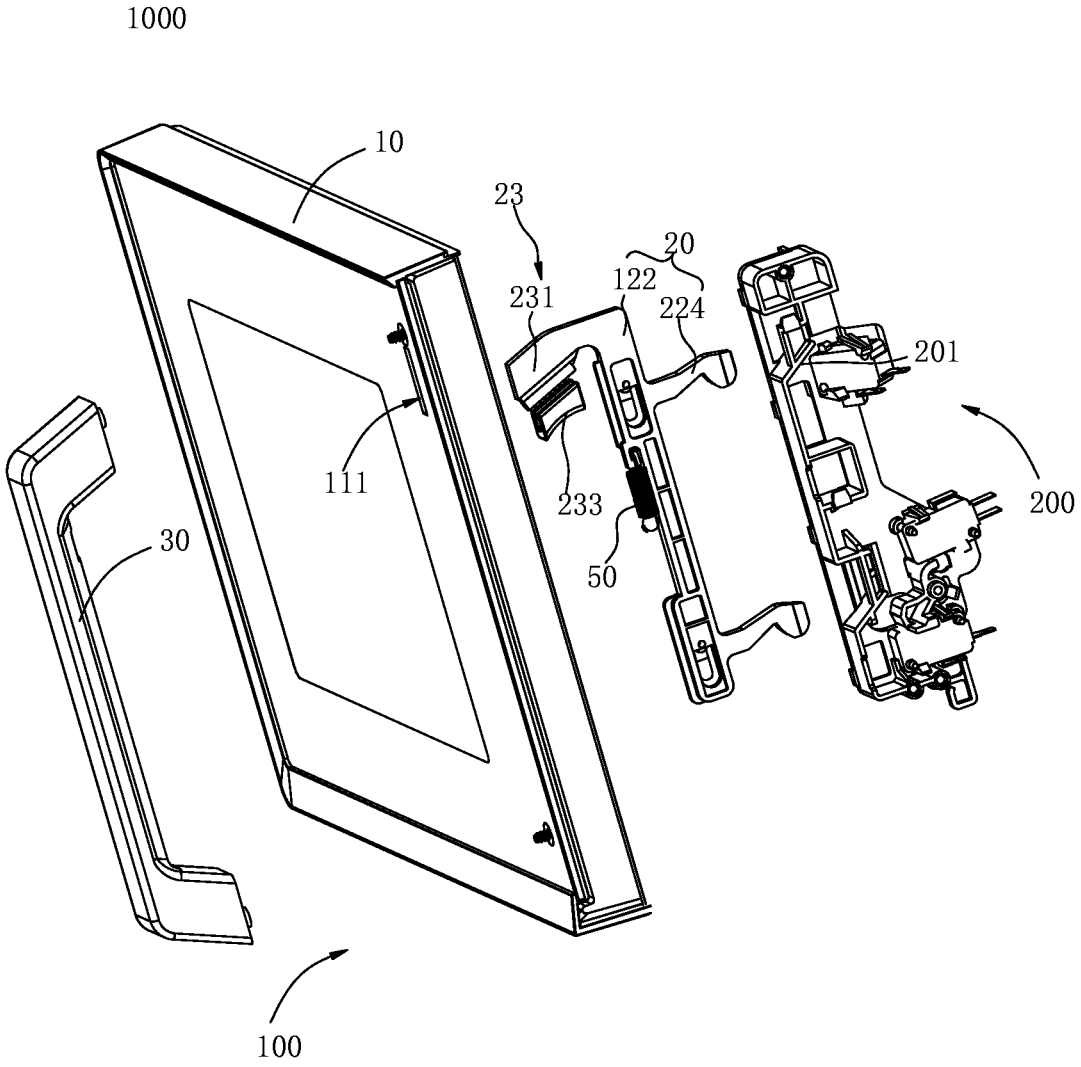
FIG. 2 is a schematic exploded view showing a door body structure and a housing according to an embodiment of the present disclosure.

Further, with reference to FIG. 2, in some embodiments, the door body 10 has a through hole 111 defined therein, and a part of the engagement member 20 passes through the through hole 111 to be positioned outside the door body 10 to define the connecting segment 231.

For example, a part of the main body 122 passes through the through hole 111 from the door body 10 to be connected to the connecting segment 231 located outside the door body 10. In this manner, the engagement member 20 can be driven by pressing the operating member 233 to move from the first position x1 to the second position x2, thereby allowing the hook 224 to be disengaged from the limiting portion 201.

Referring to FIG. 3, in some embodiments, the operating member 233 extends obliquely upwards in a direction from the handle 30 to the door body 10.

For example, the included angle between the sliding direction of the operating member 233 and the movement direction of the engagement member 20 is an acute angle, such that the operating member 233 extends obliquely upwards in the direction from the handle 30 to the door body 10. For example, in some examples, the included angle between the sliding direction of the operating member 233 and the movement direction of the engagement member 20 is 60°. In this case, when the operating member 233 is at least partially enters the locking groove 141, the operating member 233 can be prevented from sliding out of the locking groove 141 without an external force, thereby ensuring limiting the position of the engagement member 20.

In some embodiments, the operating member 233 extends obliquely downwards in the direction from the handle 30 to the door body 10.

For example, the included angle between the sliding direction of the operating member 233 and the movement direction of the engagement member 20 is an obtuse angle, such that the operating member 233 extends obliquely downwards in the direction from the handle 30 to the door body 10. For example, in some examples, the included angle between the sliding direction of the operating member 233 and the movement direction of the engagement member 20 is 150°.

In some embodiments, the extending direction of the operating member 233 from the handle 30 to the door body 10 is perpendicular to the movement direction of the engagement member 20.

In some embodiments, the door body structure 100 further includes a restoring member 50 connected to each of the door body 10 and the engagement member 20. The restoring member 50 is configured to provide the engagement member 20 with a force for moving the engagement member 20 from the second position x2 to the first position x1.

It should be understood that, during opening the door body, the engagement member 20 needs to move from the first position x1 to the second position x2 to allow the limiting portion 201 to release the engagement with the hook 224. During closing the door body, the engagement member 20 needs to move from the second position x2 to the first position x1 to allow the hook 224 to be engaged with the limiting portion 201. Therefore, the restoring member 50 is configured to provide the engagement member 20 with the force for moving the engagement member 20 from the second position x2 to the first position x1 to allow the engagement member 20 to be effectively positioned at the first position x1, thereby ensuring an engagement between the hook 224 and the limiting portion 201, and further reducing mis-operation and improving use safety.

In some embodiments, the restoring member 50 is a spring. The spring is hooked to and engaged with the door body 10 and the engagement member 20 at both ends thereof, respectively.

When the door needs to be closed, the engagement member 20 can be pulled with an elastic force of the spring to move from the second position x2 to the first position x1, which in turn allows the hook 224 of the engagement member 20 to be engaged with the limiting portion 201. When the door needs to be opened, it is necessary to press the operating member 233 to drive the engagement member 20 to move from the first position x1 to the second position x2 against the elastic force of the spring, thereby increasing a force for opening the door body, and further reducing mis-operation and improving the use safety. In other embodiments, the restoring member 50 may also be other elastic members, as long as the restoring member 50 can allow the engagement member 20 to be engaged with the limiting portion 201 more stably.

In some embodiments, the door body structure 100 further includes a damping member 17 arranged on the limiting portion 201 and configured to attenuate, when the engagement member 20 is moving into the first position x1, a collision force between a hook 224 and the limiting portion 201.

In this manner, noises generated by the impacts and collisions, which are caused by an inertial action during opening and closing the door body, between the hook 224 and the limiting portion 201 are reduced, such that the noise reduction during opening and closing the door body can be realized, and the user experience can be improved.

Figure 8:
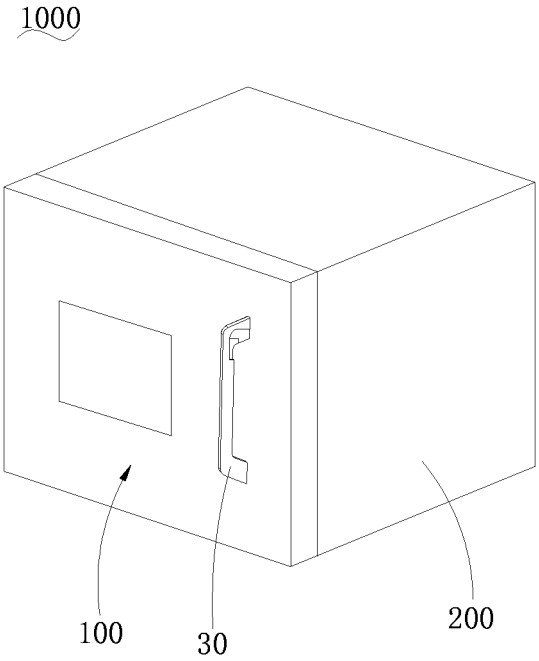
FIG. 8 is a schematic perspective view showing a cooking device according to an embodiment of the present disclosure.
Figure 9:
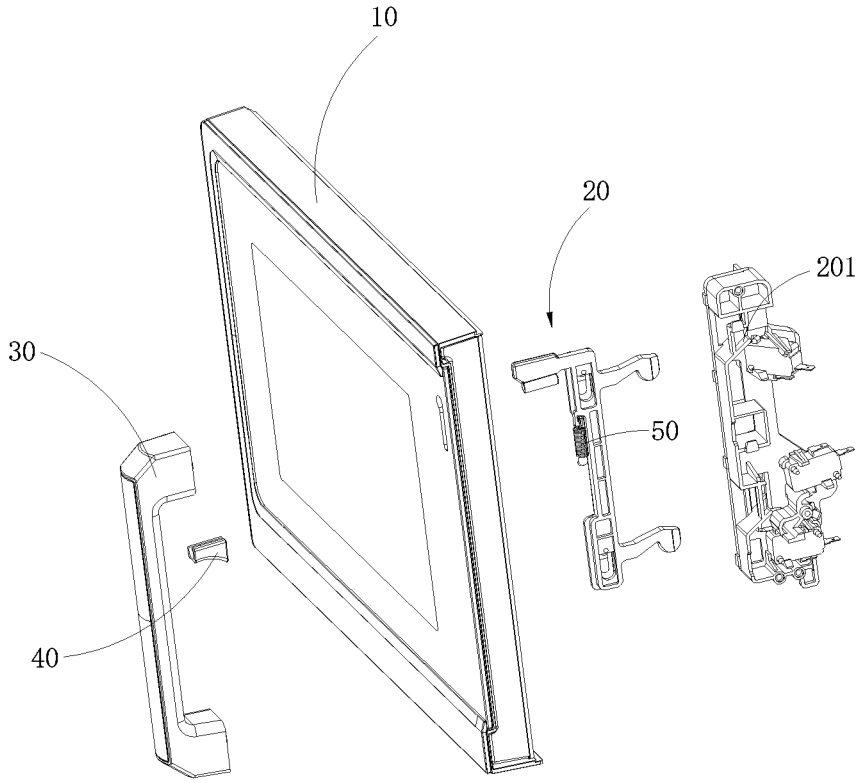
FIG. 9 is a schematic partially exploded structural view showing a cooking device according to an embodiment of the present disclosure.
Figure 10:
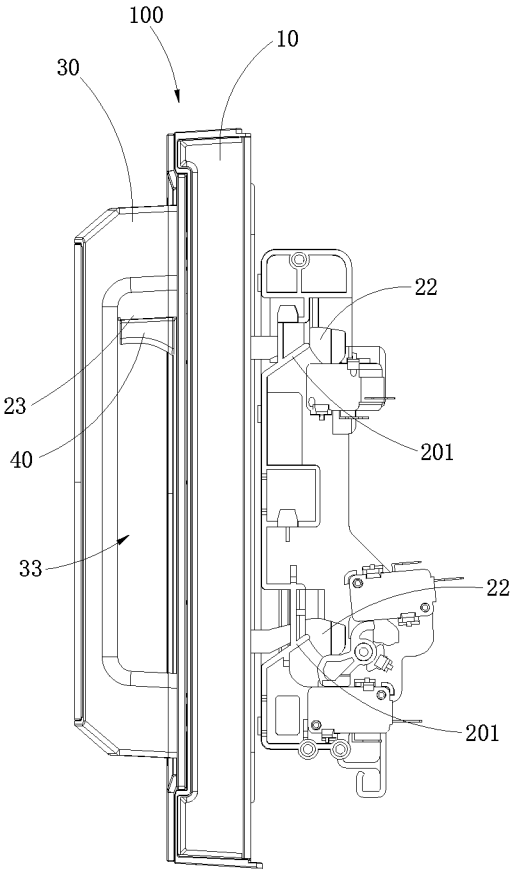
FIG. 10 is a schematic structural view showing a door body structure when being closed according to an embodiment of the present disclosure.
Figure 11:
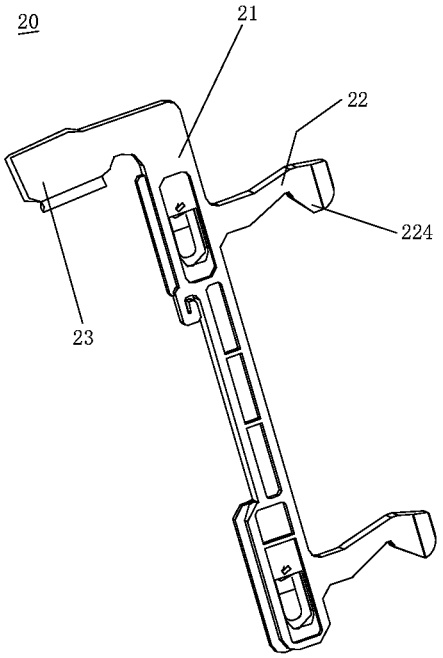
FIG. 11 is a schematic perspective structural view showing an engagement member according to an embodiment of the present disclosure.

Referring to FIG. 8 to FIG. 10, a cooking device 1000 according to the embodiments of the present disclosure includes a housing 200 and the door body structure 100 according to any one of the embodiments of the present disclosure. The housing 200 has a limiting portion 201 provided thereon, and the door body structure 100 is arranged on the housing 200 in an openable and closable manner.

The cooking device 1000 includes, but is not limited to, a kitchen electrical appliance such as a microwave oven, a baking oven, a steamer, and a function-integrated appliance. The housing 200 may be understood as a cooking main body for cooking in the cooking device 1000. The housing 200 has a cooking chamber defined therein, and the cooking chamber has an opening. That is, the opening is formed in the cooking chamber for easy access to an object. The door body structure 100 can be mounted on an opening side of the housing 200, and is rotatable relative to the housing 200 to open or close the housing 200. The limiting portion 201 may also be arranged on the opening side of the housing 200, and can cooperate with the door body structure 100 to limit opening or closing of the door body structure 100 relative to the housing 200, thereby preventing cooking effect of the cooking device 1000 during cooking from being affected by arbitrary opening of the door body structure 100, and even preventing the door body structure 100 from being mistakenly opened to avoid harms to the user.

Referring to FIG. 9 to FIG. 13, a door body structure 100 according to an embodiment of the present disclosure includes a door body 10, an engagement member 20, and a switching member 23. The door body 10 is connected to the housing 200 in an openable and closable manner. The engagement member 20 is arranged on the door body 10. The switching member 23 is configured to drive the engagement member 20 to move relative to the door body 10 between a first position A and a second position B.

Here, the switching member 23 is formed by a part of the engagement member 20 protruding from an outer side of the door body 10. The engagement member 20 is configured to be engaged with the limiting portion 201 when the engagement member 20 is at the first position A, and to be disengaged from the limiting portion 201 when the engagement member 20 is at the second position B.

In the door body structure 100 and the cooking device 1000 according to the embodiments of the present disclosure, the engagement member 20 is slidable, relative to the door body 10, between the first position A and the second position B, and the switching member 23 is fixedly connected to the engagement member 20 and protrudes from the outer side of the door body 10. In this way, the engagement member 20 can be driven by pushing the switching member 23 by the user to slide so as engagement member to control engagement and cooperation between the engagement member 20 and the limiting portion 201, thereby avoiding loud noises generated from collisions between the engagement member 20 and the limiting portion 201 during opening or closing the door body. Therefore, the operation is simple and convenient, noises generated during opening and closing the door body are effectively attenuated, and the user experience is improved.

For example, the door body 10 may be mounted on the opening side of the housing 200 of the cooking device 1000, and rotatably connected to the housing 200 by hinging or other means, such that the door body 10 is openable or closable relative to the housing 200. In some other embodiments, the opening and closing of the door body 10 may be implemented by arranging the door body 10 to be slidable relative to the housing 200. For example, the housing 200 has a sliding rail provided thereon, and the door body 10 is slidable on the sliding rail to open and close the housing 200.

The door body 10 may have a shape adapted to that of the opening of the housing 200 in such a manner that the housing 200 can have better airtightness when the door body 10 is closed relative to the housing 200, and the food can be cooked by the cooking device 1000 in a better manner. The present disclosure does not limit a connection method between the door body 10 and the housing 200 or the specific shape of the door body 10, and the connection method and the specific shape may be selected and set as desired.

The engagement member 20 may be arranged on a side edge of the door body 10. For example, the engagement member 20 may be arranged on a side edge of the door body opposite to a connection between the door body 10 and the housing 200. Of course, in some other embodiments, the engagement member 20 may also be arranged at a top side or a bottom side of the door body 10, and the present disclosure does not limit a mounting position of the engagement member 20 on the door body 10. The engagement member 20 is mainly configured to be engaged with the limiting portion 201 to lock the door body 10 when the door body 10 is closed, thereby avoiding injuries to the user in a case where the door body 10 is pulled open by mistake during cooking.

It should be understood that, in some embodiments, the engagement member 20 may include an engagement structure 22 configured to be engaged with the limiting portion 201 to limit the door body 10. The engagement structure 22 can extend from a sliding portion 21 towards an inner side of the door body 10 and protrude from an inner surface of the door body 10, and thus the sliding portion 21 can drive the engagement structure 22 to slide, such that the engagement structure 22 can be caught by and engaged with the limiting portion 201 when the door body 10 is closed relative to the housing 200. The sliding portion 21 may have one or more engagement structures 22 provided thereon. For example, two engagement structures 22 that are spaced apart from each other are connected to the sliding portion 21. A plurality of engagement structures 22 can allow the engagement member 20 to better limit the door body 10.

Of course, in some other embodiments, the sliding portion 21 may also be configured as a cam, a knob, or the like to drive the engagement structure 22 to be caught by and engaged with the limiting portion 201. The present disclosure does not limit a manner in which the sliding member drives the engagement structure 22 to move.

It should be understood that, in some embodiments, the housing 200 may have an engagement hole defined at a position thereof opposite to the engagement structure 22. The engagement hole is configured for an engagement of the engagement structure 22. When the door body 10 is closed relative to the housing 200, the engagement structure 22 can extend into the engagement hole. Therefore, the door body 10 can be better sealed to the housing 200 when the door body 10 is closed to allow the cooking device 1000 to have a better cooking effect.

The limiting portion 201 may be constructed into a plate-like structure, a post structure or the like. The limiting portion 201 may be directly formed within the engagement hole on the housing 200. Also, the limiting portion 201 may be formed on a fixing frame, through which the limiting portion 201 is fixed at the engagement hole, and the limiting portion 201 extends from a side of the door body 10 to an inner side of the housing 200, such that when the engagement structure 22 protrudes into the engagement hole, the limiting portion 201 can cooperate with the engagement structure 22 to limit the door body 10.

The switching member 23 may be arranged on a side of the sliding portion 21 opposite to the engagement structure 22. The switching member 23 extends from the sliding portion 21 towards the outer side of the door body 10 and protrudes from an outer side surface of the door body 10, such that the sliding portion 21 is controlled through pushing the switching member 23 by the user. In this case, the sliding portion 21 can be pushed by the user to slide between the first position A and the second position B more easily to allow the engagement structure 22 to be caught by and engaged with the limiting portion 201.

The switching member 23 may be constructed into a plate-like structure, and have a pushed surface in contact with a hand. The pushed surface may be configured as an arc-shaped surface to provide the user with a more comfortable feeling when pushing the switching member 23. In some embodiments, the pushed surface may also be configured as a frosted surface to enhance friction, thereby preventing the user's hand from slipping off an operation surface when pushing the switching member 23. The switching member 23, the engagement structure 22, and the sliding portion 21 may be formed into one piece to strength a connection among the switching member 23, the engagement structure 22, and the sliding portion 21, and avoid damages to the engagement structure 22 caught by the limiting portion 201 when the switching member 23 is pushed.

Figure 12:
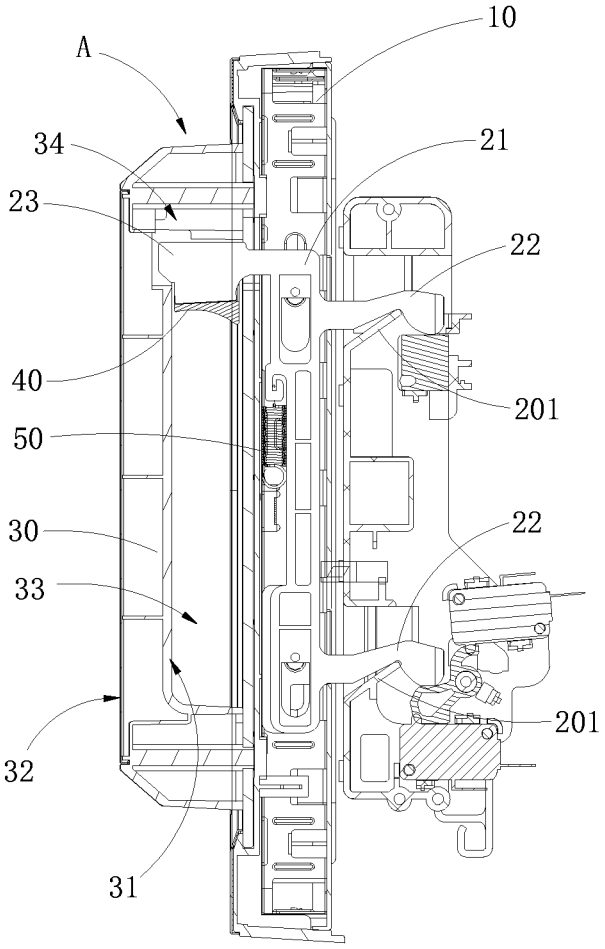
FIG. 12 is a schematic cross-sectional structural view showing the engagement member at a first position according to an embodiment of the present disclosure.

As illustrated in FIG. 12, when the door body 10 is closed relative to the housing 200, the switching member 23 can be pushed to allow the sliding portion 21 to slide into the first position A, and the engagement structure 22 may slide synchronously with the sliding portion 21 to allow the engagement structure 22 to be caught by the limiting portion 201. In this case, when the door body 10 is pulled outwards by the user, the door body 10 can be opened, however, loud noises may be generated, which affect the work or rest of other people.

Figure 13:
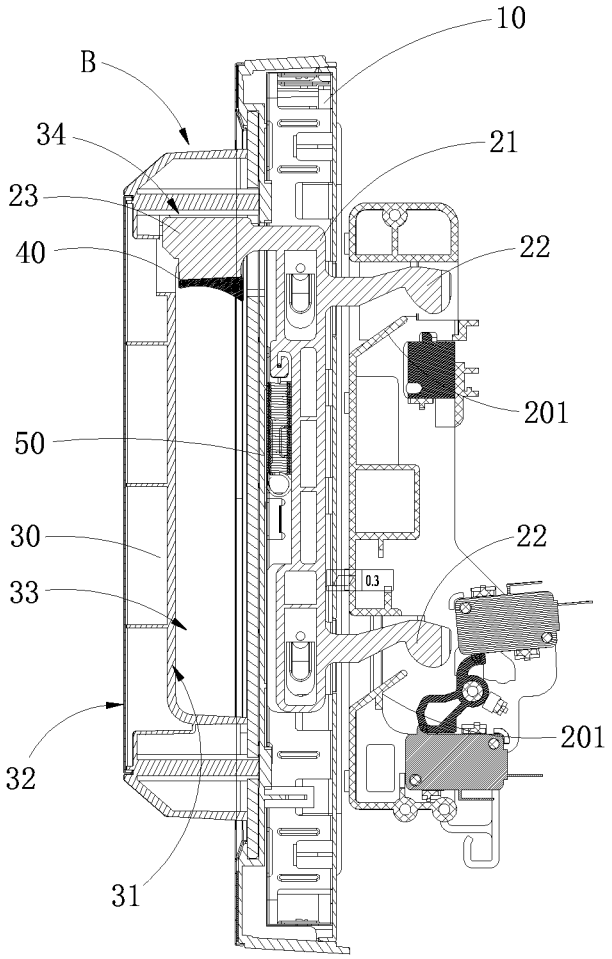
FIG. 13 is a schematic cross-sectional structural view showing the engagement member at a second position according to an embodiment of the present disclosure.
Figure 14:
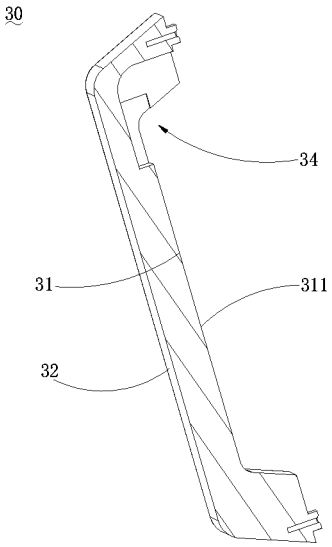
FIG. 14 is a schematic cross-sectional structural view showing a handle according to an embodiment of the present disclosure.
Figure 15:
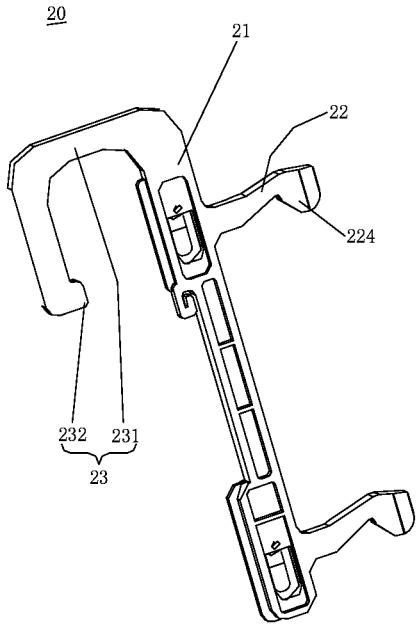
FIG. 15 is a schematic perspective structural view showing an engagement member according to an embodiment of the present disclosure.
Figure 16:
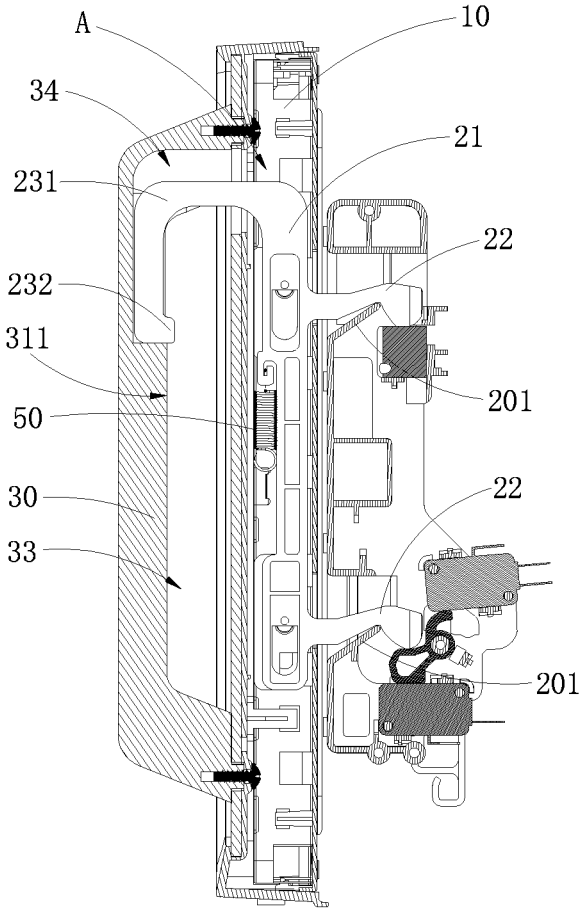
FIG. 16 is a schematic cross-sectional structural view showing the engagement member at a first position according to an embodiment of the present disclosure.
Figure 17:
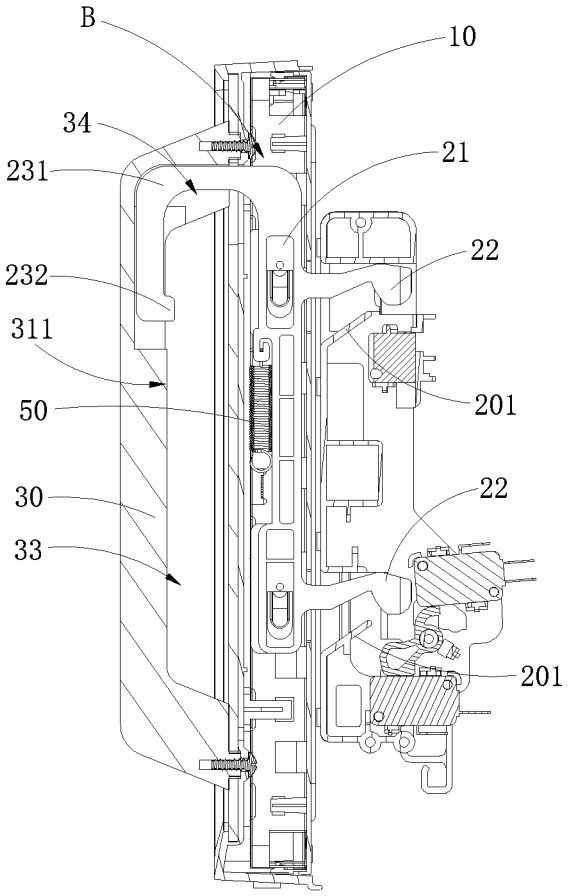
FIG. 17 is a schematic cross-sectional structural view showing the engagement member at a second position according to an embodiment of the present disclosure.

As illustrated in FIG. 13, when the user wants to open the housing 200 after cooking, the switching member 23 can be pushed by the user to allow the sliding portion 21 to slide into the second position B, and the engagement structure 22 may slide synchronously with the sliding portion 21 to be disengaged from the limiting portion 201. In this case, the housing 200 can be opened through pulling the door body 10 by the user. By controlling the sliding of the sliding portion 21 by pushing the switching member 23, loud sounds caused by collisions between the engagement structure 22 and the limiting portion 201 can be avoided when the door body 10 is opened or closed, which further effectively reducing the noises generated during use of the cooking device 1000 to improve the user experience.

In some embodiments, the engagement member 20 is slidable relative to the door body 10 in an upward-downward direction, and the first position A is below the second position B. In this manner, the sliding portion 21 is slidable smoothly with respect to the door body 10 to better drive the engagement structure 22 to be caught by and engaged with the limiting portion 201. Correspondingly, the limiting portion 201 may be arranged to be inclined upwards, such that when the sliding portion 21 drives the engagement structure 22 to slide downwards, the limiting portion 201 can be better caught by and engaged with the engagement structure 22.

Referring to FIG. 12 and FIG. 13, in some embodiments, the door body structure 100 further includes a restoring member 50 connected to each of the door body 10 and the sliding portion 21. The restoring member 50 is configured to provide the sliding portion 21 with a force for moving the sliding portion 21 from the second position B to the first position A.

In this manner, the restoring member 50 exerts a pulling force on the sliding portion 21 in a direction towards the first position A. The sliding portion 21 can always be kept at the first position A without being pushed by any external force, and thus when the door body 10 is closed, the engagement structure 22 can be better caught by and engaged with the limiting portion 201, thereby further preventing the door body 10 from being pulled open directly to enhance safety.

For example, the restoring member 50 may be an elastic element such as a spring, an elastic cord, or the like. The restoring member 50 is be connected to the sliding portion 21 at one end thereof and is fixed on the door body 10 at the other end thereof. The restoring member 50 keeps exerting a pulling force on the sliding portion 21 so that the sliding portion 21 is always kept at the first position A without being pushed by the external force.

When the door body 10 needs to be opened, the user needs to push the switching member 23 against the elastic force of the restoring member 50 to allow the sliding portion 21 to slide into the second position B, and then the door body 10 is pulled. After the door body 10 is opened and the external force is removed, the sliding portion 21 slides back to the first position A by the pulling force of the restoring member 50.

It should be noted that when the sliding portion 21 is at the first position A, the engagement structure 22 is disengaged from the limiting portion 201 directly by the external force. That is, the door body 10 can be pulled open by the external force. However, after the engagement structure 22 is pushed upwards by the limiting portion 201 to be disengaged from the limiting portion 201, the sliding portion 21 may immediately return back to the first position A due to the restoring member 50. In this case, the sliding portion 21 is likely to collide with the door body 10 to generate the noises. Therefore, loud noises generated during opening the door body 10 can be avoid by actively overcoming the force of the restoring member 50.

In some embodiments, the engagement structure 22 may be formed with a guide surface at an end thereof opposite to the sliding portion 21. The guide surface is arranged obliquely to guide the limiting portion 201 to slide towards the engagement structure 22 when closing the door body 10. In this way, when closing the door body 10, the door body 10 can be directly pushed by the user to be closed. The guide surface can guide the limiting portion 201 to slide directly into a position limited by the engagement structure 22, and the sliding portion 21 can be pulled, by the pulling force of the restoring member 50, to slide back to the first position A to close the door body 10.

Of course, in the case where the user directly pushes the door body 10 to be closed and directly pulls the door body 10 to open the door body, since no external force is exerted on the engagement member 20, the engagement member 20 may collide with the door body 10 due to the restoring member 50, and thus sounds may be generated. Therefore, when quietness is required, it is avoided to directly push the door body 10 to be closed or to directly pull the door body 10 to be opened for eliminating influences on other people.

In some embodiments, the switching member 23, the sliding portion 21, and the engagement structure 22 may be formed into an integrated structure by injection molding or other methods. In this manner, the connection among the switching member 23, the sliding portion 21, and the engagement structure 22 is enhanced for better cooperation, thereby avoiding breakages and damages during the pushing, and prolonging the service life.

Referring to FIG. 9 to FIG. 14, in some embodiments, the door body structure 100 further includes a handle 30 fixed on the outer side of the door body 10. The switching member 23 is at least partially accommodated within an accommodation space 33 defined between the handle 30 and the door body 10.

In this manner, such an arrangement of the handle 30 allows the door body 10 to be pulled by the user more conveniently. Since the switching member 23 protrudes from an outer surface of the door body 10, the handle 30 can also protect the switching member 23 within the accommodation space 33 to a certain extent, thereby preventing the switching member 23 from being hit and damaged.

For example, the handle 30 may be arranged on the outer side of the door body 10 and away from a side of the door body 10 connected to the housing 200. The handle 30 may be mounted on the door body 10 vertically or horizontally. The accommodation space 33 is defined between the handle 30 and the outer surface of the door body 10. When the user pulls the handle 30 by hand, his/her fingers can enter the accommodation space 33 to facilitate grasping of the handle 30, such that the door body 10 can be pulled easier.

The switching member 23 protrudes from the outer surface of the door body 10 and is at least partially accommodated within the accommodation space 33. When opening the door, the user can push the switching member 23 while grasping the handle 30 to slide the sliding portion 21, such that the sliding portion 21 slides towards the second position B to drive the hook 224 to be disengaged from the limiting portion 201, and then the door body 10 can be opened by continuing pulling the handle 30. The operation is simple and convenient, and at the same time, the switching member 23 can be protected. Correspondingly, when the door body is closed, the switching member 23 can be pushed back into the first position A easily to lock the door body 10.

Referring to FIG. 9 to FIG. 14, in some embodiments, the handle 30 includes an inner side surface 31 close to the door body 10, and the accommodation space 33 is defined between the inner side surface 31 and the door body 10. The inner side surface 31 has a receiving groove 34 defined therein, and the receiving groove 34 has a shape matched with that of the switching member 23. The switching member 23 is at least partially received within the receiving groove 34 and movable within the receiving groove 34.

In this manner, the receiving groove 34 can better protect the switching member 23, and a receiving space can allow the user's hand to hold the door body 10 more conveniently and also facilitate pushing, by the user, the switching member 23 in the receiving space.

For example, the handle 30 has a surface on a side thereof facing towards the outer surface of the door body 10, and the surface is the inner side surface 31. The inner side surface 31 may extend outwards from the outer surface of the door body 10 and define the accommodation space 33 together with the outer surface. The receiving groove 34 may be formed by recessing the inner side surface 31 in a direction facing away from the accommodation space 33, and has a shape matched with that of the switching member 23 to allow the switching member 23 to be slidable within the receiving groove 34. In this manner, the receiving groove 34 can better protect the switching member 23, thereby preventing the switching member 23 from being hit and damaged.

Referring to FIG. 14 to FIG. 17, in some embodiments, the inner side surface 31 includes a holding surface 311 facing towards the door body 10. The switching member 23 includes a connecting segment 231 and a protrusion 232. The connecting segment 231 is connected to the sliding portion 21 and movably arranged within the receiving groove 34, and the protrusion 232 is connected to an end of the connecting segment 231 facing away from the sliding portion 21 and protrudes from the holding surface 311.

In this manner, the holding surface 311 can provide a more comfortable gripping feeling to the hand of the user, and the protrusion 232 protruding from the holding surface 311 provides more convenience for the user to push the switching member 23.

For example, the holding surface 311 faces towards the outer surface of the door body 10, and the holding surface 311 can be constructed into a smooth curved surface to provide the user with a more comfortable sliding feeling when the user grips the holding surface 311, and prevent the user's hand from being scratched. The receiving groove 34 may be formed at a connection between the holding surface 311 and the door body 10. The connecting segment 231 may have a shape matched with that of a connection between the handle 30 and the door body 10. The protrusion 232 may be arranged at an end of the connecting segment 231 facing way from the sliding portion 21 and protrude inwardly from the holding surface 311. When the user grips the holding surface 311 with his/her hand, the sliding of the sliding portion 21 can be controlled by pushing the protrusion 232. The protrusion 232 provides more convenience for the user to push the switching member 23.

Figure 18:
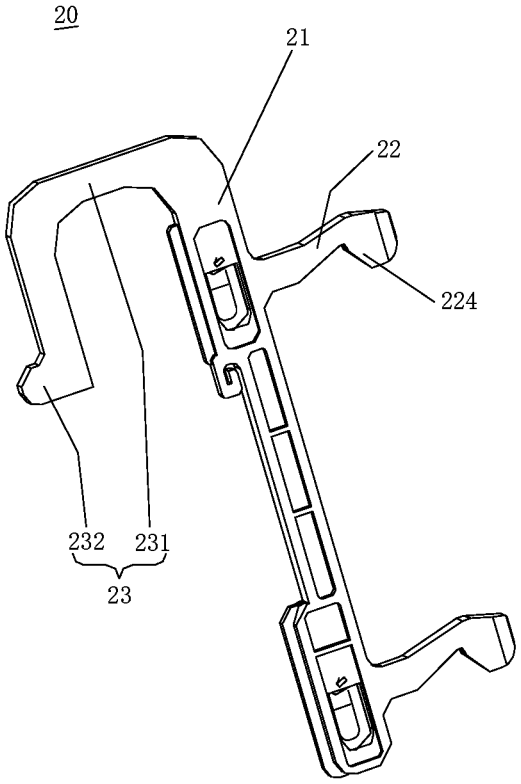
FIG. 18 is a schematic perspective structural view showing an engagement member according to an embodiment of the present disclosure.
Figure 19:
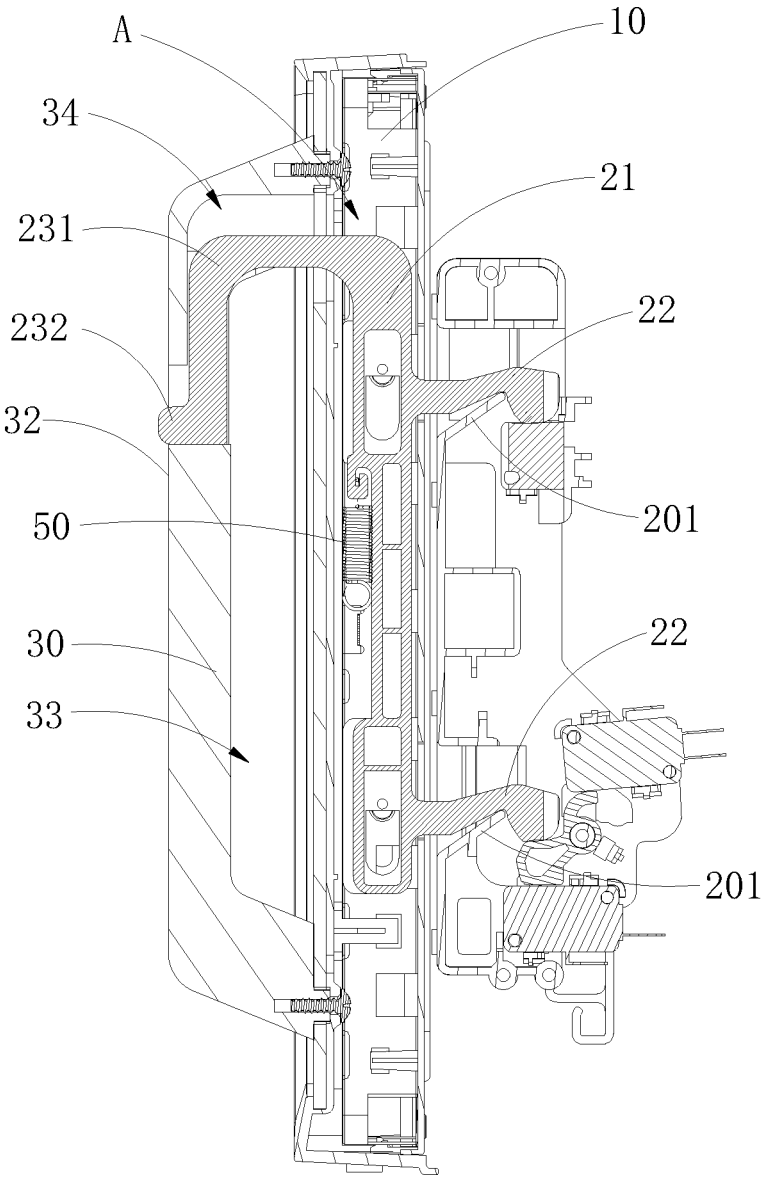
FIG. 19 is a schematic cross-sectional structural view showing the engagement member at a first position according to an embodiment of the present disclosure.
Figure 20:
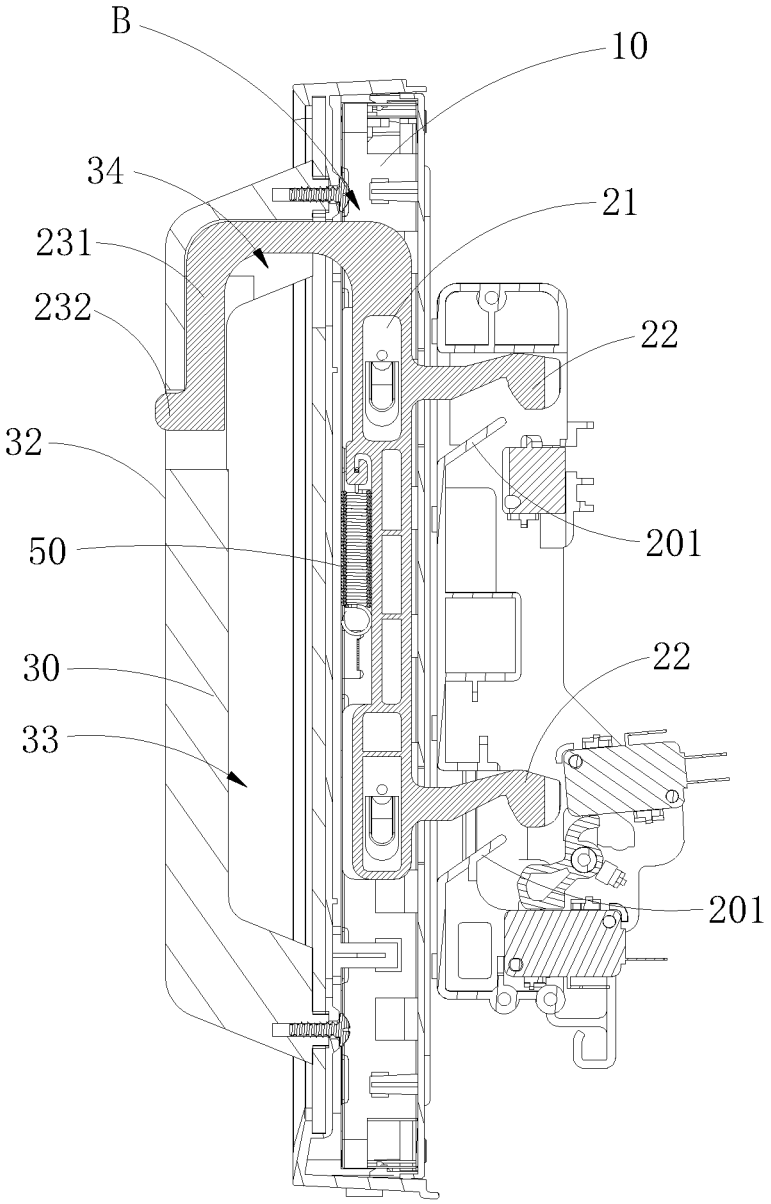
FIG. 20 is a schematic cross-sectional structural view showing the engagement member at a second position according to an embodiment of the present disclosure.

Referring to FIG. 18 to FIG. 20, in some embodiments, the handle 30 includes an appearance surface 32 facing away from the door body 10. The switching member 23 includes a connecting segment 231 and a protrusion 232. The connecting segment 231 is connected to the sliding portion 21 and movably arranged within the receiving groove 34. The protrusion 232 is connected to an end of the connecting segment 231 facing away from the sliding portion 21, and protrudes beyond the appearance surface 32 from the receiving groove 34 in a direction facing away from the door body 10.

In this manner, the appearance surface 32 can provide a more delightful overall appearance for the cooking device 1000, and at the same time, provide the user's hand with more comfortable feeling when the user grips the appearance surface 32. The protrusion 232 protrudes outwards beyond the appearance surface 32, such that the switching member 23 is pushed by the user more conveniently.

For example, the appearance surface 32 may be a surface of the handle 30 facing towards the outer side of the door body 10. The appearance surface 32 can be matched with the outer surface of the door body 10 in such a manner that the handle 30 protruding from the outer surface of the door body 10 would not affect an appearance of the door body 10 to ensure overall aesthetics of the cooking device 1000. When gripping the handle 30, the user also grips the appearance surface 32, and thus the appearance surface 32 may also be configured as a smooth curved surface to provide the user with more comfortable sliding experience when gripping the appearance surface 32, thereby preventing the user's hand from being scratched.

The receiving groove 34 may be formed on an inner side of the handle 30 and partially pass through the handle 30 to allow the protrusion 232 to protrude outwards from the appearance surface 32. The connecting segment 231 may have a shape matched with that of the connection between the handle 30 and the door body 10, and the protrusion 232 may be arranged at the end of the connecting segment 231 facing away from the sliding portion 21 and protrudes from the receiving groove 34 beyond appearance surface 32 in a direction facing towards the appearance surface 32. When the user's hand grips the handle 30, the user's thumbs can push the protrusion 232 to control the sliding of the sliding portion 21. The protrusion 232 provides more convenience for the user to push the switching member 23.

Figure 21:
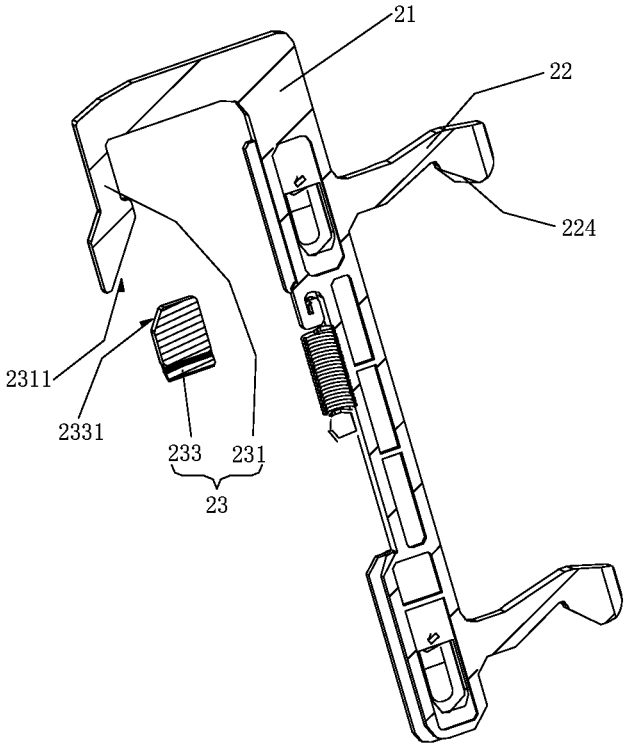
FIG. 21 is a schematic perspective structural view showing an engagement member according to an embodiment of the present disclosure.
Figure 22:
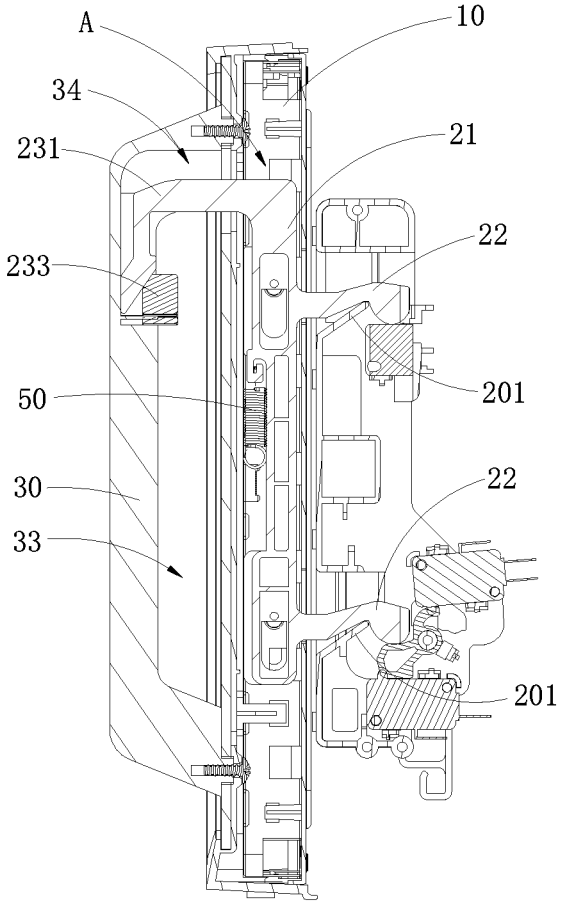
FIG. 22 is a schematic cross-sectional structural view showing the engagement member at a first position according to an embodiment of the present disclosure.
Figure 23:
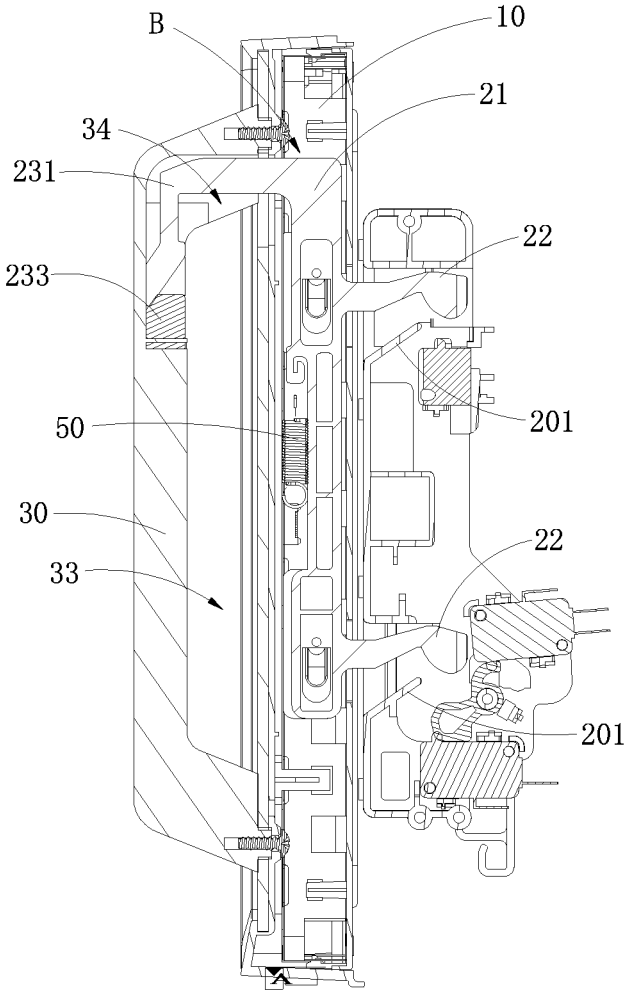
FIG. 23 is a schematic cross-sectional structural view showing the engagement member at a second position according to an embodiment of the present disclosure.

Referring to FIG. 21 to FIG. 23, in some embodiments, the inner side surface 31 includes a holding surface 311 facing towards the door body 10. The switching member 23 includes a connecting segment 231 and an operating member 233. The connecting segment 231 is connected to the engagement member 20 and movably arranged within the receiving groove 34. The operating member 233 is movably arranged on the handle 30 and partially extends beyond the holding surface 311 towards the door body 10. The operating member 233 is configured to cooperate with the connecting segment 231 to move the engagement member 20 between the first position A and the second position B.

In this manner, the user can drive the movement, relative to the door body 10, of the engagement member 20 by pushing the operating member 233. The operation is simple, convenient, and facilitates the exertion of the external force the user' fingers when opening the door body.

For example, the receiving groove 34 may be formed at the connection between the holding surface 311 and the door body 10. The connecting segment 231 may have a shape matched with that of the connection between the handle 30 and the door body 10. The operating member 233 is movably arranged at an end of the connecting segment 231 facing away from the sliding portion 21 and extends beyond the holding surface 311.

It should be understood that the operating member 233 may be partially located within the receiving groove 34 and partially located within the accommodation space 33. The user can extend his/her fingers into the accommodation space 33 to press the operating member 233 in such a manner that the operating member 233 is slidingly engaged with the connecting segment 231, which in turn drives the engagement member 20 to move between the first position A and the second position B.

Here, the operating member 233 is operated in an operation direction perpendicular to a movement direction of the engagement member 20. That is, the operating member 233 may be pressed by the fingers in a direction perpendicular to a direction of the holding surface 311, such that the user can press the operating member 233 while pulling the door body 10 outwards to unlock the door body 10. Such an unlocking method is more convenient.

Alternatively, in other embodiments, the operating member 233 is operated in an operation direction oblique to a movement direction of the engagement member 20. That is, the operating member 233 may be pressed by the fingers in a direction from bottom to top, or from top to bottom. The present disclosure is not limited in this regard, and the operation direction can be selected by the user as desired.

Referring to FIG. 21 to FIG. 23, in some embodiments, the operating member 233 has a driving surface 2331 formed at an end thereof facing towards the connecting segment 231, the connecting segment 231 has a driven surface 2311 formed at an end thereof that cooperates with the operating member 233, and a contact surface between the driving surface 2331 and the driven surface 2311 is arranged to be inclined relative to the operation direction of the operating member 233.

In this manner, the engagement member 20 can be driven through cooperation between the driving surface 2331 and the driven surface 2311 to move between the first position A and the second position B to allow the door body 10 to be switchable between locking and unlocking.

For example, when the operating member 233 is pressed towards the connecting segment 231, the driving surface 2331 can provide a certain guiding to allow the driven surface 2311 to slide along the driving surface 2331. Therefore, the connecting segment 231 may move upwards under driving of the operating member 233 to drive the engagement member 20 to move upwards, thereby implementing unlocking between the hook 224 and the limiting portion 201.

Here, both the driving surface 2331 and the driven surface 2311 are flat surfaces. In this case, the operating member 233 can be pressed more smoothly towards the holding surface 311. Therefore, the operating member 233 and the holding surface 311 can better cooperate with each other, and the operation is more smoothly.

Of course, at least one of the driving surface 2331 and the driven surface 2311 is a curved surface. For example, the driving surface 2331 is a curved surface convexed towards the driven surface 2311, or the driven surface 2311 is a curved surface convexed towards the driving surface 2331. In this manner, the driving surface 2331 can slidably cooperate with the driven surface 2311 better, thereby implementing smooth operation. The present disclosure does not limit structures of the driving surface 2331 and the driven surface 2311.

Referring to FIG. 9 to FIG. 13, in some embodiments, the door body structure 100 includes a jacket 40 arranged between the switching member 23 and the handle 30 and made of a shock absorbing material. When the sliding portion 21 is at the first position A or the second position B, the jacket 40 is abutted against the handle 30.

In this manner, when the user pushes the switching member 23 to move, the jacket 40 can attenuate sounds generated by collisions between the switching member 23 and the handle 30, and can also prevent the switching member 23 from being damaged due to an excessive pushing force, thereby protecting the switching member 23 to a certain extent.

In some embodiments, a sealing member may be provided between the door body 10 and the housing 200. The sealing member has a satisfying sealing effect when the door body 10 is closed relative to the housing 200, and also has a noise reduction effect in avoiding loud noises generated by a direct collision between the door body 10 and the housing when the door body 10 is closed.

In some embodiments, the jacket 40 is arranged on the switching member 23. In this manner, the jacket 40 can not only have shock absorption and noise reduction effect, but also make the user feel more comfortable when pushing the switching member 23.

For example, the jacket 40 may has a shape matched with that of the switching member 23 and sleeved on the switching member 23. When the user pushes the switching member 23, the jacket 40 can lower the sound generated by the collision between the switching member 23 and the handle 30 when the switching member 23 is pushed in place, and can also better protect the switching member 23.

Referring to FIG. 12 and FIG. 13, in some embodiments, the jacket 40 extends obliquely upwards in a direction from the handle 30 to the door body 10. For example, the jacket 40 has a pressing surface located on a side thereof facing towards the accommodation space 33 and arranged obliquely upwards in the direction from the handle 30 to the door body 10. In this manner, when the user presses the jacket 40 to push the switching member 23, a pressing force can be divided into an upward force and an outward force due to an inclined structure of the jacket 40, such that the door body 10 can be opened naturally when the switching member 23 is pressed for opening the door body. The door opening process is more convenient and provides a more comfortable pressing feeling to the hand.

Of course, in other embodiments, the jacket 40 may also be arranged to extend obliquely downwards in the direction from the handle 30 to the door body 10. For example, the jacket 40 has a pressing surface located on a side thereof facing towards the accommodation space 33 and arranged obliquely downwards in the direction from the handle 30 to the door body 10. In this manner, when the user presses the jacket 40 to push the switching member 23, a pressing force can be divided into an upward force and an inward force due to an inclined structure of the jacket 40, such that when the switching member 23 is pressed to open the door, an inward pushing force is generated to disengage the hook 224 from the limiting portion 201 better, thereby avoiding a pressing difficulty caused when the hook 224 is stuck.

The present disclosure does not limit an oblique direction of the jacket 40, and the oblique direction may be determined based on practical situations. According to an embodiment, when the jacket 40 extends obliquely upwards from the handle 30, the door body can be opened easier.

In certain embodiments, the jacket 40 is shaped to be suitable for being gripped by the user's hand. For example, the jacket 40 includes compliant curved surfaces concave downwardly and upwardly. The compliant curved surfaces have shapes matched with those of fingers, thereby providing more comfortable feelings to the user when pressing the switching member 23, and avoiding hurting the hand.

Figure 24:
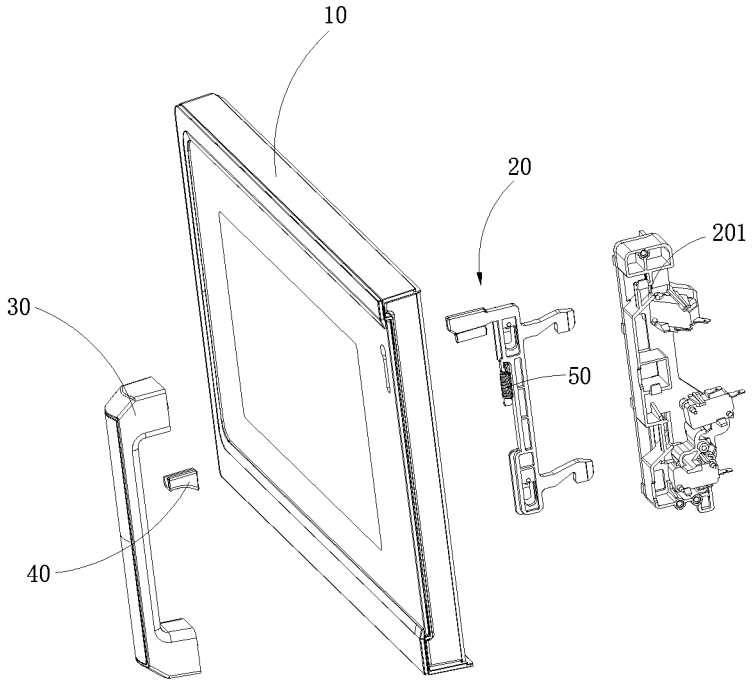
FIG. 24 is a schematic partially exploded structural view showing a cooking device according to an embodiment of the present disclosure.
Figure 25:
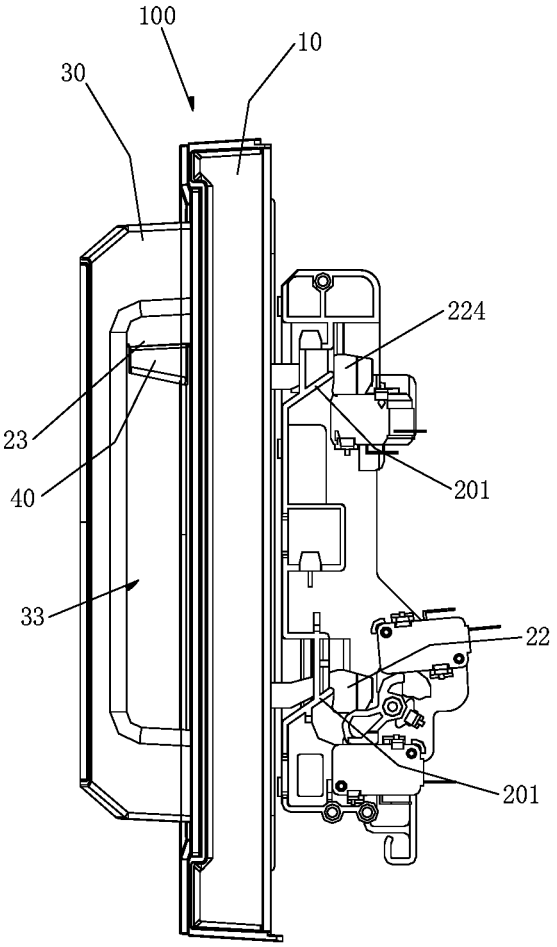
FIG. 25 is a schematic structural view showing a door body structure when being closed according to an embodiment of the present disclosure.

Referring to FIG. 8, FIG. 24, and FIG. 25, the cooking device 1000 according to the embodiments of the present disclosure includes a housing 200 and the door body structure 100 according to the embodiments of the present disclosure. The housing 200 has a limiting portion 201 provided thereon, and the door body structure 100 is connected to the housing 200 in an openable and closable manner.

Referring to FIG. 24 to FIG. 28, a door body structure 100 according to the embodiments of the present disclosure includes a door body 10, an engagement member 20, and a switching member 23. The door body 10 is connected to the housing 200 in the openable and closable manner. The engagement member 20 is arranged on the door body 10 and includes a hook 224. The hook 224 is formed with a barb structure 223 facing towards the door body 10. The switching member 23 is configured to drive the engagement member 20 to move relative to the door body 10 between a first position A and a second position B.

Here, the switching member 23 is formed by a part of the engagement member 20 protruding from the outer side of the door body 10. The hook 224 is configured to be engaged with the limiting portion 201 by the barb structure 223 to prevent the door body 10 from being opened when the engagement member 20 is at the first position A, and to be disengaged from the limiting portion 201 to allow the door body 10 to be opened when the engagement member 20 is at the second position B.

In the door body structure 100 and the cooking device 1000 according to the embodiments of the present disclosure, the hook 224 is formed with the barb structure 223. The switching member 23 is configured to drive the engagement member 20 to move relative to the door body 10 between the first position A and the second position B, such that the hook 224 can be engaged with or disengaged from the limiting portion 201 to limit closing or opening, relative to the housing 200, of the door body 10. In this manner, a user needs to push the switching member 23 firstly to drive the engagement member 20 to move into the second position B, and thus the door body 10 can be pulled to open the housing 200 only after the hook 224 is disengaged from the limiting portion 201. Multi-step operations can prevent the user from being injured by a high temperature inside the housing 200 when the user directly pulls the housing 200 open. Further, the barb structure 223 can increase engagement firmness between the hook 224 and the limiting portion 201 to prevent the door body 10 from being directly pulled open, thereby increasing the safety.

In some embodiments, the engagement member 20 further includes a sliding portion 21. The hook 224 is fixedly connected to the sliding portion 21 and protrudes from the door body 10 to extend towards the housing 200. The engagement member 20 can be slidably mounted on the door body 10 through the sliding portion 21. The sliding portion 21 may be constructed as a slider that is slidably arranged relative to the door body 10 by means of a pulley or a sliding groove. Here, the sliding portion 21 is slidable, relative to the door body 10, between the first position A and the second position B. For example, the sliding portion 21 is slidable, relative to the door body 10, in an upward-downward direction. In this case, the first position A may be a position where the sliding portion 21 is located when the sliding portion 21 slides to a lower side, and the second position B may a position where the sliding portion 21 is located when the sliding portion 21 slides to an upper side. Alternatively, the sliding portion 21 is slidable, relative to the door body 10, in a leftward-rightward direction. In this case, the first position A may be a position where the sliding portion 21 is located when the sliding portion 21 slides to a left side, and the second position B may be a position where the sliding portion 21 is located when the sliding portion 21 slides to a right side. The present disclosure does not limit a sliding manner or a sliding direction between the sliding portion 21 and the door body 10.

The hook 224 may extend from the sliding portion 21 towards the inner side of the door body 10 and protrude from the inner surface of the door body 10, and further, the sliding portion 21 can drive the hook 224 to slide. Therefore, the hook 224 can be engaged with the limiting portion 201 when the door body 10 is closed relative to the housing 200.

The limiting portion 201 may be constructed into a plate-like structure, a post-like structure, or the like. The limiting portion 201 may be directly formed within the engagement hole on the housing 200. Also, the limiting portion 201 may be formed on a fixing frame, by which the limiting portion 201 is fixed at the engagement hole, and extends from a side of the door body 10 to the inner side of the housing 200, such that when the hook 224 extends into the engagement hole, the limiting portion 201 can be engaged with the hook 224 to limit the door body 10.

The switching member 23 may be arranged on a side of the sliding portion 21 opposite to the hook 224. The switching member 23 extends from the sliding portion 21 towards the outer side of the door body 10 and protrudes from the outer side surface of the door body 10. The switching member 23 and the sliding portion 21 may be formed into one piece to such that the switching member 23 and the sliding portion 21 are more firmly connected to each other, thereby avoiding damages caused by pushing the switching member 23.

Figure 27:
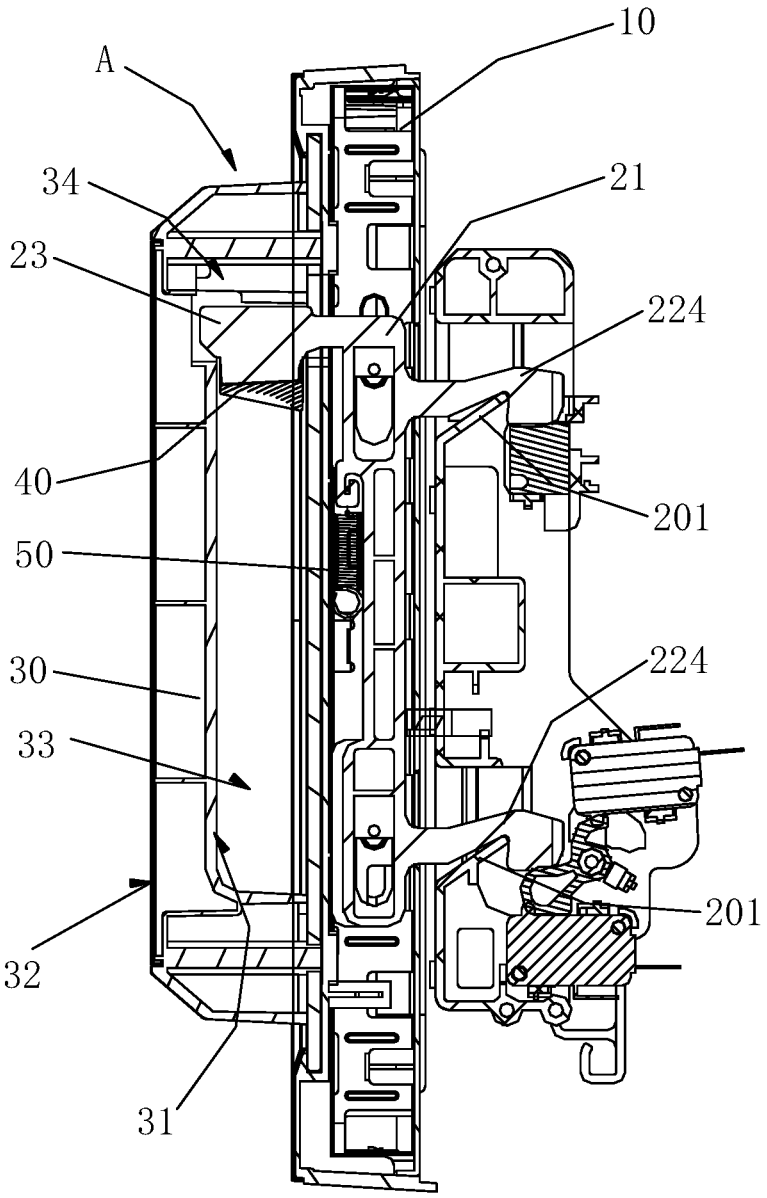
FIG. 27 is a schematic cross-sectional structural view showing the engagement member at a first position according to an embodiment of the present disclosure.

As illustrated in FIG. 27, when the door body 10 is closed relative to the housing 200, the switching member 23 may be controlled to move the sliding portion 21 into the first position A, and the hook 224 may slide synchronously with the sliding portion 21 to allow the hook 224 to be caught by the limiting portion 201. In this case, the door body 10 may be in a locked state relative to the housing 200. When pulls the door body 10 is pulled outwards by the user, the door body 10 cannot be opened, thereby preventing the user from being scalded in a case where the door body 10 is opened by mistake during cooking.

Here, it should be noted that the hook 224 has a barb structure 223 formed at an end thereof opposite to the sliding portion 21. The barb structure 223 may be formed by bending an end of the hook 224 towards the door body 10. When the door body 10 is closed relative to the housing 200 and the sliding portion 21 is at the first position A, the limiting portion 201 is caught at the barb structure 223. The barb structure 223 can be engaged with the limiting portion 201 more firmly to better prevent the door body 10 from being opened, thereby further improving safety performance of the cooking device 1000.

Figure 28:
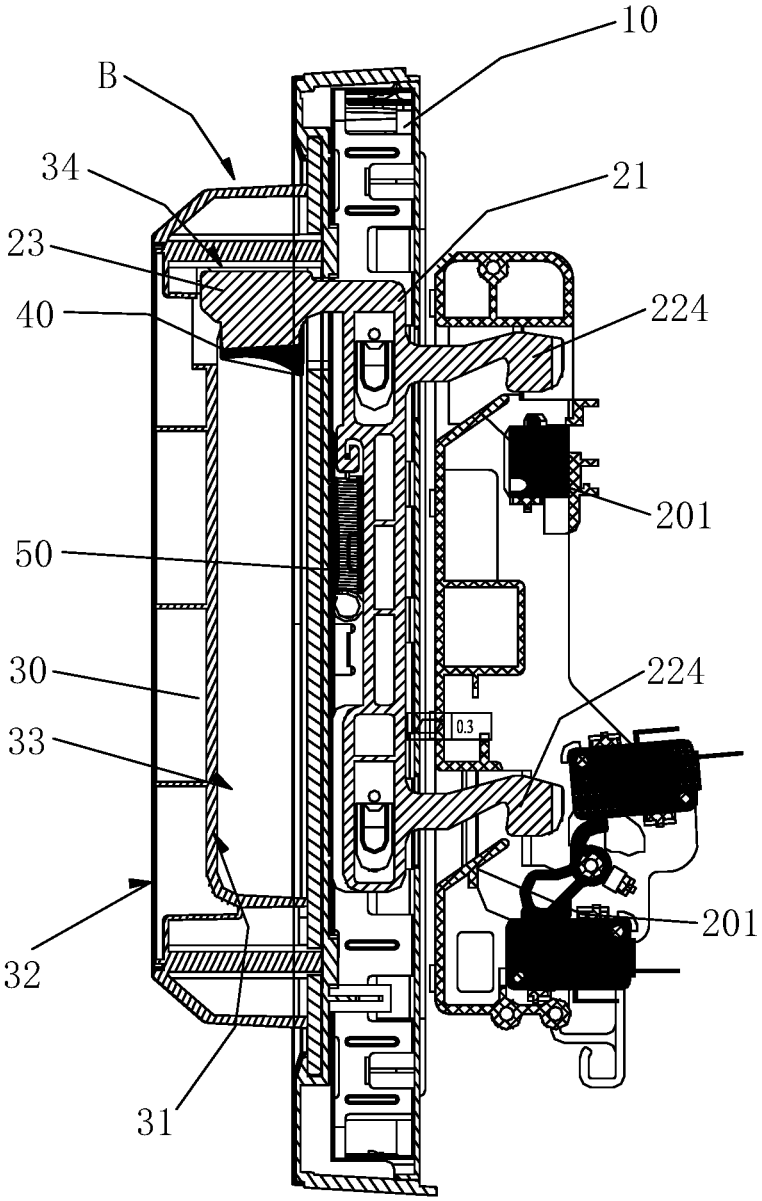
FIG. 28 is a schematic cross-sectional structural view showing the engagement member at a second position according to an embodiment of the present disclosure.
Figure 29:
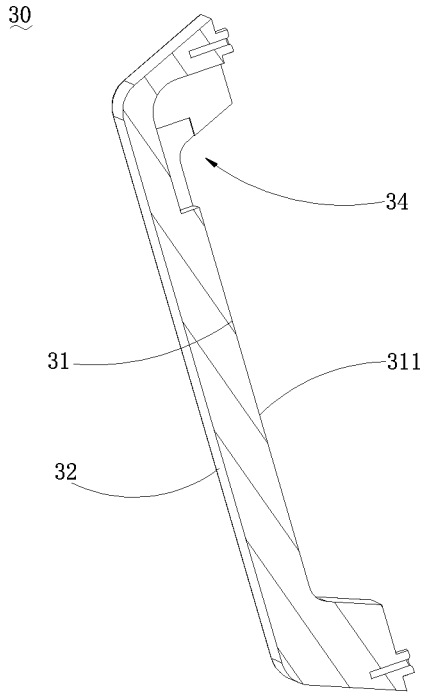
FIG. 29 is a schematic cross-sectional structural view showing a handle according to an embodiment of the present disclosure.
Figure 30:
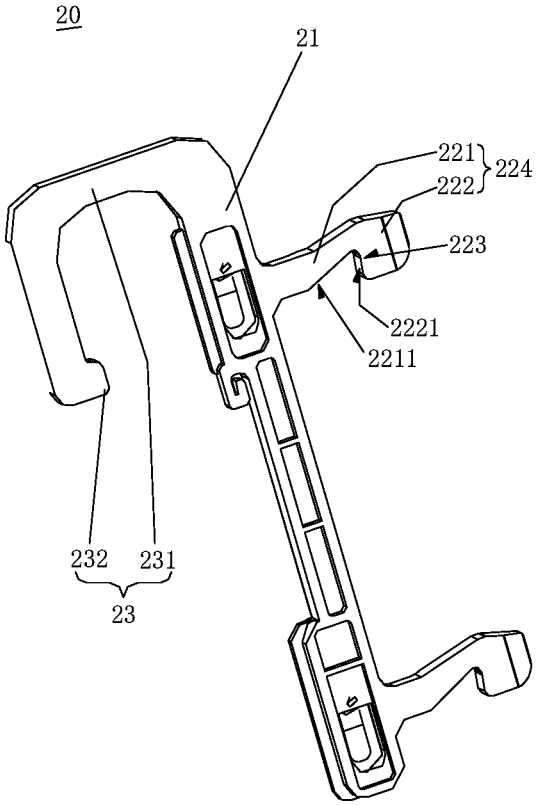
FIG. 30 is a schematic perspective structural view showing an engagement member according to an embodiment of the present disclosure.
Figure 31:
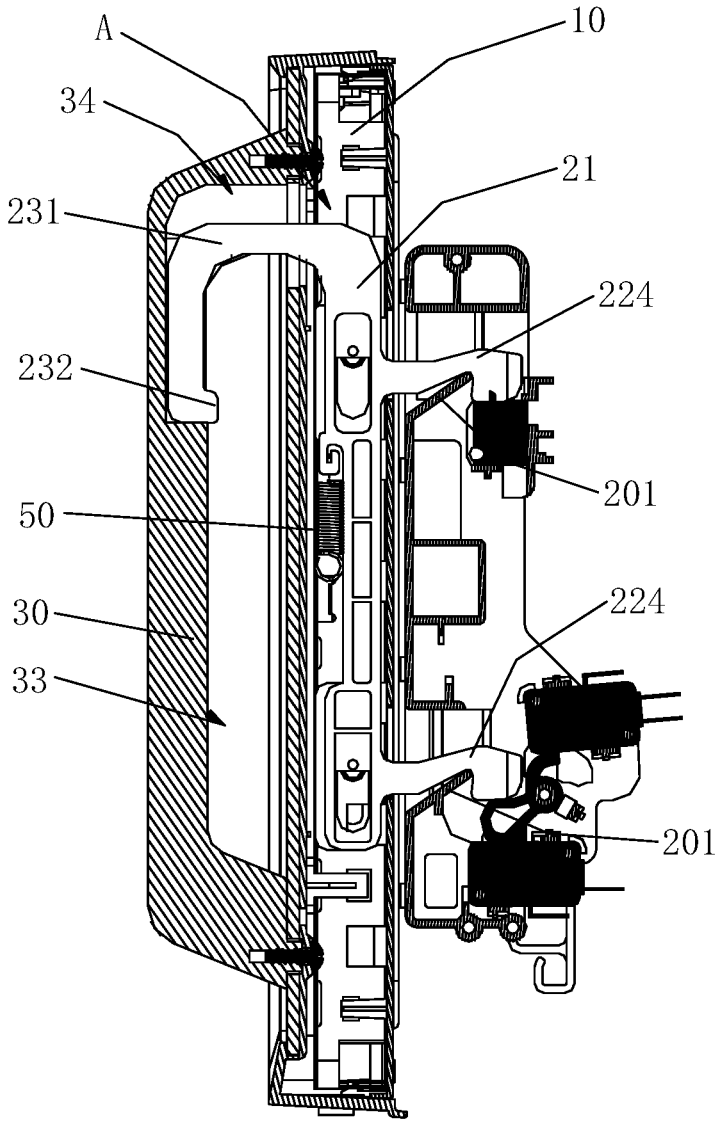
FIG. 31 is a schematic cross-sectional structural view showing the engagement member at a first position according to an embodiment of the present disclosure.
Figure 32:
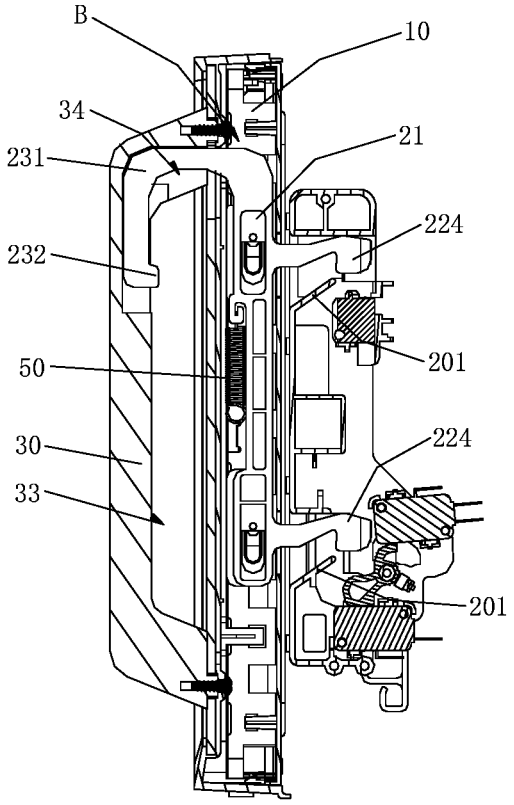
FIG. 32 is a schematic cross-sectional structural view showing the engagement member at a second position according to an embodiment of the present disclosure.
Figure 33:
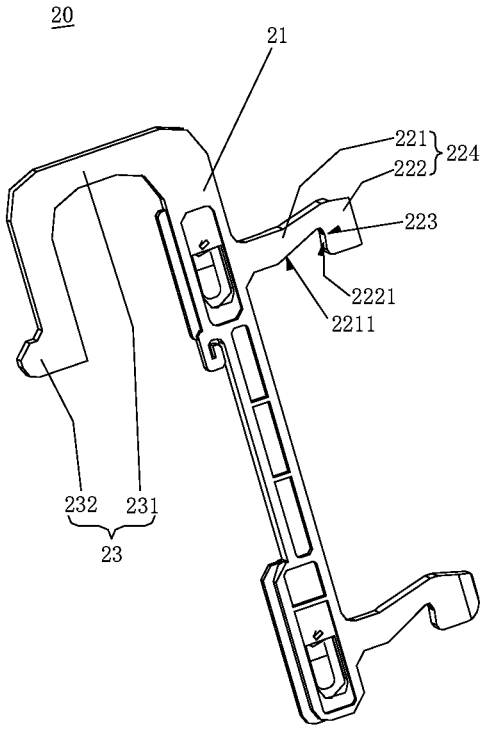
FIG. 33 is a schematic perspective structural view showing an engagement member according to an embodiment of the present disclosure.
Figure 34:
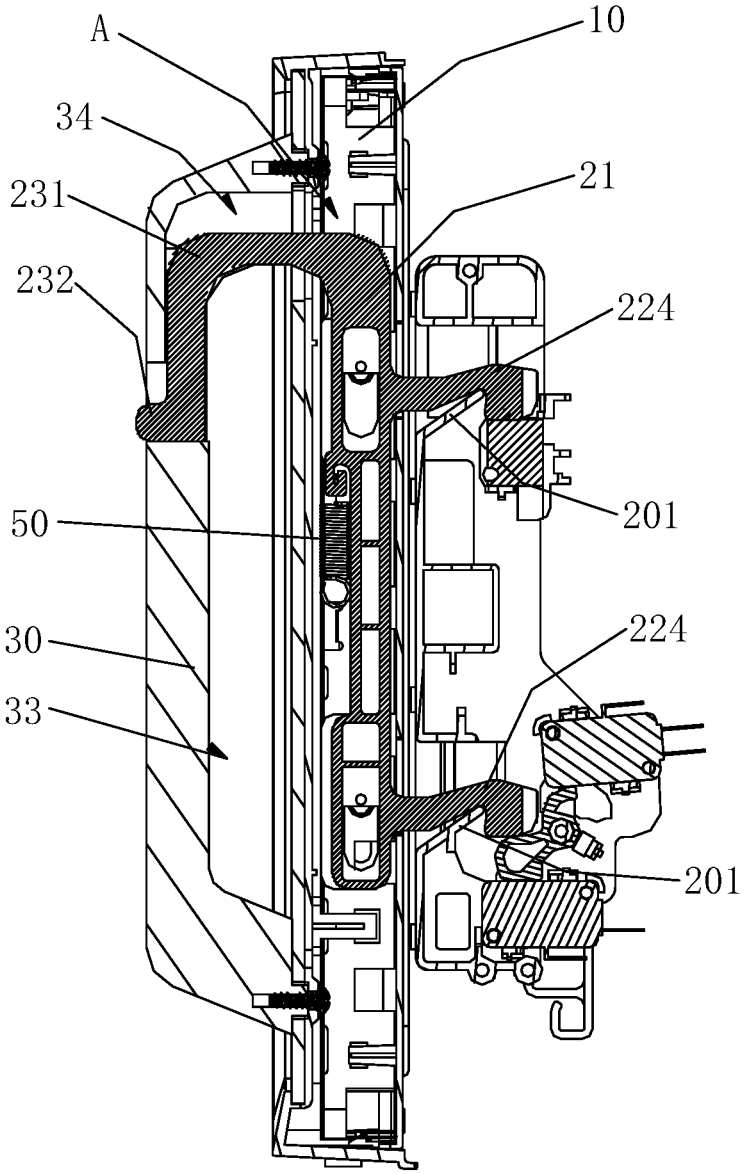
FIG. 34 is a schematic cross-sectional structural view showing the engagement member at a first position according to an embodiment of the present disclosure.
Figure 35:
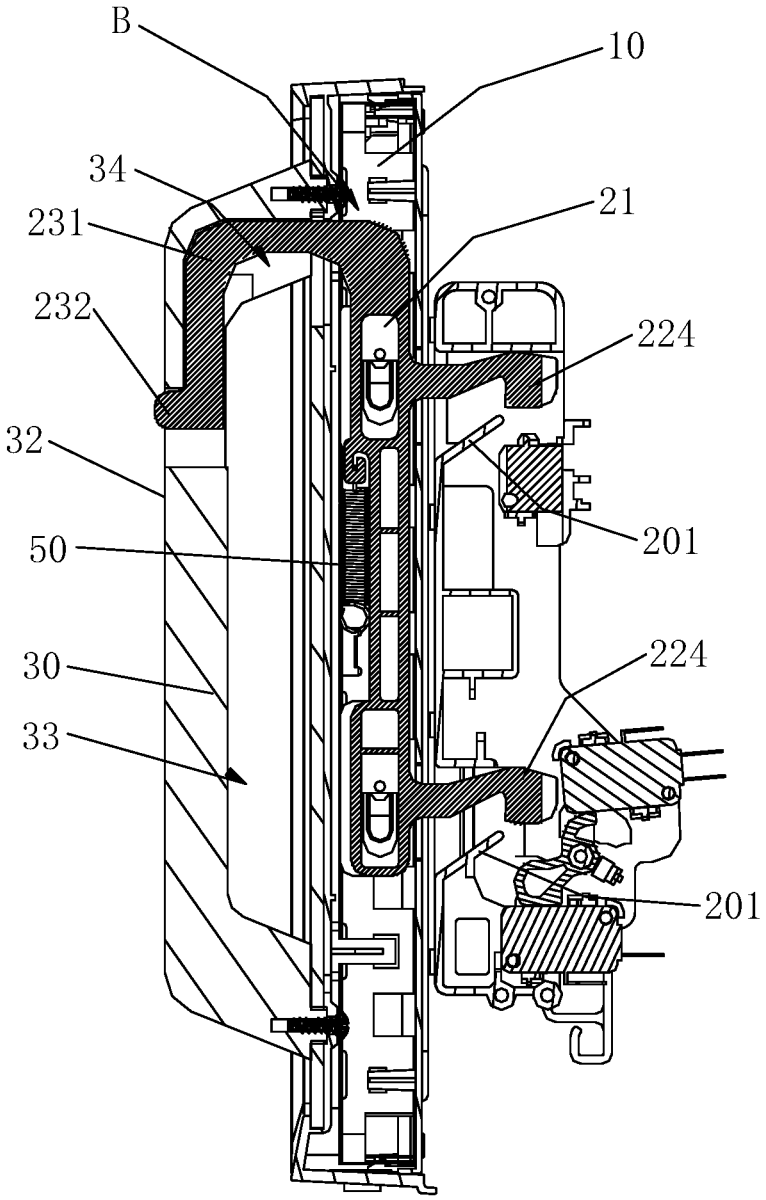
FIG. 35 is a schematic cross-sectional structural view showing the engagement member at a second position according to an embodiment of the present disclosure.
Figure 36:
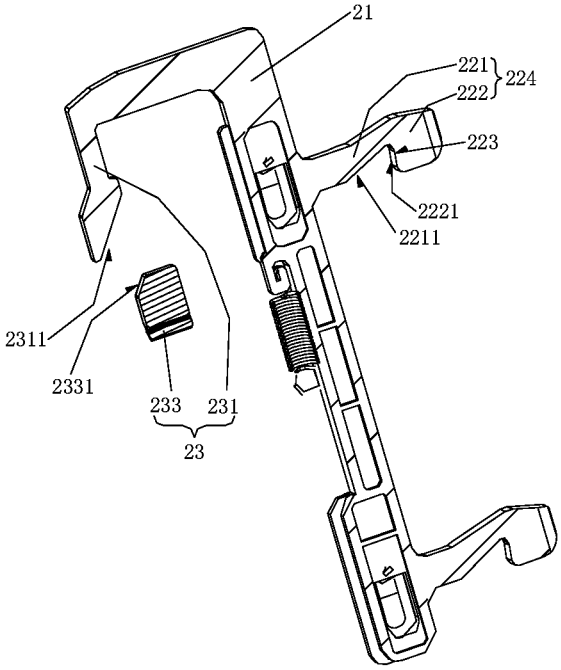
FIG. 36 is a schematic perspective structural view showing an engagement member according to an embodiment of the present disclosure.
Figure 37:
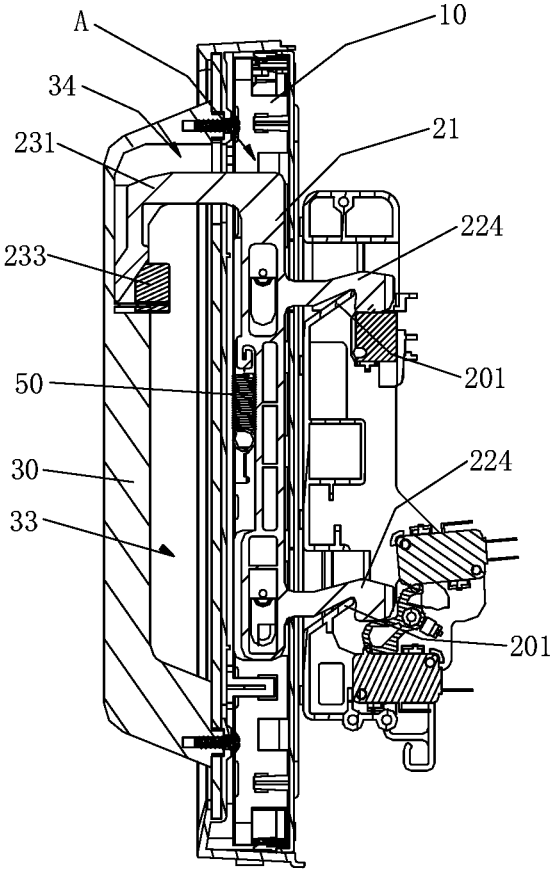
FIG. 37 is a schematic cross-sectional structural view showing the engagement member at a first position according to an embodiment of the present disclosure.
Figure 38:
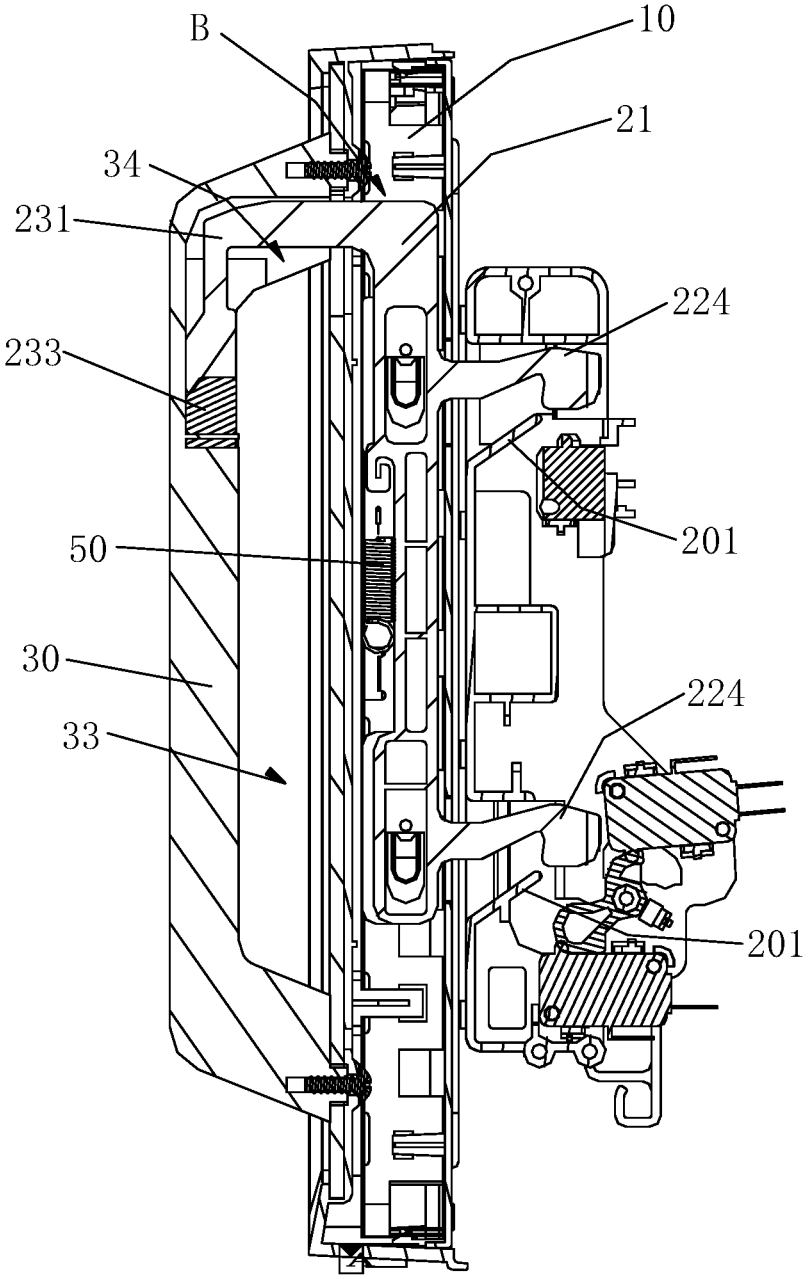
FIG. 38 is a schematic cross-sectional structural view showing the engagement member at a second position according to an embodiment of the present disclosure.

As illustrated in FIG. 28, when the user wants to open the housing 200 after cooking, the switching member 23 is controlled by the user to allow the sliding portion 21 to slide into the second position B, and the hook 224 slide synchronously with the sliding portion 21 to be disengaged from the limiting portion 201. That is, the barb structure 223 is also disengaged from the limiting portion 201. In this case, the door body 10 is in an unlocked state relative to the housing 200, and the housing 200 can be opened through pulling the door body 10 by the user. Multi-step operations can better prevent the user from being scalded when the door body 10 is opened by mistake, and especially better prevent a child from being scalded when the child opens the door body 10 during cooking, thereby greatly improving the safety of the cooking device 1000.

Figure 26:
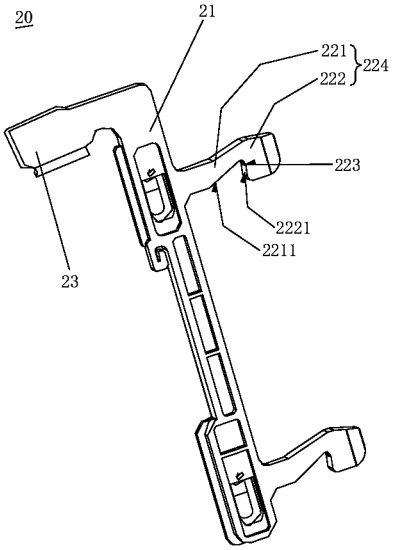
FIG. 26 is a schematic perspective structural view showing an engagement member according to an embodiment of the present disclosure.

Referring to FIG. 26 to FIG. 28, in some embodiments, the hook 224 includes a connecting arm 221 and an engagement portion 222. The connecting arm 221 is connected to the sliding portion 21, and the engagement portion 222 extends from an end of the connecting arm 221 facing away from the sliding portion 21 towards the sliding portion 21 while being bent to form a barb structure 223. The engagement portion 222 is configured to be caught by the limiting portion 201 when the sliding portion 21 is at the first position A, and to be disengaged from the limiting portion 201 when the sliding portion 21 is at the second position B.

In this manner, the hook 224 can implement locking between the door body 10 and the housing 200 through cooperation between the engagement portion 222 and the limiting portion 201, thereby preventing the door body 10 from being directly pulled open by the user.

For example, the connecting arm 221 extends from the sliding portion 21 towards the inner side of the door body 10, and the engagement portion 222 extends from an end of the connecting arm 221 opposite to the sliding portion 21 while being bent, such that the barb structure 223 can be located on the engagement portion 222. The sliding portion 21, the connecting arm 221, and the engagement portion 222 can be formed into one piece by injection molding to increase firmness of the connection therebetween, thereby improving restriction effect on the door body 10. Of course, the connection may also be implemented in other manners, which is not limited in the present disclosure.

The door body 10 can control, by controlling the sliding portion 21, the engagement portion 222 to be engaged with the limiting portion 201 to further control locking and unlocking, relative to the housing 200, of the door body 10. When the door body 10 is closed relative to the housing 200 and the sliding portion 21 is at the first position A, the engagement portion 222 can be engaged with the limiting portion 201 to prevent the door body 10 from being opened relative to the housing 200, so that the door body 10 is in the locked state to prevent the door body 10 from being opened by mistake. When the sliding portion 21 slides from the first position A into the second position B, the engagement portion 222 is disengaged from the limiting portion 201 to allow the door body 10 to be in the unlocked state. In this manner, the door body 10 can be pulled open relative to the housing 200 by an external force.

Referring to FIG. 26 to FIG. 28, in some embodiments, the connecting arm 221 includes a connecting surface 2211 extending along the sliding portion 21 towards the engagement portion 222. The engagement portion 222 includes an engagement surface 2221 connected to the connecting surface 2211. An included angle between the connecting surface 2211 and the engagement surface 2221 is an acute angle, and the engagement surface 2221 extends towards the sliding portion 21 from the connecting surface 2211.

In this manner, the barb structure 223 on the engagement portion 222 can be better engaged with the limiting portion 201 to prevent the limiting portion 201 from being disengaged from the engagement portion 222 when the door body 10 is pulled with a greater force, thereby further increasing engagement firmness between the limiting portion 201 and the engagement portion 222.

For example, the included angle between the connecting surface 2211 and the engagement surface 2221 may be understood as a bending degree of the engagement portion 222 relative to the connecting arm 221. The engagement firmness between the limiting portion 201 and the engagement portion 222 increases and the included angle between the connecting surface 2211 and the engagement surface 2221 decreases as the bending degree of the engagement portion 222 relative to the connecting segment increases. When the door body 10 is pulled with the greater force, the limiting portion 201 may be caught within the included angle between the connecting surface 2211 and the engagement surface 2221, such that the limiting portion 201 would not be disengaged from the engagement portion 222 along the engagement surface 2221.

The included angle between the connecting surface 2211 and the engagement surface 2221 increases as the bending degree of the engagement portion 222 relative to the connecting segment decreases. When the door body 10 is pulled with the greater force, the limiting portion 201 would be disengaged from the engagement portion 222 along the engagement surface 2221, and thus the door body 10 is directly pulled open, resulting in low safety.

Of course, in some other embodiments, the included angle between the engagement surface 2221 and the connecting surface 2211 may also be a right angle. The right-angled engagement portion 222 can also provide good engagement. According to an embodiment, the included angle between the engagement surface 2221 and the connecting surface 2211 should not be an obtuse angle, for a reason that the obtuse-angled engagement portion 222 may allow the door body 10 to be directly pulled open easily, which results in injury to the user easily.

Referring to FIG. 26 to FIG. 28, in some embodiments, the sliding portion 21 is slidable, relative to the door body 10, in the upward-downward direction, and the first position A is located below the second position B. In this manner, the sliding portion 21 can slide relatively smoothly with respect to the door body 10 to better drive the hook 224 to be caught by and engaged with the limiting portion 201. Correspondingly, the limiting portion 201 may be arranged obliquely upwards, such that when the sliding portion 21 drives the hook 224 to slide downwards, the limiting portion 201 can be better caught by and engaged with the hook 224.

In some embodiments, a plurality of hooks 224 is provided. The plurality of hooks 224 is arranged at intervals in the sliding direction of the sliding portion 21, and at least one of the plurality of hooks 224 is provided with the barb structure 223.

In this manner, the plurality of hooks 224, which is arranged at intervals, is arranged on the sliding portion 21 to allow the sliding portion 21 to simultaneously drive the plurality of hooks 224 to move, and thus the operation is simple and convenient. The plurality of hooks 224 is caught by the respective limiting portions 201 to provide better restriction on the door body 10, thereby further preventing the door body 10 from being pulled open directly.

For example, two, three, or four hooks 224 may be provided. For example, two hooks 224 are arranged to be spaced apart from each other in the sliding direction of the sliding portion 21 and extend in a same direction. Correspondingly, the number and position of the limiting portions 201 on the housing 200 correspond to the number and position of the hook 224.

When sliding, the sliding portion 21 can simultaneously drive the plurality of hooks 224 to move to be engaged with or disengaged from the limiting portion 201, such that the user only needs to push the sliding portion 21 to control the movement of the plurality of hooks 224 during operation. Such an operation method is simple and convenient. At the same time, when the door body 10 is closed relative to the housing 200, the plurality of hooks 224 makes the locking between the door body 10 and the housing 200 firmer, thereby further preventing the door body 10 from being directly pulled open.

Here, each of the plurality of hooks 224 may have the barb structure 223 provided at an end thereof, or some of the plurality of hooks 224 may have rounded ends, and some of the hooks 224 may have the barb structures 223 provided at ends thereof. It should be noted that at least one of the plurality of hooks 224 has the barb structure 223 provided at an end thereof to allow the hook 224 to be better caught by and engaged with the limiting portion 201, thereby preventing the door body 10 from being directly pulled open.

For example, the jacket 40 may be made of a rubber material. Good flexibility of the rubber material has a good damping effect, and satisfying sound absorption performance of the rubber material has a good noise reduction effect. When the user uses the cooking device 1000 in a quiet environment, during pushing the switching member 23 to open or close the door body 10, the jacket 40 can effectively reduce collisions between the switching member 23 and the handle 30 and lower sounds generated by the collisions, without interfering with other people. The jacket 40 may also be made of other materials with damping performance, and the present disclosure does not limit the material of the jacket 40.

When the door body 10 needs to be closed, the user also needs to firstly push the switching member 23 against the elastic force of the restoring member 50 to allow the sliding portion 21 to slide into the second position B, and then pushes the door body 10. After the external force is removed, the restoring member 50 can pull the sliding portion 21 to slide back into the first position A, without pushing the switching member 23 again to allow the sliding portion 21 to slide back into the second position B. The sliding portion 21 can be maintained at the first position A by a pulling force of the restoring member 50, thereby preventing the door body 10 from being directly pulled open by the user.

In some embodiments, the hook 224 may be formed with a guide surface at an end thereof opposite to the sliding portion 21. The guide surface is arranged obliquely to guide the limiting portion 201 to slide towards the hook 224 when closing the door body 10. In this way, when closing the door body 10, the door body 10 can be directly pushed by the user to be closed. The guide surface can guide the limiting portion 201 to slide directly back to the barb structure 223 of the hook 224, and the sliding portion 21 can be pulled, by the pulling force of the restoring member 50, to slide back to the first position A to lock the door body 10.

Of course, in the case where the door body 10 is directly pushed by the user to be closed, since no external force is exerted on the engagement member 20, the engagement member 20 may collide with the door body 10 due to the restoring member 50, and thus sounds may be generated. Therefore, when quietness is required, it is avoided to directly push the door body 10 to be closed for eliminating influences on other people.

Figure 39:
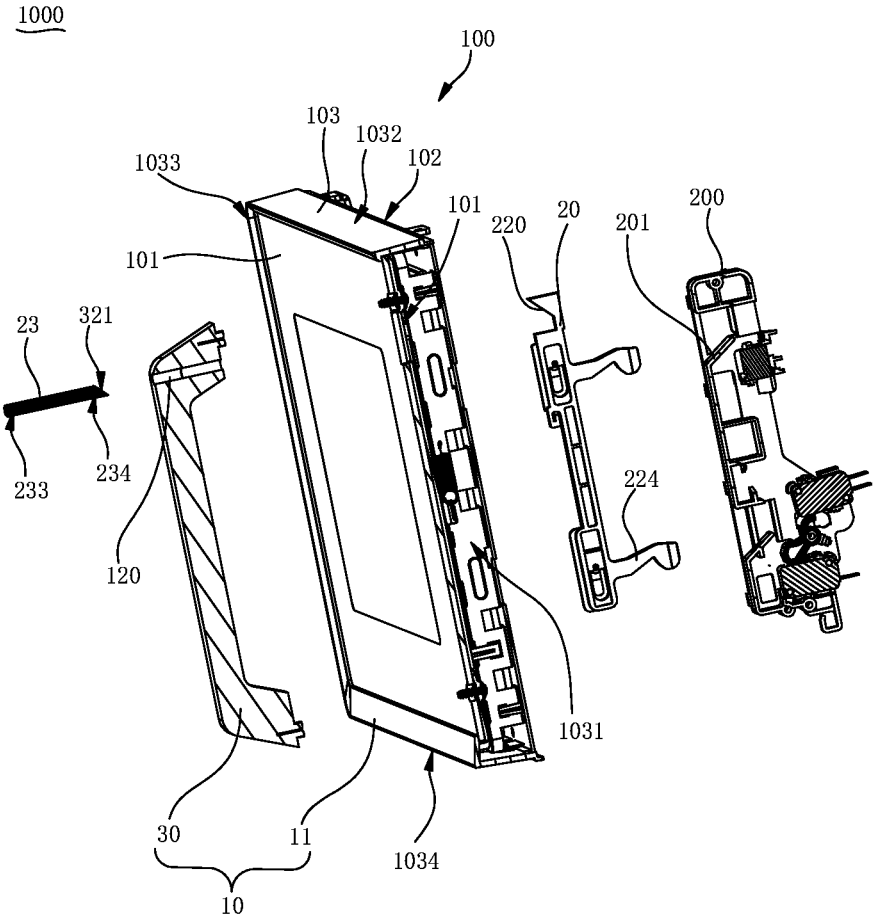
FIG. 39 is a schematic exploded view showing a door body structure according to an embodiment of the present disclosure.
Figure 40:
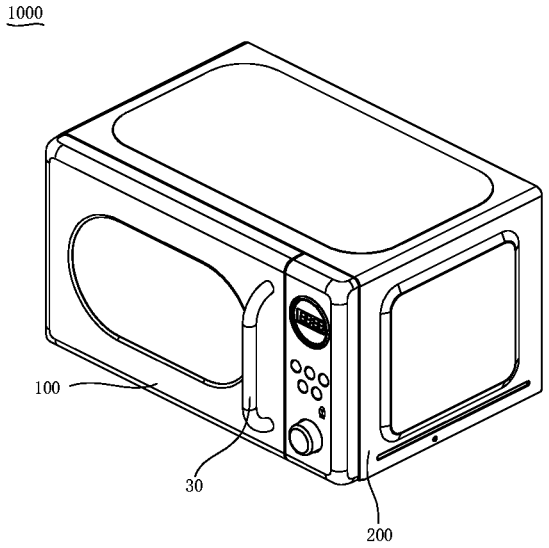
FIG. 40 is a schematic plan view of a cooking device according to some embodiments of the present disclosure.

Referring to FIG. 39 and FIG. 40, according to an embodiment of the present disclosure, a door body structure 100 is provided. The door body structure 100 includes a door body 10, an engagement member 20, and a switching member 23. The door body 10 is connected to a housing 200 of the cooking device 1000 in an openable and closable manner. The housing 200 includes a limiting portion 201. The engagement member 20 is arranged on the door body 10 and includes a hook 224. The switching member 23 is configured to drive the engagement member 20 to move relative to the door body 10 between a first position and a second position. Here, the switching member 23 extends into the door body 10 from an outer side of the door body 10, and is movable relative to the door body 10. The switching member 23 is capable of cooperate with the engagement member 20. The hook 224 is configured to be engaged with the limiting portion 201 to prevent the door body 10 from being opened when the engagement member 20 is at the first position, and to be disengaged from the limiting portion 201 to allow the door body 10 to be opened when the engagement member 20 is at the second position.

In the door body structure 100 according to the embodiments of the present disclosure, when the door body structure 100 is at the first position, the engagement member 20 is engaged with the limiting portion 201. If the door body 10 needs to be opened without being unlocked, it is necessary to release an engagement force between the engagement member 20 and the limiting portion 201, which may result in loud noises. However, in the present disclosure, the switching member 23 is provided. When being pressed, the switching member 23 drives the engagement member 20 to move between the first position and the second position. When the engagement member 20 moves into the second position, locking between the engagement member 20 and the limiting portion 201 can be released. In this case, the door body can be opened without releasing the engagement force between the engagement member 20 and the limiting portion 201. Therefore, no noise is generated, and thus the door body 10 can be opened silently. Similarly, when the door body 10 needs to be closed, the engagement member 20 can be driven to move into the second position by pressing the switching member 23 firstly, and thus the door body 10 can be closed without releasing the engagement force, such that the door body 10 can be closed silently. In this case, by the door body structure 100 of the present disclosure, the door body 10 can be opened and closed silently without generating loud noises that may affect people's study, work and rest.

Further description will be provided below in conjunction with the accompanying drawings.

Referring to FIG. 40, a cooking device 1000 includes a door body structure 100 and a housing 200. The door body structure 100 is arranged on the housing 200.

Here, the cooking device 1000 may be a kitchen electrical appliance such as a microwave oven, a baking oven, an electric cooker, and a refrigerator. The cooking device 1000 of the present disclosure is described by taking the microwave oven as an example. It should be understood that the cooking device 1000 is not limited to the microwave oven.

With reference to FIG. 39 again, the door body structure 100 includes a door body 10, an engagement member 20, and a switching member 23. The engagement member 20 and the switching member 23 are arranged on the housing 200.

For example, the door body 10 is connected to the housing 200 of the cooking device 1000 in an openable and closable manner. That is, the door body 10 is a door of the cooking device 1000.

The door body 10 includes a top wall 101, a bottom wall 102, and a side wall 103. The top wall 101 and the bottom wall 102 are opposite to each other, and the side wall 103 is connected to the top wall 101 and the bottom wall 102. Here, the side wall 103 includes a first side wall 1031, a second side wall 1032, a third side wall 1033, and a fourth side wall 1034 which are connected end to end in sequence. The first side wall 1031 and the third side wall 1033 are arranged opposite to each other, and the second side wall 1032 and the fourth side wall 1034 are arranged opposite to each other. Here, the top wall 101 is farther away from the housing 200 than the bottom wall 102. The engagement member 20 and the switching member 23 are arranged on the first side wall 1031.

In an embodiment, when the door body 10 is made of a metallic material, on the one hand, it can be ensured that the door body 10 has sufficient strength, which prevents the door body structure 100 from being damaged due to collisions, and on the other hand, the door body 10 can have good corrosion resistance, which avoids loss of metallic gloss of the door body 10 due to corrosions by a liquid such as sewage or detergents, thereby prolonging service life of the door body structure 100.

For example, the door body 10 may include a door plate 11 and the handle 30 arranged on the door plate 11. It should be understood that the user may open or close the door body 10 by grabbing the door panel 12. Here, the door panel 12 includes the top wall 101, the bottom wall 102, and the side wall 103 of the door body 10. The handle 30 is arranged on the top wall 101. The user can grab the handle 30 arranged on the top wall 101 to pull the door body 10 open or close the door body 10.

Figure 41:
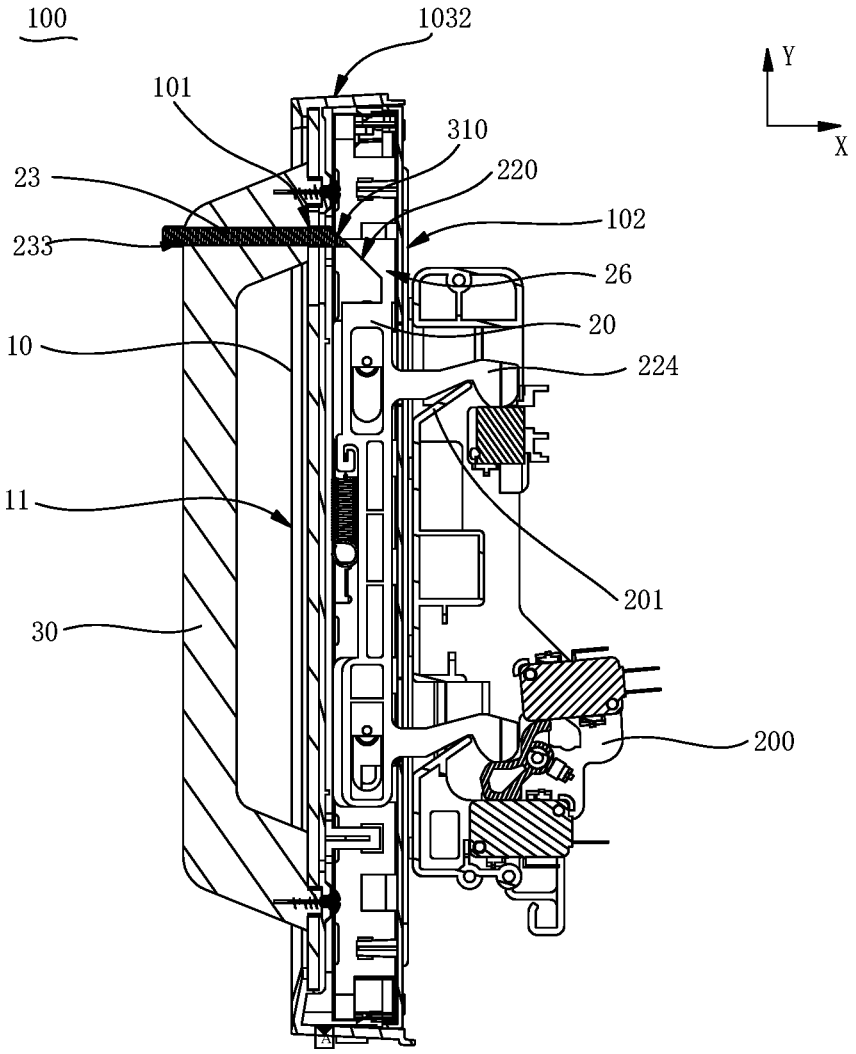
FIG. 41 is a schematic cross-sectional view of an engagement member of a door body structure at a first position according to an embodiment of the present disclosure.
Figure 42:
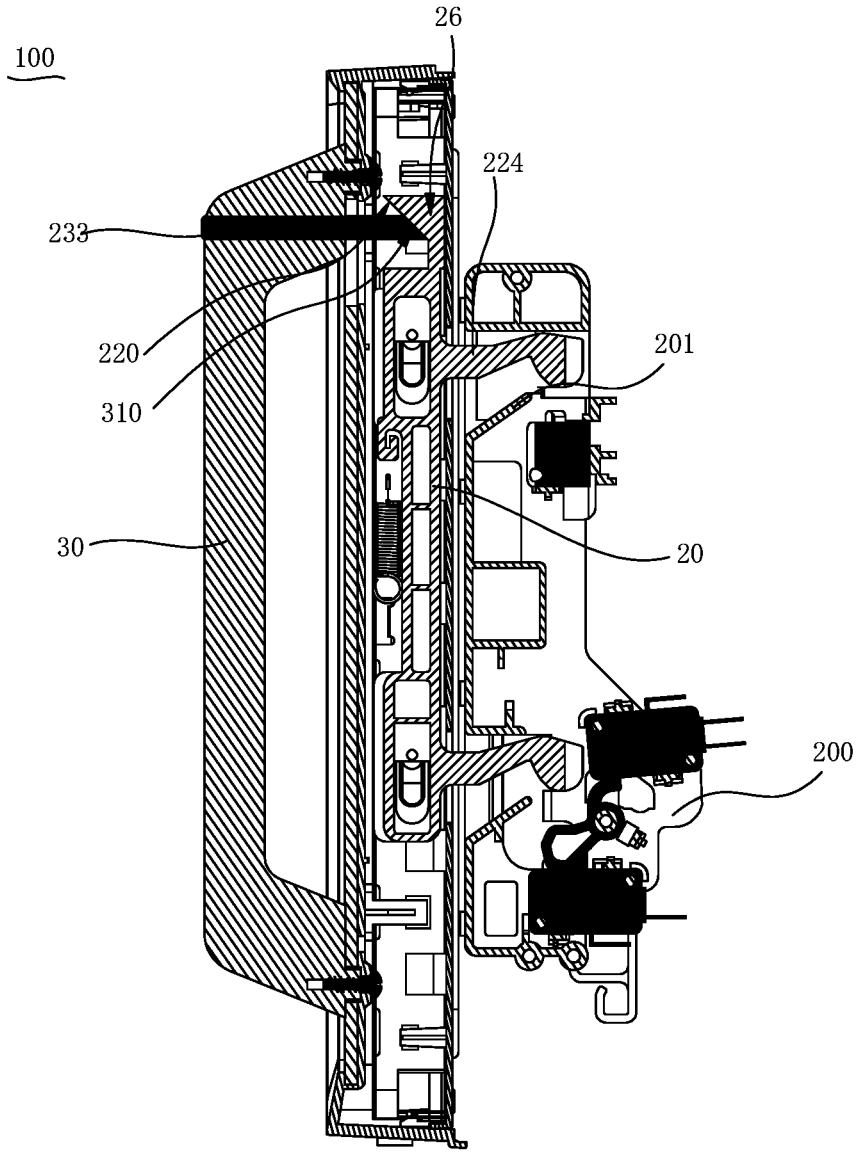
FIG. 42 is a schematic cross-sectional view of an engagement member of a door body structure at a second position according to an embodiment of the present disclosure.

Referring to FIG. 39, FIG. 41, and FIG. 42, the engagement member 20 is arranged on the door body 10. For example, the engagement member 20 is arranged on the first side wall 1031 of the door body 10.

The engagement member 20 includes a hook 224. Here, the engagement member 20 can be driven by the switching member 23 to move relative to the door body 10 between the first position and the second position.

For example, the engagement member 20 is engaged with the limiting portion 201 when the engagement member 20 is at the first position, and moves away from the limiting portion 201 when the engagement member 20 is at the second position.

For example, when the engagement member 20 is at the first position, the hook 224 of the engagement member 20 is engaged with the limiting portion 201 to prevent the door body 10 from being opened. As illustrated in FIG. 41, it can be seen that when the engagement member 20 is at the first position, the hook 224 can be brought into contact with the limiting portion 201 when the user pulls the door body 10 to provide a force that acts in opposition to the force exerted by the user for pulling the door body 10, thereby preventing the door body 10 from being opened.

Also, as illustrated in FIG. 42, when the engagement member 20 is at the second position, the hook 224 may be disengaged from the limiting portion 201 in such a manner that the hook 224 is no longer in contact with the limiting portion 201, and thus cannot provide the force that acts in opposition to the force exerted by the user for pulling the door body 10, thereby allowing the door body 10 to be opened.

With continued reference to FIG. 39, FIG. 41, and FIG. 42, the switching member 23 extends into the door body 10 from an outer side of the door body 10, is movable relative to the door body 10, and is capable of cooperating with the engagement member 20. Here, the outer side of the door body 10 is a side of the door body 10 facing away from the housing 200. That is, the switching member 23 passes through the handle 30 and the door plate 11 from the side of the door body 10 facing away from the housing 200, and is connected to the engagement member 20. When the switching member 23 moves relative to the door body 10, the engagement member 20 can be driven to move relative to the door body 10 between the first position and the second position.

For example, as illustrated in FIG. 39 and FIG. 41, the switching member 23 includes an operating member 233 movably arranged on the handle 30 and partially exposed from the handle 30. Here, the operating member 233 is configured to move the engagement member 20 to move, relative to the door body 10, between the first position and the second position.

For example, when grabbing the handle 30, the user can press the operating member 233 exposed from the handle 30 to allow the engagement member 20 to move relative to the door body 10 between the first position and the second position. Here, as illustrated in FIG. 39, the handle 30 has a mounting hole 120 defined therein. The switching member 23 passes through the mounting hole 120 and is movable within the mounting hole 120.

In an embodiment, as illustrated in FIG. 41, the operating member 233 is operated in an operation direction perpendicular to the movement direction of the engagement member 20. As illustrated in FIG. 41, when the operating direction of the operating member 233 is a direction X, the movement direction of the engagement member 20 is a direction Y, and an included angle between the direction X and the direction Y is 90 degrees. That is, when the operating member 233 is operated in the direction X, the engagement member 20 moves in the direction Y, and when the operating member 233 is operated in a direction opposite to the direction X, the engagement member 20 moves in a direction opposite to the direction Y.

Figure 43:
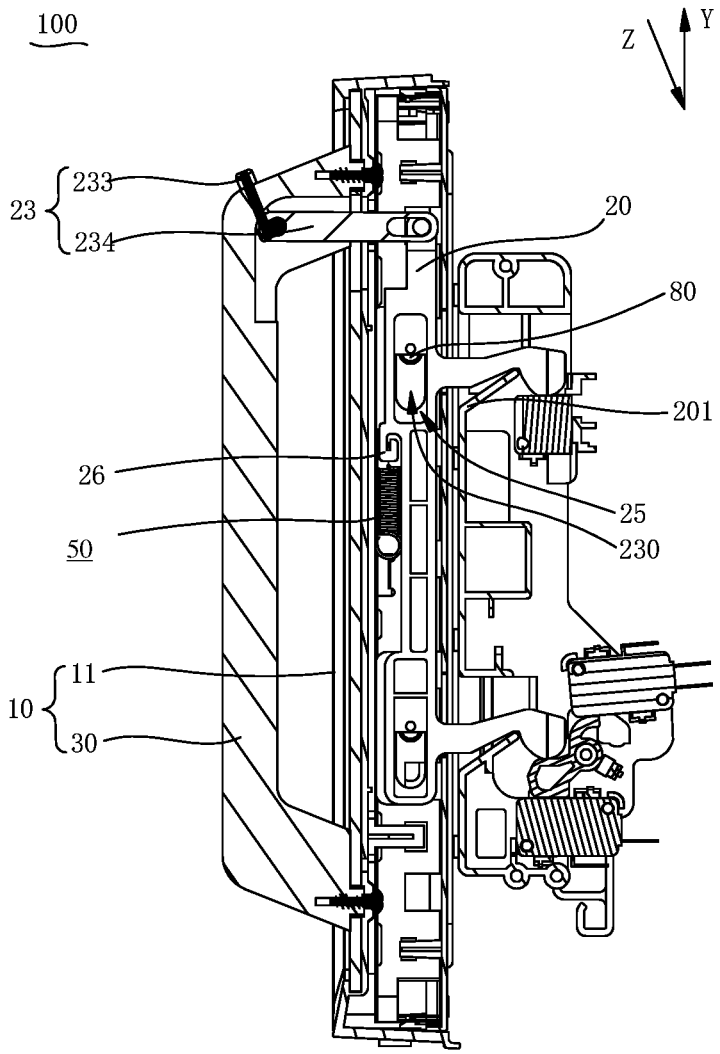
FIG. 43 is a schematic cross-sectional view of an engagement member of a door body structure at a first position according to another embodiment of the present disclosure.

In another embodiment, the operating member 233 may be operated in an operating direction oblique to the movement direction of the engagement member 20. As illustrated in FIG. 43, when the operating direction of the operating member 233 is a direction Z, the movement direction of the engagement member 20 is the direction Y, and an included angle between the direction Z and the direction Y is less than 90 degrees. That is, when the operating member 233 is operated in the direction Z, the engagement member 20 moves in the direction Y, and when the operating member 233 is operated in a direction opposite to the direction Z, the engagement member 20 moves in a direction opposite to the direction Y.

Referring to FIG. 41 and FIG. 42, it can be seen that when the operating member 233 is exposed from the handle 30, the engagement member 20 is at the first position. When the operating member 233 is pressed by the user without being exposed from the handle 30, the engagement member 20 is at the second position.

Further, when the operation direction of the operating member 233 is perpendicular to the movement direction of the engagement member 20, the operating member 233 extends into the door plate 11 from an outer side of the door plate 11 (a side of the door plate 11 facing away from the housing 200). The operation member 233 has a driving surface 310 formed at an end thereof extending into the door plate 11, and the engagement member 20 has a driven surface 220 formed at an end thereof that cooperates with the operating member 233. A contact surface between the driving surface 310 and the driven surface 220 is arranged to be inclined to the movement direction of the engagement member 20.

For example, as illustrated in FIG. 41, the operating member 233 is a pin-shaped member formed with the driving surface 310, and the engagement member 20 has an extending portion 26 provided on an upper part thereof. The extending portion 26 extends in the movement direction and has the driven surface 220 provided on an end thereof facing towards a front side of the door plate 11. Here, the upper part of the engagement member 20 refers to an end thereof that is in contact with the driving surface 310, and the front side of the door plate 11 refers to the second side wall 1032 of the door body 10. That is, the extending portion 26 has the driven surface 220 formed on an end thereof facing towards the second side wall 1032.

In this manner, when the operating member 233 is pressed by the user to move in a direction close to the housing 200, the driving surface 310 can slide relative to the driven surface 220 to push the driven surface 220, thereby driving the engagement member 20 to move.

For example, the driving surface 310 of the operating member 233 is movable within the door body 10 to drive the engagement member 20 to move relative to the door body 10 between the first position and the second position. Therefore, when the operating member 233 is pressed, the operating member 233 can drive the driving surface 310 to move within the door body 10 in such a manner that the driven surface 220 is driven to slide along an inclination angle of the driving surface 310, thereby driving the engagement member 20 to move away from the limiting portion 201. In this case, the engagement member 20 is at the second position. That is, when the operating member 233 is pressed by the user, the switching member 23 can drive the engagement member 20 away from the limiting portion 201 to allow the hook 224 to be disengaged from the limiting portion 201, such that the door body 10 can be opened.

Here, a movement distance of the engagement member 20 controlled by the switching member 23 is related to a length of a contact surface between the driving surface 310 and the driven surface 220. It should be understood that, as the length of the contact surface increases, a sliding distance of the driving surface 310 relative to the driven surface 220 increases, i.e., a movement distance of the driven surface 220 pushed by the driving surface 310 increases, and thus the movement distance of the engagement member 20 increases.

For example, the length of the contact surface between the driving surface 310 and the driven surface 220 is also related to a contact thickness between the hook 224 and the limiting portion 201. The length of the contact surface between the driving surface 310 and the driven surface 220 increases as the contact thickness between the hook 224 and the limiting portion 201 increases, thereby ensuring that the hook 224 can be disengaged from the limiting portion 201. It should be understood that a minimum length of the contact surface should be equal to the contact thickness between the hook 224 and the limiting portion 201 to ensure that the door body 10 can be opened after the operating member 233 is pressed by the user.

It should be noted that both the driving surface 310 and the driven surface 220 may be flat surfaces; or the driving surface 310 may be a curved surface and the driven surface 220 may be a flat surface; or the driving surface 310 may be a flat surface and the driven surface 220 may be a curved surface; or both the driving surface 310 and the driven surface 220 may be curved surfaces.

Figure 44:
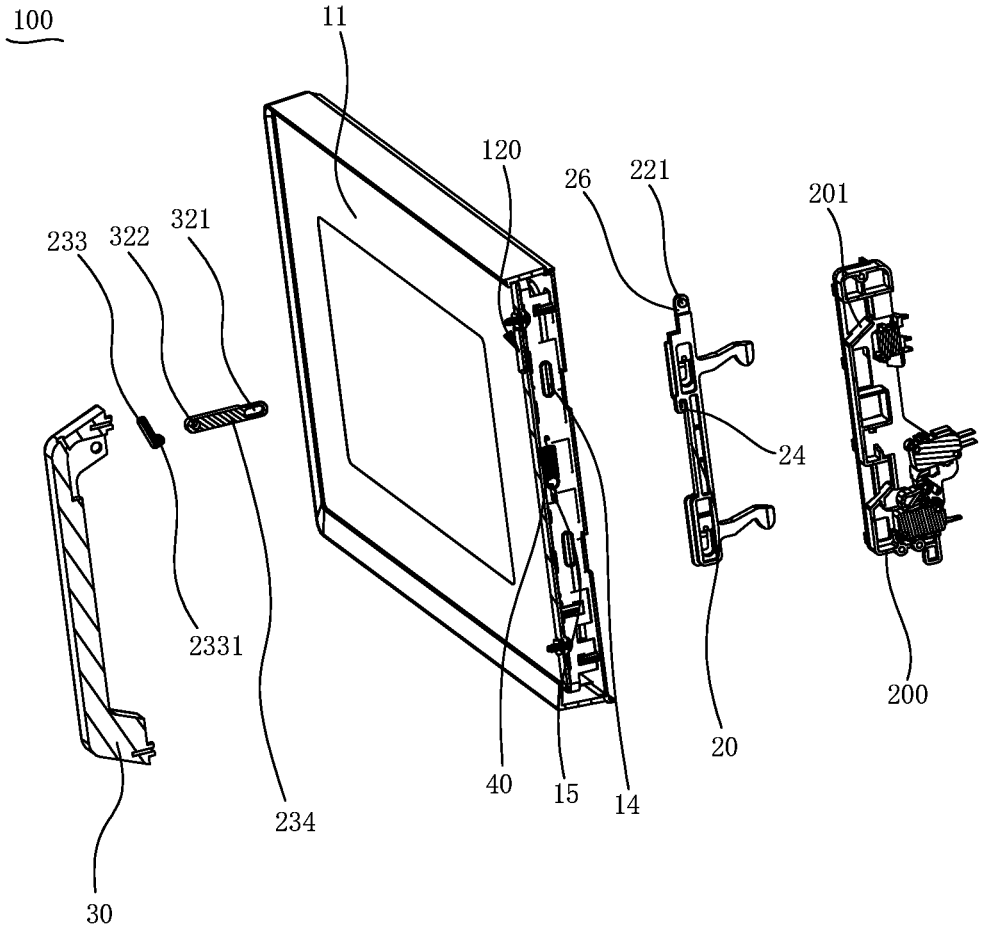
FIG. 44 is a schematic exploded view showing a door body structure according to another embodiment of the present disclosure.
Figure 45:
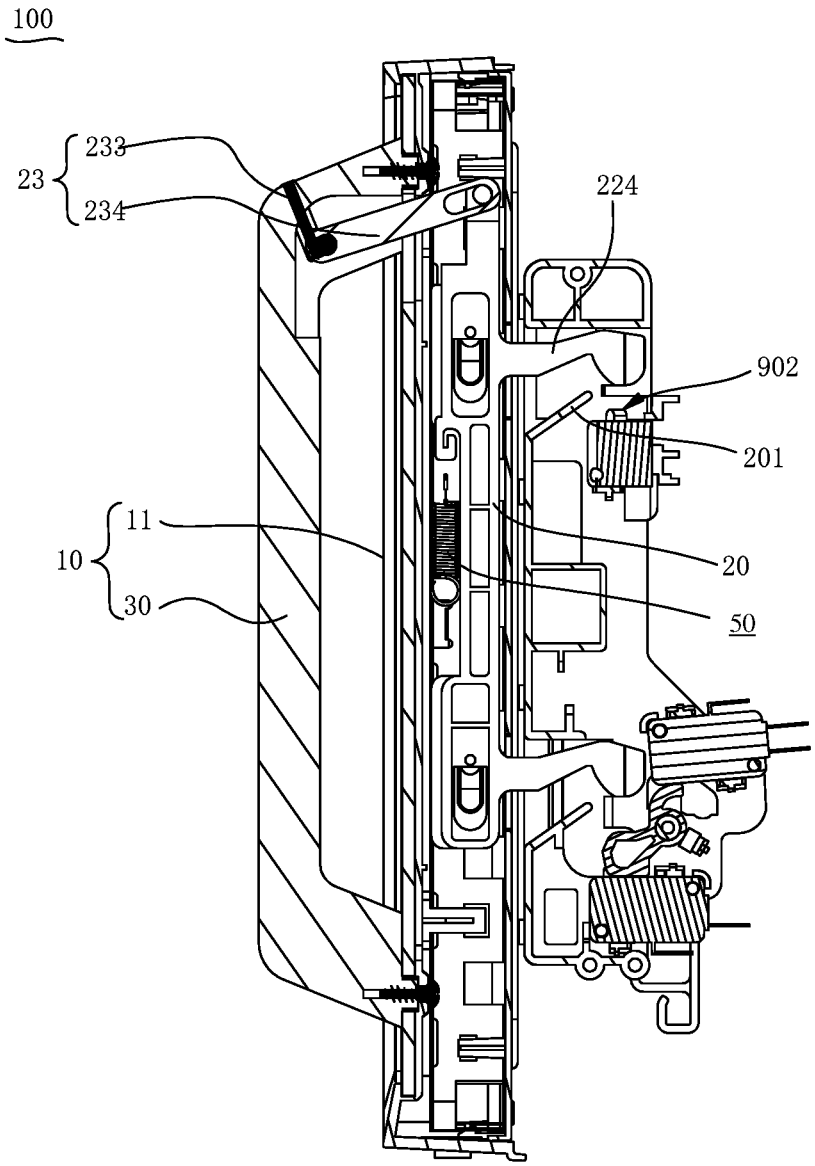
FIG. 45 is a schematic exploded view of an engagement member of a door body structure at a second position according to another embodiment of the present disclosure.

Referring to FIG. 43 to FIG. 45, when the operation direction of the operating member 233 is inclined to the movement direction of the engagement member, the switching member 23 further includes a linkage member 234. Here, the operating member 233, the linkage member 234, and the engagement member 20 may form a link structure.

For example, as can be seen from the above description, the handle 30 has the mounting hole 120 defined therein, and the operating member 233 may pass through the handle 30 and arranged within the mounting hole 120, and thus the linkage member 234 can pass through both the handle 30 and the door plate 11. That is, the linkage member 234 passes through both the mounting hole 120 and the top wall 101, and the engagement member 20 is arranged on the door plate 11 (the first side wall 1031). In this case, as illustrated in FIG. 43, one end of the linkage member 234 is movably connected to the operating member 233, and the other end of the linkage member 234 is movably connected to the engagement member 20.

For example, referring to FIG. 43 and FIG. 44, the linkage member 234 has an oblong opening 321 defined at the end thereof connected to the engagement member 20, and extends into the handle 30 from the outer side of the door plate 11. The extending portion 26 provided on the upper part of the engagement member 20 and extending in the movement direction of the engagement member 20 has a connecting post 221 provided thereon, and the connecting post 221 passes through the oblong opening 321. It should be understood that the connecting post 221 is connected to the oblong opening 321 to connect the engagement member 20 to the linkage member 234.

In addition, the linkage member 234 has a though hole 322 defined at an end thereof connected to the operating member 233. The operating member 233 has a boss 2331 provided thereon. The boss 2331 passes through the through hole 322 and is engaged with the through hole 322. That is, the boss 2331 is connected to the through hole 322 to allow the linkage member 234 to be connected to the operating member 233. In this manner, the operating member 233, the linkage member 234, and the engagement member 20 are movably connected to each other.

In an embodiment, when the operating member 233 exposed from the handle 30 is pressed by the user, the boss 2331 can drive the linkage member 234 to rotate around the connecting post 221 in such a manner that the engagement member 20 is driven to move away from the limiting portion 201 to separate the hook 224 from the limiting portion 201, thereby opening the door body 10.

It should be understood that, in the above two embodiments, by setting a cooperation relationship between the operating direction of the operating member 233 and the movement direction of the engagement member 20, it can be realized that when pressed, the operating member 233 on the handle 30 can drive the engagement member 20 to move away from the limiting portion 201, i.e., drive the engagement member 20 into the second position, such that the hook 224 can be disengaged from the limiting portion 201 to allow the door body 10 to be opened.

In some embodiments, the door body 10 may include no handle 30. In this case, the operating member 233 may pass through the top wall 101, and may be movable within the door body 10 to allow the switching member 23 to drive the engagement member 20 to move between the first position and the second position, thereby realizing a purpose of opening or closing the door body 10. In addition, the top wall 101 may have a recess (not illustrated) defined on an outer surface thereof (a surface facing away from the bottom wall 102), and a part of the operating member 233 exposed from the top wall 101 may be spaced apart from the recess by a predetermined distance. Therefore, when the user needs to open the door body 10 of the cooking device 1000, likewise, the user can press the operating member 233 and grab the recess to open the door body 10 of the cooking device 1000. In this manner, a material for manufacturing the cooking device 1000 can be saved to lower manufacturing costs.

In some embodiments, the door body structure 100 may further include a blocking member (not illustrated). The blocking member is arranged on the first side wall 1031 of the door body 10.

For example, referring to FIG. 43, the engagement member 20 may also have a sliding groove 25 defined therein. The sliding groove 25 has a limiting hole 230 defined in a bottom thereof. The limiting hole 230 extends in the movement direction of the engagement member 20. The blocking member passes through the limiting hole to be arranged on the side wall 103. Here, the movement distance of the engagement member 20 may be determined based on a length of the limiting hole 230 in the movement direction of the engagement member 20.

For example, the blocking member may be fixedly arranged on the first side wall 1031, and pass through the limiting hole 230. The blocking member may include a blocking head (not illustrated) and a blocking post (not illustrated). A size of the blocking post is smaller than or equal to a width of the limiting hole 230, and a width of the blocking head is greater than the width of the limiting hole 230, which prevent the blocking member from being disengaged from the limiting hole 230. In this manner, when the engagement member 20 moves between the first position and the second position, if a hole wall of the limiting hole 230 is brought into contact with the blocking post, the engagement member 20 can no longer move. That is, the movement distance of the engagement member 20 may be determined based on the length of the limiting hole 230 in the movement direction of the engagement member 20.

Here, a distance between the blocking head and the first side wall 1031 may be equal to a thickness of the limiting hole 230. In this case, it can be ensured that the engagement member 20 cannot move in a direction close to or away from the first side wall 1031, thereby ensuring the stability of the door body structure 100.

In some embodiments, as illustrated in FIG. 44, the first side wall 1031 may have a limiting groove 14 defined therein, and a blocking member may pass through the limiting hole 230 and arranged within the limiting groove 14. For example, the blocking post is arranged within the limiting groove 14. The size of the blocking post is smaller than or equal to the width of the limiting hole 230, and the width of the blocking head is greater than the width of the limiting hole 230, which prevent the limiting plate from being disengaged from the limiting hole 230. In this manner, when the engagement member 20 moves between the first position and the second position, if a groove wall of the limiting groove 14 in the movement direction of the engagement member 20 is brought into contact with the blocking post, the engagement member 20 can no longer move. That is, a length of the limiting groove 14 can limit the movement distance of the engagement member 20.

Referring to FIG. 43 to FIG. 45, according to the embodiments of the present disclosure, the door body structure 100 further includes a restoring member 50 connected to each of the door body 10 and the engagement member 20. The restoring member is configured to provide the engagement member 20 with a restoring force for moving the engagement member 20 from the second position to the first position.

For example, the door body 10 may further include a first connecting portion 15 arranged on the first side wall 1031. The engagement member 20 may include a second connecting portion 24. The restoring member 50 may be connected to the first connecting portion 15 and the second connecting portion 24 at both ends thereof, respectively.

For example, referring to FIG. 43 and FIG. 45, in a case where the user needs to open the door body 10 of the cooking device 1000, when the user presses the operating member 233 to drive the engagement member 20 to move from the first position to the second position, i.e., the hook 224 is disengaged from the limiting portion 201, the restoring member 50 is driven by the second connecting portion 24 to move into the second position. Since the restoring member 50 is stretched by the first connecting portion 15 and the second connecting portion 24 when the engagement member 20 is at the second position, the restoring member 50 generates the restoring force, which is opposite to the movement direction of the engagement member 20. Therefore, when the user locks the door body 10 of the cooking device 1000, the user can release the operating member 233 in such a manner that the restoring member 50 can drive the engagement member 20 to move from the second position into the first position to allow the hook 224 to be disengaged from the limiting portion 201, thereby preventing the door body 10 from being opened.

In this manner, when the user presses the operating member 233, the driving surface 310 of the operating member 233 is slidable relative to the driven surface 220 of the engagement member 20 to push the driven surface 220 to move, thereby moving the engagement member 20 from the first position into the second position. In this case, the restoring member 50 may generate the force opposite to the movement direction of the engagement member 20. Therefore, when the user releases the operating member 233, the restoring member 50 may drive the engagement member 20 to move from the second position into the first position, such that the hook 224 can be engaged with the limiting portion 201 again to prevent the door body 10 from being opened.

In addition, when the engagement member 20 moves from the second position into the first position, the driven surface 220 is also slidable relative to the driving surface 310 of the operating member 233 to move the operating member 233 away from the door plate 11 (the top wall), thereby exposing the operating member 233 from door body 10 again for the user to open, by pressing the operating member 233, the door body 10 next time.

Referring to FIG. 39, the housing 200 includes the limiting portion 201. The door body structure 100 can prevent the door body 10 from being opened by cooperation of the limiting portion 201 with the engagement member 20.

For example, when the engagement member 20 is at the first position, the engagement member 20 can be engaged with the limiting portion 201 through the hook 224 to prevent the door body 10 from being opened. When the engagement member 20 is at the second position, the hook 224 can be disengaged from the limiting portion 201 to allow the door body 10 to be opened.

Here, a plurality of hooks 224 and a plurality of limiting portions 201 may be provided, and the number of the plurality of hooks 224 may be equal to that of the plurality of limiting portions 201. For example, one, two, three, or more hooks 224 may be provided, and the number of the limiting portion 201 corresponds to that of the hooks 224. For example, when two hooks 224 are provided, two limiting portions 201 are also provided. When one hook 224 and one limiting portion 201 are provided, materials required for the hook 224 and the limiting portion 201 can be reduced, thereby lowering fabrication costs. In a case where the plurality of hooks 224 and the plurality of limiting portions 201 are provided, when the user pulls the door body 10 without pressing the operating member 233, cooperation between the plurality of hooks 224 and the plurality of limiting portions 201 may generate a strong reaction force to prevent the door body 10 from being forcibly pulled open, thereby preventing children from getting hurt when the children forcibly pull the cooking device 1000 open, and ensuring the user experience.

In an embodiment, the hook 224 may be located at a top, middle, or bottom of the engagement member 20, and the limiting portion 201 may be arranged to correspond to the hook 224. For example, when the hook 224 is located at the top of the engagement member 20, the limiting portion 201 may be located at a top of the housing 200. For example, when the hook 224 is located in the middle of the engagement member 20, the limiting portion 201 is located in a middle of the housing 200.

Referring to FIG. 45, according to the embodiments of the present disclosure, the door body structure 100 may further include a damping member (not illustrated). Here, the limiting portion 201 is arranged on a surface, which is opposite to the side wall 13, of the housing 200 of the cooking device 1000. When the hook 224 and the limiting portion 201 are fastened to each other, the hook 224 is abutted against the limiting portion 201.

For example, the limiting portion 201 has a damping component (not illustrated) provided thereon. For example, the damping may be provided at a position where the hook 224 is in contact with the limiting portion 201, or may also be provided in the limiting portion 201 at a position (e.g., a position 902 as illustrated in FIG. 45) where the hook 224 is in contact with the limiting portion 201. Here, the damping may be a foam, pearl cotton, sponge, and the like.

For example, when the engagement member 20 is brought into contact with the limiting portion 201 again due to the restoring force of the restoring member 50, i.e., when the engagement member 20 moves back into the first position, the hook 224 is brought into contact with the limiting portion 201. In this case, the damping member arranged on a surface where the limiting portion 201 is in contact with the engagement member 20 can prevent the engagement member 20 from generating collision sounds when the engagement member 20 rapidly moves back into the first position due to the restoring force. When the engagement member 20 moves towards the second position, the engagement member 20 slides along the sliding groove 25 or the limiting groove 14 to ensure that no loud collision sounds may be generated during fastening or separation (i.e., unlocking or locking) between the engagement member 20 in the door body structure 100 and the limiting portion 201, such that the door body 10 can be opened or closed without any noise, thereby improving the user experience.

Referring to FIG. 39 and FIG. 40, the housing 200 is configured for mounting the door body structure 100 on the cooking device 1000. Also, the housing 200 can be configured for mounting functional modules of the cooking device 1000, such as a display device, a power supply device, and a drive device, to allow the housing 200 to provide protection against dust and water for the functional modules.

According to the embodiments of the present disclosure, in the door body structure 100 and the cooking device 1000, the driven surface 220 may be arranged on the engagement member 20, and the driving surface 310 having a same inclination angle as the driven surface 220 may be arranged on the operating member 233 of the switching member 23. In this manner, when the user presses the operating member 233, the driving surface 310 may be pushed to move in a direction close to the engagement member 20. As illustrated by X in the drawing, the driving surface 310 is below the driven surface 220, and thus can push the driven surface 220 to elevate a height of the driven surface 220. That is, the engagement member 20 is pushed to move towards the second position.

According to the embodiments of the present disclosure, the door body structure 100 further includes the restoring member 50 connected to the second connecting portion of the engagement member 20 and a third connecting portion. When the engagement member 20 is fastened to the limiting portion 201, i.e., when the engagement member 20 is at the first position, the restoring member 50 is not stretched, and thus no elastic force is generated. When the user presses the operating member 233 to move the engagement member 20 towards the second position, the restoring member 50 is stretched. In this case, when the user releases the operating member 233, i.e., when the force exerted by the operating member 233 on the engagement member 20 disappears, the restoring force generated by the restoring member 50 due to the stretching may drive the engagement member 20 to move towards the first position again, and the engagement member 20 may be re-fastened to the limiting portion 201, such that the cooking device 1000 can be opened and closed.

Here, during re-fastening of the engagement member 20 to the limiting portion 201, the driven surface 220 of the engagement member 20 may also push the driving surface 310 to move away from the engagement member 20, thereby ensuring the operating member 233 to move back to allow the user to press the operating member 233 again when using the cooking device 1000 next time.

Further, since the limiting portion 201 is provided with the damping member that attenuates a collision force between the engagement member 20 and the limiting portion 201, an impact, which is generated when the restoring force generated by the restoring part 40 drives the engagement member 20 to move towards the first position to be brought into contact with the limiting portion 201, may be absorbed by the damping member. Therefore, it is possible to ensure that when the engagement member 20 is re-fastened to the restoring member 50, no loud noises may be generated, thereby improving the user experience.

Figure 46:
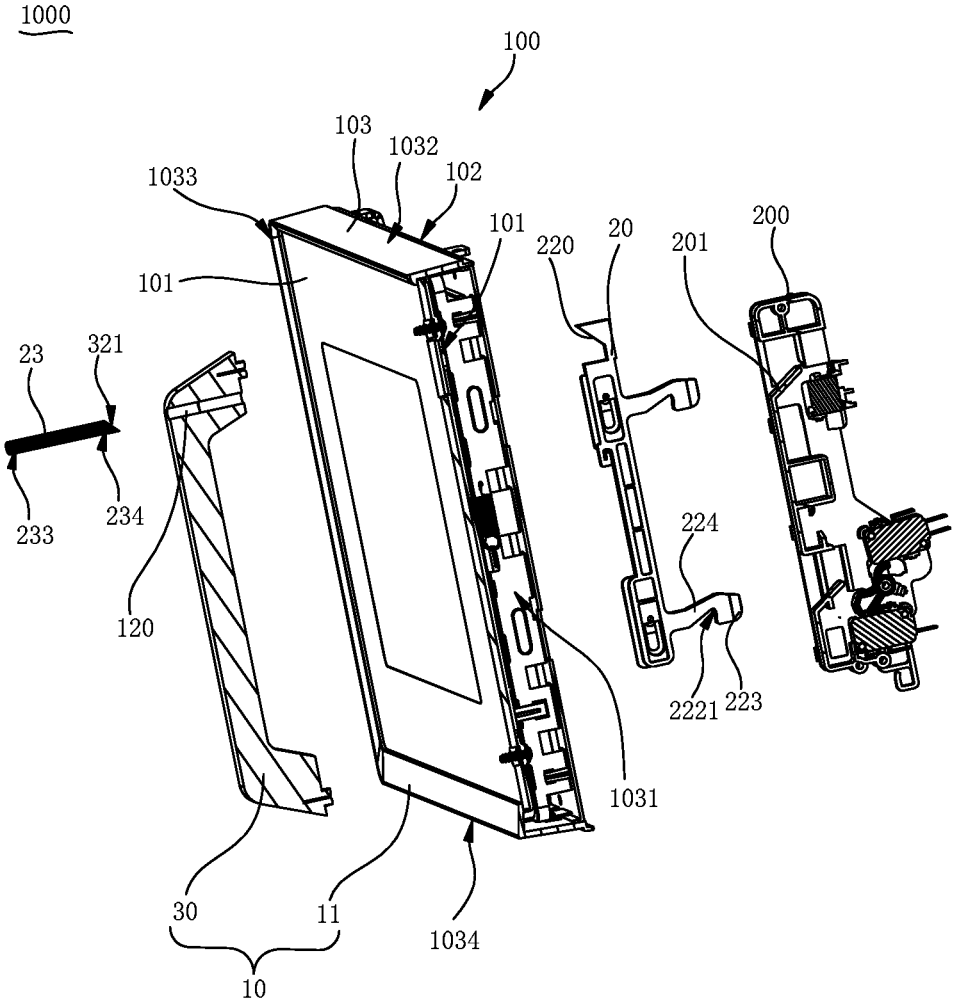
FIG. 46 is a schematic exploded view showing a door body structure according to an embodiment of the present disclosure.

Referring to FIG. 46 and FIG. 40, an embodiment of the present disclosure provides a door body structure 100. The door body structure 100 includes a door body 10, an engagement member 20, and a switching member 23. The door body 10 is connected to a housing 200 of the cooking device 1000 in an openable and closable manner. The housing includes a limiting portion 201. The engagement member 20 is arranged on the door body 10 and includes a hook 224. The hook 224 is formed with a barb structure 223 facing towards the door body 10. The switching member 23 is configured to drive the engagement member 20 to move relative to the door body 10 between a first position and a second position. Here, the switching member 23 extends into the door body 10 from an outer side of the door body 10, and is movable relative to the door body 10. The switching member 23 is capable of cooperating with the engagement member 20. The hook 224 is configured to be engaged with the limiting portion 201 by the barb structure 223 to prevent the door body 10 from being opened when the engagement member 20 is at the first position, and to be disengaged from the limiting portion 201 to allow the door body 10 to be opened when the engagement member 20 is at the second position.

According to the embodiments of the present disclosure, the door body structure 100 can allow the barb structure 223, which is formed by the hook 224, to be engaged with the limiting portion 201 when the engagement member 20 is at the first position, thereby preventing the door body 10 from being opened. Further, since the switching member 23 can drive the engagement member 20 to move relative to the door body 10 between the first position and the second position, and the hook 224 is disengaged from the limiting portion 201 to allow the door body 10 to be opened when the engagement member 20 is at the second position, it is ensured that the door body 10 cannot be directly opened by an external force when the cooking device 1000 is working, thereby preventing children from being injured, and improving the user experience.

Further description will be provided below in conjunction with the accompanying drawings.

Figure 47:
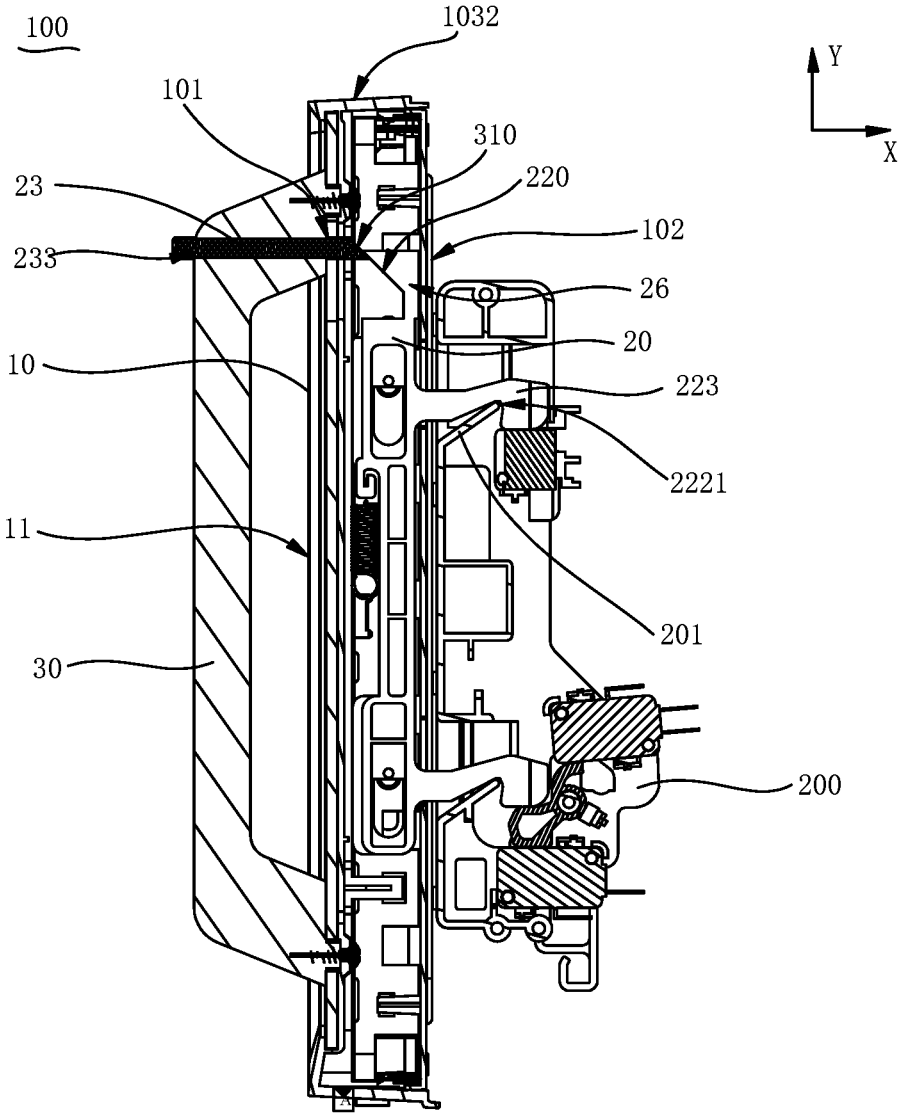
FIG. 47 is a schematic cross-sectional view of an engagement member of a door body structure at a first position according to an embodiment of the present disclosure.
Figure 48:
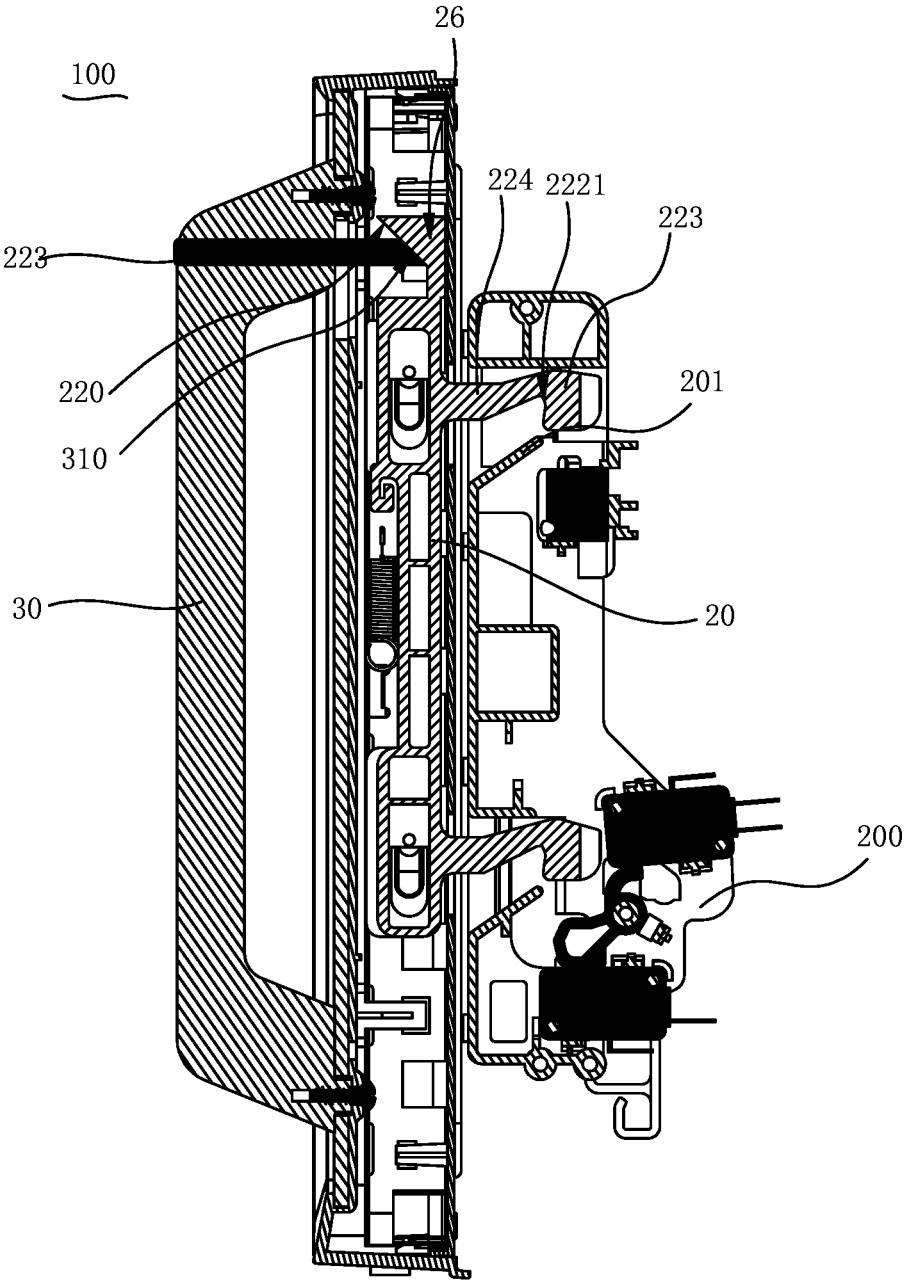
FIG. 48 is a schematic cross-sectional view of an engagement member of a door body structure at a second position according to an embodiment of the present disclosure.
Figure 49:
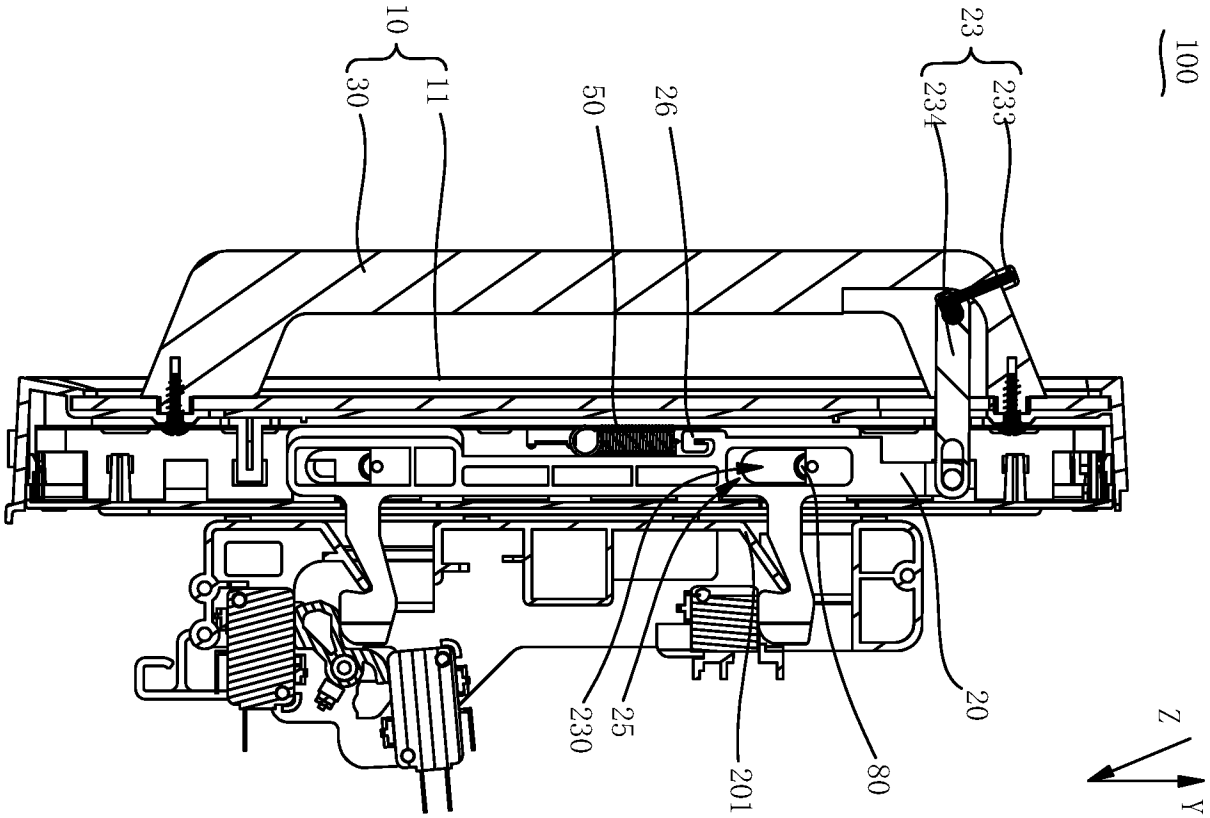
FIG. 49 is a schematic cross-sectional view of an engagement member of a door body structure at a first position according to another embodiment of the present disclosure.
Figure 50:
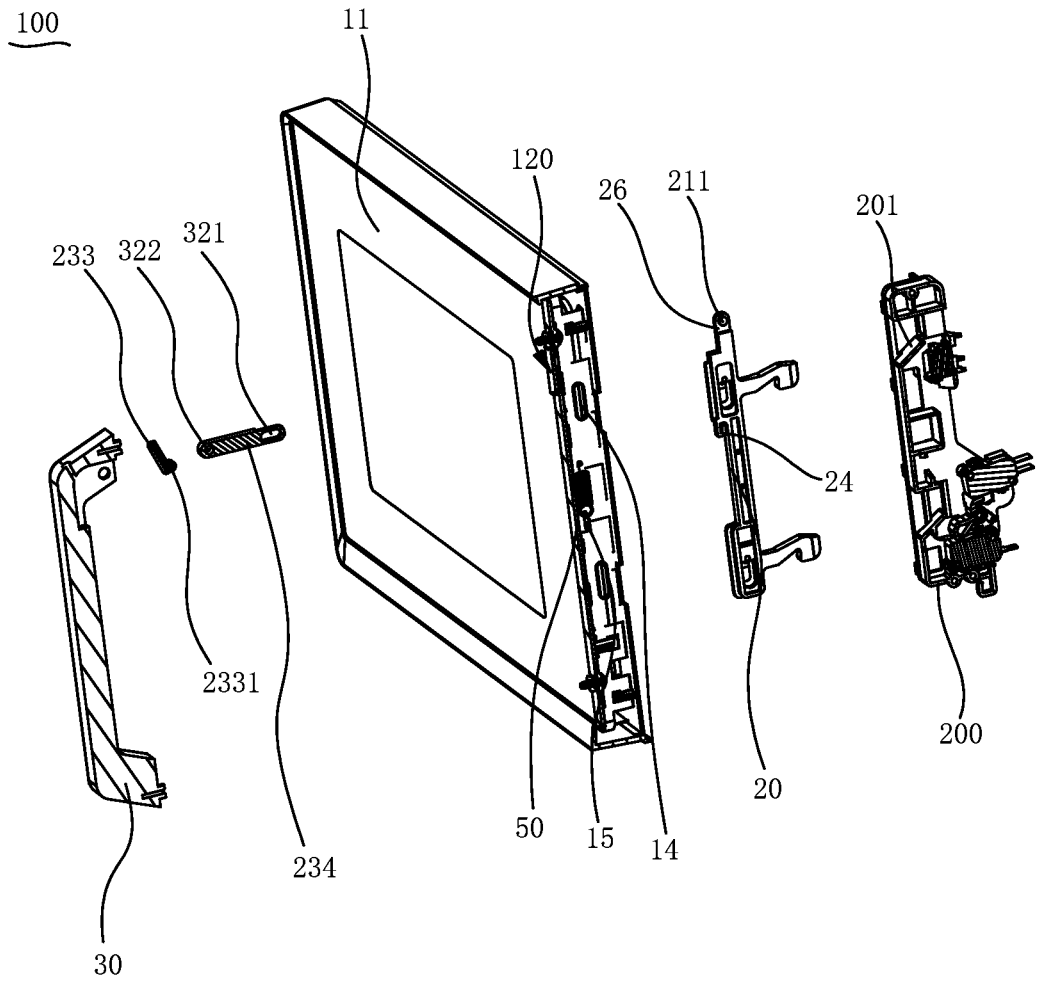
FIG. 50 is a schematic exploded view showing a door body structure according to another embodiment of the present disclosure.

Here, referring to FIG. 47 and FIG. 48, the barb structure 223 includes the engagement surface 2221. The engagement surface 2221 is a contact surface between the barb structure 223 and the limiting portion 201 when the engagement member 20 is at the first position.

It should be understood that when the engagement member 20 is at the first position, the hook 224 can be engaged with the limiting portion 201 through the engagement surface 2221 to prevent the door body 10 from being opened.

When the engagement member 20 is at the second position, the engagement surface 2221 is disengaged from the limiting portion 201, and thus the door body 10 can be opened. Here, an inclination angle of the engagement surface 2221 relative to the door body 10 may be 0 degree, or any angle less than 90 degrees, e.g., 10 degrees, 20 degrees, 30 degrees, and the like.

In an embodiment, it should be understood that when the inclination angle of the engagement surface 2221 relative to the door body 10 is 0 degree, the engagement surface 2221 is parallel to a plane where the bottom wall 102 is located. That is, a surface of the engagement member 20 in contact with the limiting portion 201 is parallel to the bottom wall 102. In this manner, when the engagement member 20 is fastened to the limiting portion 201, since the engagement surface 2221 is parallel to the plane where the bottom wall 102 is located, in a case where a child pulls the door body 10, i.e., a door of the cooking device 1000, the engagement member 20, instead of generating an upward or downward component force, may only generate a force completely opposite to a direction in which the child pulls the door open, which ensures that the child cannot pull open the door of the cooking device 1000, thereby avoiding injuries to the child, and improving the user experience.

In another embodiment, when the inclination angle of the engagement surface 2221 relative to the door body 10 is less than 90 degrees, the barb structure 223 is further bent to be parallel to the bottom wall 102 or towards the bottom wall 102. In this manner, an included angle between the engagement surface 2221 and the plane where the bottom wall 102 is located is an acute angle. When the engagement member 20 is fastened to the limiting portion 201, since the included angle between the engagement surface 2221 and the plane where the bottom wall 102 is located is the acute angle, in a case where a child pulls the door body 10, i.e., the door of the cooking device 1000, even if the child forcibly shakes the door body 10, the barb structure 223 cannot be disengaged from the limiting portion 201, which ensures that the child cannot pull open the door of the cooking device 1000 by force, thereby preventing the child from being injured, and improving the user experience.

For example, the engagement member 20 can be arranged on the limiting portion 201 by the barb structure 223 or the engagement surface 2221 to prevent the door body 10 from being opened when the engagement member 20 is at the first position, and the hook 224 or the engagement surface 2221 may be disengaged from the limiting portion 201 to allow the door body 10 to be opened when the engagement member 20 is at the second position.

Here, a plurality of hooks 224 and a plurality of limiting portions 201 may be provided, and the number of the plurality of hooks 224 may be equal to that of the plurality of limiting portions 201. For example, one, two, three, or more hooks 224 may be provided, and the number of the limiting portions 201 may correspond to that of the hooks 224. For example, when two hooks 224 are provided, two limiting portions 201 are also provided. When one hook 224 and one limiting portion 201 are provided, materials required for the hook 224 and the limiting portion 201 can be reduced, thereby lowering fabrication costs. In a case where the plurality of hooks 224 and the plurality of limiting portions 201 are provided, when the user pulls the door body 10 without pressing the operating member 233, cooperation between the barb structures 223 of the plurality of hooks 224 and the plurality of limiting portions 201 may generate a strong reaction force to prevent the door body 10 from being forcibly pulled open, thereby preventing the child from getting hurt when the child forcibly pull the cooking device 1000 open, and improving the user experience.

Figure 51:
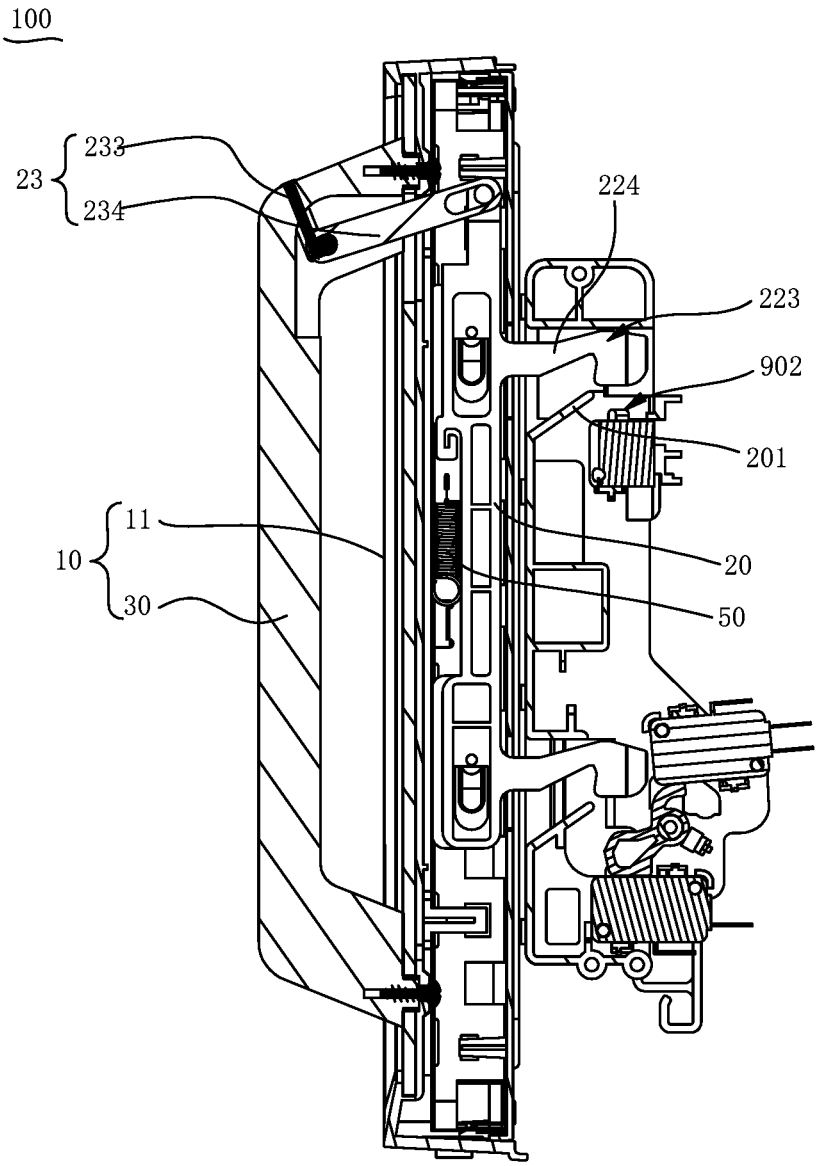
FIG. 51 is a schematic exploded view of an engagement member of a door body structure at a second position according to another embodiment of the present disclosure.

Referring to FIG. 51, according to the embodiments of the present disclosure, the door body structure 100 may further include a damping member (not illustrated). Here, the limiting portion 201 is arranged on a surface, which is opposite to the side wall, of the housing 200 of the cooking device 1000. When the barb structure 223 and the limiting portion 201 are fastened to each other, the engagement surface 2221 is abutted against the limiting portion 201.

For example, the limiting portion 201 has a damping (not illustrated) provided thereon. For example, the damping may be provided at a position where the engagement surface 2221 is in contact with the limiting portion 201, or may be provided in the limiting portion 201 at a position (e.g., a position 902 as illustrated in FIG. 51) where the barb structure 223 is in contact with the limiting portion 201. Here, the damping may be a foam, pearl cotton, sponge, and the like.

For example, when the engagement member 20 is brought into contact with the limiting portion 201 again due to the restoring force of the restoring member 50, i.e., when the engagement member 20 moves back into the first position, the barb structure 223 is brought into contact with the limiting portion 201. In this case, the damping member arranged on the surface where the limiting portion 201 is in contact with the engagement member 20 can prevent the engagement member 20 from generating collision sounds when the engagement member 20 rapidly moves back into the first position due to the restoring force. When the engagement member 20 moves towards the second position, the engagement member 20 slides along the sliding groove 25 or the limiting groove 14 to ensure that no loud collision sounds may be generated during fastening or separation (i.e., the unlocking or locking) between the engagement member 20 in the door body structure 100 and the limiting portion 201, such that the door body 10 can be opened or closed without any noise, thereby improving the user experience.

In the description of this specification, descriptions with reference to the terms "an embodiment", "some embodiments", "illustrative embodiments", "an example", "a specific example", "some examples", etc., mean that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

Although embodiments of the present disclosure have been illustrated and described, it is conceivable for those skilled in the art that various changes, modifications, replacements, and variations can be made to these embodiments without departing from the principles and spirit of the present disclosure. The scope of the present disclosure shall be defined by the claims as appended and their equivalents.

What is claimed is:

1. A door body structure, applied in a cooking device, wherein the cooking device comprises a housing comprising a limiting portion, the door body structure comprising:

a door body arranged on the housing in an openable and closable manner;

an engagement member arranged on the door body and comprising a hook, wherein the hook is configured to be engaged with or disengaged from the limiting portion;

a switching member configured to cooperate with the engagement member to drive the engagement member to move between a first position and a second position, wherein the switching member comprises a connecting segment connected to the engagement member and an operating member slidingly engaged with the connecting segment; and a handle provided on the door body and having a locking groove defined therein, wherein when the engagement member is located at the first position, the hook is engaged with the limiting portion, and at least a part of the operating member is located within the locking groove to limit a movement of the engagement member; and wherein when the operating member is disengaged from the locking groove, the switching member is capable of driving the engagement member to move relative to the door body.

2. The door body structure according to claim 1, wherein the locking groove is disposed within an accommodation space defined between the handle and the door body.

3. The door body structure according to claim 2, wherein an angle is formed between a sliding direction of the operating member and a movement direction of the engagement member.

4. The door body structure according to claim 3, wherein:

a part of the connecting segment is located within the accommodation space, and the operating member is configured to be slidingly engaged with the part of the connecting segment located within the accommodation space; and when the operating member is disengaged from the locking groove, the handle being pulled towards a direction facing away from the door body drives the engagement member to move in such a manner that the hook is disengaged from the limiting portion.

5. The door body structure according to claim 2, wherein:

a surface of the handle facing towards the door body is an inner side surface comprising a first engagement surface and a holding surface, and the locking groove is connected to the first engagement surface at a top surface thereof and is connected to the holding surface at a bottom surface thereof to define a stepped surface, the stepped surface being located below the connecting segment to limit a movement of the connecting segment.

6. The door body structure according to claim 1, wherein one of the operating member and the connecting segment has a sliding rail provided thereon and the other one of the operating member and the connecting segment has a sliding groove defined therein, and wherein the sliding rail and the sliding groove are slidably engaged with each other.

7. The door body structure according to claim 1, wherein the operating member is made of a flexible material for attenuating, when the operating member is entering the locking groove, a collision force between the operating member and the locking groove.

8. The door body structure according to claim 1, wherein the hook is formed into a downwardly bent barb structure.

9. The door body structure according to claim 8, wherein:

the hook comprises a connecting arm and an engagement portion, the connecting arm is connected to a main body of the engagement member, and the engagement portion extends from an end of the connecting arm facing away from the main body towards the door body while being bent to form the barb structure.

10. The door body structure according to claim 1, wherein:

the door body has a through hole defined therein, and a part of the engagement member passes through the through hole to be positioned outside the door body to define the connecting segment.

11. The door body structure according to claim 1, wherein:

the operating member extends obliquely upwards in a direction from the handle to the door body; or the operating member extends obliquely downwards in a direction from the handle to the door body.

12. A door body structure comprising:

a door body connected to a housing in an openable and closable manner, wherein the housing comprises a limiting portion;

an engagement member arranged on the door body and comprising a hook, wherein the hook is formed with a barb structure facing towards the door body;

a switching member configured to drive the engagement member to move relative to the door body between a first position and a second position; and a handle fixed on an outer side of the door body, wherein:

the switching member is formed by a part of the engagement member protruding from an outer side of the door body, the hook is configured to be engaged with the limiting portion by the barb structure to prevent the door body from being opened when the engagement member is at the first position, the hook is configured to be disengaged from the limiting portion to allow the door body to be opened when the engagement member is at the second position, an accommodation space is defined between the handle and the door body, and the switching member is at least partially accommodated within the accommodation space.

13. The door body structure according to claim 12, wherein the engagement member comprises a sliding portion, the hook is fixedly connected to the sliding portion and protrudes from the door body to extend towards the housing, and wherein the switching member is fixedly connected to the sliding portion, extends towards the outer side of the door body, and is capable of driving the sliding portion to move relative to the door body between the first position and the second position.

14. The door body structure according to claim 13, wherein the hook comprises a connecting arm and an engagement portion, wherein the connecting arm is connected to the sliding portion, and wherein the engagement portion extends from an end of the connecting arm facing away from the sliding portion towards the door body while being bent to form the barb structure.

15. The door body structure according to claim 14, wherein the connecting arm comprises a connecting surface extending along the sliding portion towards the engagement portion, wherein the engagement portion comprises an engagement surface connected to the connecting surface, an angle between the connecting surface and the engagement surface being an acute angle, and wherein the engagement surface extends towards the sliding portion from the connecting surface.

16. The door body structure according to claim 12, wherein the engagement member is slidable relative to the door body in an upward-downward direction, the first position being below the second position.

17. The door body structure according to claim 13, wherein the hook is one of a plurality of hooks provided at intervals in a sliding direction of the sliding portion.

18. The door body structure according to claim 13, wherein the switching member, the sliding portion, and the hook are formed into one piece.

19. The door body structure according to claim 12, wherein the handle comprises an inner side surface close to the door body, the accommodation space is defined between the inner side surface and the door body, the inner side surface has a receiving groove defined therein, the receiving groove has a shape matched with that of the switching member, and the switching member is at least partially received within the receiving groove and movable within the receiving groove.

20. The door body structure according to claim 19, wherein the inner side surface comprises a holding surface facing towards the door body and the switching member comprises a connecting segment and an operating member, wherein the connecting segment is connected to the engagement member and movably arranged within the receiving groove, wherein the operating member is movably arranged on the handle and partially protrudes towards the door body from the holding surface, and wherein the operating member is configured to cooperate with the connecting segment to move the engagement member between the first position and the second position; and wherein the operating member is operated in an operation direction perpendicular to a movement direction of the engagement member, or in an operation direction oblique to a movement direction of the engagement member.

21. The door body structure according to claim 20, wherein the operating member has a driving surface formed at an end thereof facing towards the connecting segment, wherein the connecting segment has a driven surface formed at an end thereof that cooperates with the operating member, and wherein a plane formed by contact between the driving surface and the driven surface is arranged to be inclined relative to the operation direction of the operating member; and wherein both the driving surface and the driven surface are flat surfaces, or at least one of the driving surface and the driven surface is a curved surface.

22. The door body structure according to claim 12, further comprising a jacket arranged on the switching member and made of a damping material, wherein when the engagement member is at the first position or the second position, the jacket is abutted against the handle.

23. The door body structure according to claim 22, wherein the jacket extends obliquely upwards in a direction from the handle to the door body; or the jacket extends obliquely downwards in a direction from the handle to the door body.

* * * * *